US006952852B2

(12) United States Patent
Reeder et al.

(10) Patent No.: US 6,952,852 B2
(45) Date of Patent: Oct. 11, 2005

(54) MATTRESS STRUCTURE

(75) Inventors: Ryan A. Reeder, Brookville, IN (US); James R. Stolpmann, Charleston, SC (US); Roger D. Dalton, Monks Corner, SC (US); Steven R. Westerfeld, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/745,143

(22) Filed: Dec. 23, 2003

(65) Prior Publication Data

US 2004/0133987 A1 Jul. 15, 2004

Related U.S. Application Data

(60) Continuation of application No. 10/186,782, filed on Jul. 1, 2002, now Pat. No. 6,687,935, which is a continuation of application No. 09/484,710, filed on Jan. 18, 2000, now Pat. No. 6,460,209, which is a division of application No. 09/064,297, filed on Apr. 22, 1998, now Pat. No. 6,115,861, and a continuation-in-part of application No. 09/033,116, filed on Mar. 2, 1998, now Pat. No. 6,378,152, which is a division of application No. 08/565,409, filed on Nov. 30, 1995, now Pat. No. 5,815,865.

(60) Provisional application No. 60/061,492, filed on Oct. 9, 1997, provisional application No. 60/061,494, filed on Oct. 9, 1997, and provisional application No. 60/066,627, filed on Nov. 26, 1997.

(51) Int. Cl.[7] ..... A47C 27/15

(52) U.S. Cl. ..... 5/727; 5/740; 5/691; 5/723; 5/411

(58) Field of Search ..... 5/690, 691, 722, 5/723, 727, 730, 737–740, 925, 926, 411, 420

(56) References Cited

U.S. PATENT DOCUMENTS

| | | | | |
|---|---|---|---|---|
| 595,734 A | 12/1897 | Rand et al. | ..... | 5/710 |
| 757,414 A | 4/1904 | Rogers | ..... | 5/691 X |
| 853,049 A | 5/1907 | Western | ..... | 5/738 |
| 1,123,345 A | 1/1915 | Micon | ..... | 5/690 |
| 1,323,610 A | 12/1919 | Price | ..... | 5/706 |

(Continued)

FOREIGN PATENT DOCUMENTS

| | | | | |
|---|---|---|---|---|
| CA | 670328 | * 9/1963 | ..... | 5/411 |
| CH | 52674 | 3/1911 | ..... | 5/738 |
| CH | 678-390 | 9/1991 | | |
| DE | 1114015 | 9/1961 | | |
| EP | 0 220 708 | 5/1987 | | |

(Continued)

OTHER PUBLICATIONS

"Introducing a revolutionary way to improve your sleep.", Select Comfort Corporation, advertising literature, 1996.

"Select Comfort Adjustable Firmness Sleep Systems," Select Comfort Corporation, advertising literature, date unknown.

*Primary Examiner*—Robert G. Santos
(74) *Attorney, Agent, or Firm*—Barnes & Thornburg LLP

(57) ABSTRACT

A mattress (900) provides a user with three-dimensional firmness zoning, the mattress (900) cooperating with a mattress shell (720). The mattress (900) includes a plurality of longitudinally spaced, transversely extending resilient blocks (910) being independently movable relative to one another, an inflatable bladder (914) positioned to lie upon the top side of at least one of the blocks (910), and a topper (912) positioned to lie upon the inflatable bladder (914), the topper including opposite ends configured for attachment to the shell (720).

11 Claims, 41 Drawing Sheets

U.S. PATENT DOCUMENTS

| | | | | | |
|---|---|---|---|---|---|
| 1,394,061 | A | | 10/1921 | Bernstein | 5/690 |
| 1,423,416 | A | | 7/1922 | Gomes | 4/738 X |
| 1,579,074 | A | | 3/1926 | Burton | 5/690 |
| 1,841,410 | A | | 1/1932 | Karr | 5/691 X |
| 1,914,661 | A | | 6/1933 | Burke | 5/722 |
| 2,099,427 | A | | 11/1937 | Karr | 5/500 |
| 2,245,909 | A | | 6/1941 | Enfiajian | 5/710 |
| 2,332,957 | A | | 10/1943 | Weisglass | 5/690 X |
| 2,359,958 | A | | 10/1944 | Martin | 5/690 |
| 2,373,047 | A | | 4/1945 | Pabst | 5/690 |
| 2,651,788 | A | | 9/1953 | Forwood | 5/716 |
| 2,995,762 | A | * | 8/1961 | Albinson | 5/411 |
| 3,080,578 | A | | 3/1963 | Novascone | 5/720 |
| 3,080,720 | A | | 3/1963 | Downs et al. | 60/581 |
| 3,110,042 | A | | 11/1963 | Slemmons | 5/727 X |
| 3,118,153 | A | * | 1/1964 | Hood | 428/218 |
| 3,138,807 | A | | 6/1964 | Blecker | 5/720 |
| 3,293,671 | A | | 12/1966 | Griffin | 5/420 X |
| 3,419,920 | A | | 1/1969 | Maddux et al. | 5/695 |
| 3,521,311 | A | | 7/1970 | Cohen | 5/727 |
| 3,534,417 | A | | 10/1970 | Boyles | 5/728 |
| 3,574,873 | A | | 4/1971 | Weinstein | 5/727 |
| 3,595,223 | A | | 7/1971 | Castagna | 601/55 |
| 3,731,327 | A | | 5/1973 | Frey | 5/690 |
| 3,837,020 | A | | 9/1974 | Bosch | 5/411 |
| 3,846,857 | A | | 11/1974 | Weinstock | 5/727 |
| 3,848,282 | A | | 11/1974 | Viesturs | 5/682 |
| 3,863,387 | A | | 2/1975 | Webster et al. | 5/420 X |
| 3,939,508 | A | * | 2/1976 | Hall et al. | 5/727 |
| 3,950,800 | A | | 4/1976 | Garshfield | 5/738 |
| 3,974,532 | A | | 8/1976 | Ecchuya | 5/724 |
| 4,042,988 | A | | 8/1977 | Holliday | 5/706 X |
| 4,053,957 | A | | 10/1977 | Regan | 5/727 |
| 4,070,719 | A | | 1/1978 | Morgan | 5/740 |
| 4,086,675 | A | | 5/1978 | Talbert et al. | 5/655.9 |
| 4,161,045 | A | | 7/1979 | Regan | 5/728 |
| 4,180,877 | A | | 1/1980 | Higgins | 5/263 |
| 4,224,706 | A | | 9/1980 | Young et al. | 5/706 X |
| 4,306,322 | A | | 12/1981 | Young et al. | 5/710 |
| 4,316,298 | A | | 2/1982 | Russo et al. | 5/722 |
| 4,335,476 | A | | 6/1982 | Watkin | 5/730 |
| 4,336,621 | A | | 6/1982 | Schwartz et al. | 5/691 X |
| 4,381,571 | A | | 5/1983 | Elliott | 5/616 |
| 4,424,600 | A | | 1/1984 | Callaway | 5/710 |
| 4,435,864 | A | | 3/1984 | Callaway | 5/706 |
| 4,440,817 | A | | 4/1984 | Ahlm | 428/71 |
| 4,449,261 | A | | 5/1984 | Magnusson | 5/722 |
| 4,454,615 | A | | 6/1984 | Whitney | 5/691 |
| 4,476,594 | A | | 10/1984 | McLeod | 5/722 X |
| 4,524,473 | A | | 6/1985 | Fanti | 5/740 |
| 4,580,301 | A | | 4/1986 | Ludman et al. | 5/724 |
| 4,622,706 | A | | 11/1986 | Takeuchi | 5/713 |
| 4,628,557 | A | | 12/1986 | Murphy | 5/723 |
| 4,634,179 | A | | 1/1987 | Hashimoto et al. | 297/284.6 |
| 4,638,519 | A | | 1/1987 | Hess | 5/713 |
| 4,652,726 | A | | 3/1987 | Femino et al. | 219/217 |
| 4,689,844 | A | | 9/1987 | Alivizatos | 5/722 X |
| 4,694,520 | A | | 9/1987 | Paul et al. | 5/706 |
| 4,706,313 | A | | 11/1987 | Murphy | 5/722 |
| 4,726,083 | A | | 2/1988 | Hoshall | 5/690 X |
| 4,745,647 | A | | 5/1988 | Goodwin | 5/713 |
| 4,757,564 | A | | 7/1988 | Goodale | 5/669 |
| RE32,734 | E | | 8/1988 | McLeod | 5/722 |
| 4,768,249 | A | | 9/1988 | Goodwin | 5/713 |
| 4,768,251 | A | | 9/1988 | Baskent | 5/730 X |
| 4,787,104 | A | | 11/1988 | Grantham | 5/613 |
| 4,794,658 | A | | 1/1989 | Goodale | 5/737 |
| 4,803,744 | A | | 2/1989 | Peck et al. | 5/713 |
| 4,829,615 | A | | 5/1989 | Raymond | 5/731 |
| 4,829,616 | A | | 5/1989 | Walker | 5/713 |
| 4,843,666 | A | | 7/1989 | Elesh et al. | 5/723 |
| 4,862,538 | A | | 9/1989 | Spann et al. | 5/730 |
| 4,879,776 | A | | 11/1989 | Farley | 5/430 |
| 4,890,344 | A | | 1/1990 | Walker | 5/713 |
| 4,896,389 | A | | 1/1990 | Chamberland | 5/710 |
| 4,897,890 | A | | 2/1990 | Walker | 5/713 |
| 4,903,359 | A | | 2/1990 | Rogers | 5/741 |
| 4,908,895 | A | | 3/1990 | Walker | 5/711 |
| 4,928,337 | A | | 5/1990 | Chauncey | 5/722 |
| 4,930,170 | A | | 6/1990 | Kobayashi | 5/691 X |
| 4,935,968 | A | | 6/1990 | Hunt et al. | 5/713 |
| 4,947,500 | A | | 8/1990 | Seiler | 5/706 |
| 4,949,413 | A | | 8/1990 | Thomas et al. | 5/713 |
| 4,949,414 | A | | 8/1990 | Thomas et al. | 5/713 |
| 4,951,335 | A | | 8/1990 | Eady | 5/709 |
| 4,955,095 | A | | 9/1990 | Gerrick | 5/691 |
| 4,969,223 | A | | 11/1990 | Yamaguchi | 5/722 |
| 4,975,996 | A | * | 12/1990 | Evans et al. | 5/731 |
| D313,973 | S | | 1/1991 | Walker | D13/168 |
| 4,982,466 | A | | 1/1991 | Higgins et al. | 5/713 |
| 4,986,738 | A | | 1/1991 | Kawasaki et al. | 417/304 |
| 4,991,244 | A | | 2/1991 | Walker | 5/400 |
| 4,998,310 | A | | 3/1991 | Olson | 5/710 |
| 5,005,238 | A | | 4/1991 | Freet | 5/680 |
| 5,010,610 | A | | 4/1991 | Ackley | 5/691 |
| 5,022,111 | A | * | 6/1991 | Fenner, Sr. | 5/736 |
| 5,025,519 | A | | 6/1991 | Spann et al. | 5/730 |
| 5,027,454 | A | | 7/1991 | Peng | 5/706 X |
| 5,029,352 | A | | 7/1991 | Hargest | 5/689 |
| 5,038,433 | A | | 8/1991 | Farley | 5/730 |
| 5,044,029 | A | | 9/1991 | Vrzalik | 5/713 |
| 5,062,167 | A | | 11/1991 | Thomas et al. | 5/614 |
| 5,062,169 | A | | 11/1991 | Kennedy et al. | 5/713 |
| 5,065,485 | A | | 11/1991 | Zocco | 29/91.1 |
| 5,070,560 | A | | 12/1991 | Wilkinson | 5/710 |
| 5,073,999 | A | | 12/1991 | Thomas et al. | 5/615 |
| 5,077,849 | A | | 1/1992 | Farley | 5/730 |
| 5,081,728 | A | | 1/1992 | Skinner | 5/727 |
| 5,083,332 | A | | 1/1992 | Foster et al. | 5/185 |
| 5,097,552 | A | | 3/1992 | Viestus | 5/691 |
| 5,101,527 | A | | 4/1992 | Wadsworth, III et al. | 5/727 |
| 5,103,519 | A | | 4/1992 | Hasty | 5/715 |
| 5,105,488 | A | | 4/1992 | Hutchinson et al. | 5/710 |
| 5,111,542 | A | | 5/1992 | Farley | 5/727 |
| 5,127,119 | A | | 7/1992 | Rogers | 5/730 |
| 5,136,741 | A | | 8/1992 | Balonick et al. | 5/738 |
| 5,144,707 | A | | 9/1992 | Callaway et al. | 5/678 |
| 5,170,522 | A | | 12/1992 | Hutchinson et al. | 5/615 |
| 5,172,439 | A | | 12/1992 | Farley | 5/722 |
| 5,178,811 | A | | 1/1993 | Farley | 264/138 |
| 5,179,742 | A | | 1/1993 | Oberle | 5/727 |
| 5,179,744 | A | | 1/1993 | Foster et al. | 5/600 |
| 5,182,826 | A | | 2/1993 | Thomas et al. | 5/713 |
| 5,201,780 | A | | 4/1993 | Dinsmoor, II et al. | 5/926 |
| 5,214,809 | A | | 6/1993 | Stuart | 5/716 |
| 5,231,717 | A | | 8/1993 | Scott et al. | 5/727 |
| 5,235,258 | A | | 8/1993 | Schuerch | 5/616 X |
| 5,243,722 | A | | 9/1993 | Gusakov | 5/655.3 |
| 5,243,723 | A | | 9/1993 | Cotner et al. | 5/710 |
| 5,245,716 | A | | 9/1993 | Callaway et al. | 5/679 |
| 5,259,079 | A | | 11/1993 | Visser et al. | 5/685 |
| 5,267,364 | A | | 12/1993 | Volk | 5/713 |
| 5,285,542 | A | | 2/1994 | West et al. | 5/500 |
| 5,331,698 | A | | 7/1994 | Newkirk et al. | 5/602 |
| 5,353,454 | A | | 10/1994 | Callaway et al. | 5/665 |
| 5,360,653 | A | | 11/1994 | Ackley | 428/71 |
| 5,367,728 | A | | 11/1994 | Chang | 5/689 |
| 5,388,292 | A | | 2/1995 | Stinson et al. | 5/682 |
| 5,394,577 | A | | 3/1995 | James et al. | 5/713 |
| 5,398,354 | A | | 3/1995 | Balonick et al. | 5/728 |
| 5,398,355 | A | | 3/1995 | Bailey | 5/500 |

| | | | | |
|---|---|---|---|---|
| 5,412,821 | A | 5/1995 | Wilkinson | 5/709 |
| 5,421,044 | A | 6/1995 | Steensen | 5/710 |
| 5,428,852 | A | 7/1995 | Tenuta et al. | 5/690 |
| 5,430,901 | A | 7/1995 | Farley | 5/730 |
| 5,487,196 | A | 1/1996 | Wilkinson et al. | 5/715 |
| 5,509,154 | A | 4/1996 | Shafer et al. | 5/713 |
| 5,513,400 | A | 5/1996 | Turner | 5/422 |
| 5,524,307 | A | 6/1996 | Griffin | 5/710 |
| 5,542,136 | A | 8/1996 | Tappel | 5/710 |
| 5,544,376 | A | 8/1996 | Fromson | 318/16 X |
| 5,561,873 | A | 10/1996 | Weedling | 5/713 |
| 5,579,549 | A | 12/1996 | Selman et al. | 5/727 X |
| 5,594,963 | A | 1/1997 | Berkowitz | 5/713 |
| 5,600,214 | A | 2/1997 | Shafer et al. | 318/16 X |
| 5,611,096 | A | 3/1997 | Bartlett et al. | 5/710 X |
| 5,634,225 | A | 6/1997 | Miller, Sr. et al. | 5/710 |
| 5,652,484 | A | 7/1997 | Shafer et al. | 318/16 |
| 5,682,631 | A | 11/1997 | Weismiller et al. | 5/618 |
| 5,687,437 | A | 11/1997 | Goldsmith | 5/611 |
| 5,699,570 | A | 12/1997 | Wilkinson et al. | 5/713 |
| 5,701,623 | A | 12/1997 | May | 5/739 |
| 5,737,783 | A | 4/1998 | Antinori | 5/411 |
| 5,745,940 | A | 5/1998 | Roberts et al. | 5/727 |
| 5,765,246 | A | 6/1998 | Shoenhair | 5/680 |
| 5,787,528 | A | 8/1998 | Antinori | 5/616 |
| 5,794,288 | A | 8/1998 | Soltani et al. | 5/713 |
| 5,794,289 | A | 8/1998 | Wortman et al. | 5/713 |
| 5,802,646 | A | 9/1998 | Stolpmann et al. | 5/740 |
| 5,815,864 | A | 10/1998 | Sloop | 5/706 |
| 5,815,865 | A | 10/1998 | Washburn et al. | 5/722 X |
| 5,848,450 | A | 12/1998 | Oexman et al. | 5/706 X |
| 5,860,174 | A | 1/1999 | Failor | 5/723 X |
| 5,876,137 | A | 3/1999 | Byrd | 401/78 |
| 5,903,941 | A | 5/1999 | Shafer et al. | 5/935 |
| 5,926,883 | A | 7/1999 | Rechin et al. | 5/706 |
| 5,960,496 | A | 10/1999 | Boyd | 5/722 |
| 5,969,488 | A | 10/1999 | Fromson et al. | 318/16 |
| 5,987,676 | A | 11/1999 | Littleford et al. | 5/722 X |
| 6,008,598 | A | 12/1999 | Luff et al. | 5/713 X |
| 6,009,579 | A | 1/2000 | Pedersen | 5/690 |
| 6,016,582 | A | 1/2000 | Larson | 5/691 |
| 6,037,723 | A | 3/2000 | Shafer et al. | 5/935 X |
| 6,041,459 | A | 3/2000 | Nunez et al. | 5/730 |
| 6,047,424 | A | 4/2000 | Osborne et al. | 5/713 |
| 6,058,537 | A | 5/2000 | Larson | 5/710 |
| 6,079,065 | A | 6/2000 | Luff et al. | 5/710 X |
| 6,115,861 | A | 9/2000 | Reeder et al. | 5/722 X |
| 6,145,142 | A | 11/2000 | Rechin et al. | 5/706 |
| 6,145,143 | A | 11/2000 | Hicks et al. | 5/722 |
| 6,163,907 | A | 12/2000 | Larson | 5/691 |
| 6,178,578 | B1 | 1/2001 | Soltani et al. | 5/713 |
| 6,182,316 | B1 | 2/2001 | Thomas et al. | 5/722 |
| 6,202,239 | B1 | 3/2001 | Ward et al. | 5/727 |
| 6,212,718 | B1 | 4/2001 | Stolpmann et al. | 5/713 |
| 6,243,894 | B1 | 6/2001 | Kosumsuppamala et al. | 5/739 X |
| 6,282,735 | B1 | 9/2001 | Stolpmann et al. | 5/740 X |
| 6,286,166 | B1 | 9/2001 | Henley et al. | 5/722 |
| 6,430,766 | B1 | 8/2002 | Henley et al. | 5/722 |
| 6,460,209 | B1 | 10/2002 | Reeder et al. | 5/690 |
| 6,481,033 | B2 | 11/2002 | Fogel | 5/727 |
| RE38,135 | E | 6/2003 | Stolpmann et al. | 5/740 |
| 6,687,935 | B2 * | 2/2004 | Reeder et al. | 5/691 |
| 6,694,556 | B2 * | 2/2004 | Stolpmann | 5/710 |
| 6,782,575 | B1 * | 8/2004 | Robinson | 5/740 |
| 2002/0029425 | A1 | 3/2002 | Henley et al. | 5/722 |
| 2002/0178503 | A1 | 12/2002 | Reeder et al. | 5/722 |
| 2004/0133987 | A1 * | 7/2004 | Reeder et al. | 5/713 |

FOREIGN PATENT DOCUMENTS

| | | | | |
|---|---|---|---|---|
| EP | 0 228 233 | | 7/1987 | |
| EP | 0 261 830 | | 3/1988 | |
| EP | 0 302 579 | | 2/1989 | |
| EP | 0 316 643 | | 5/1989 | |
| EP | 0 341 570 | | 11/1989 | |
| EP | 0 351 170 | A1 | 1/1990 | 5/669 X |
| EP | 0 360 733 | | 3/1990 | |
| EP | 0 453 363 | | 10/1991 | |
| GB | 17815 | | 11/1900 | 5/738 |
| GB | 122506 | | 2/1919 | |
| GB | 318141 | | 8/1930 | 5/727 |
| GB | 1288319 | | 9/1972 | |
| GB | 2 210 554 | | 6/1989 | |
| JP | 4-322611 | | 11/1992 | |
| WO | WO 81/02384 | | 9/1981 | 5/740 |
| WO | WO 93/04654 | | 3/1993 | |
| WO | WO 97/19619 | | 6/1997 | |

* cited by examiner

FIG. 26
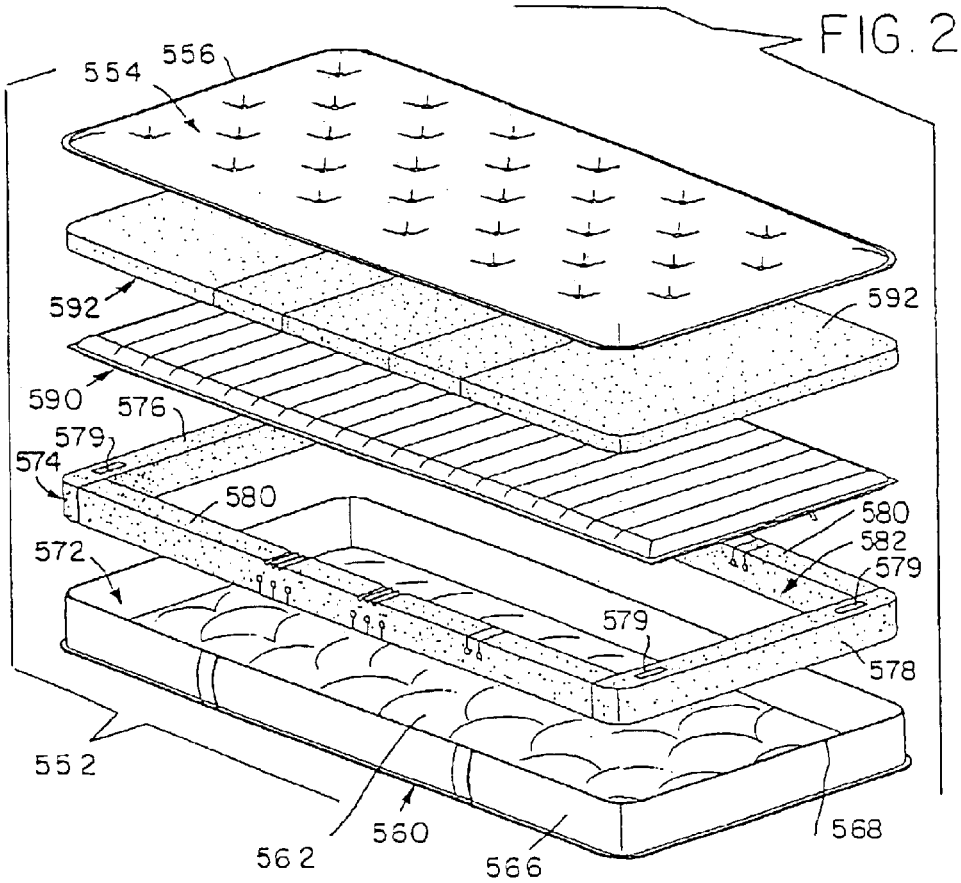
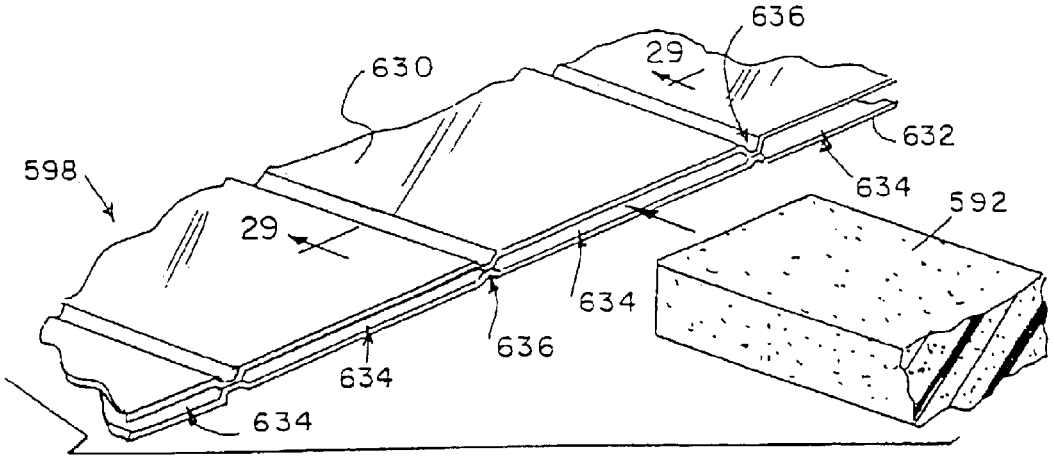
FIG. 28
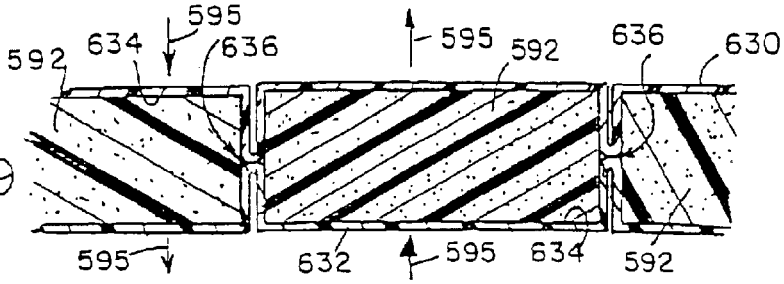
FIG. 29

MATTRESS STRUCTURE

CROSS-REFERENCE TO RELATED APPLICATIONS

This is a continuation of U.S. Ser. No. 10/186,782 filed Jul. 1, 2002, now U.S. Pat. No. 6,687,935, which is continuation of U.S. Ser. No. 09/484,710 filed Jan. 18, 2000, now U.S. Pat. No. 6,460,209, which is a divisional of U.S. patent application Ser. No. 09/064,297, filed Apr. 22, 1998, now U.S. Pat. No. 6,115,861, claiming benefit of priority of U.S. provisional applications No. 60/061,492, filed Oct. 9, 1997; No. 60/061,494, filed Oct. 9, 1997; and No. 60/066,627, filed Nov. 26, 1997; and which is a continuation-in-part of U.S. patent application Ser. No. 09/033,116, filed Mar. 2, 1998, now U.S. Pat. 6,378,152, which is a divisional of U.S. patent application Ser. No. 08/565,409, filed Nov. 30, 1995, which issued as U.S. Pat. No. 5,815,865 on Oct. 6, 1998. The disclosures of U.S. Ser. Nos. 09/484,710 and 10/186,782 are incorporated herein by reference.

BACKGROUND AND SUMMARY OF THE INVENTION

The present invention relates to bed and mattress structures and particularly to mattress structures that may be customized for individual users. The mattress of the present invention may be delivered to the user in a variety of forms assembled from kits provided at the point of sale to accommodate the musculoskeletal condition of the user. The mattress may also be customized at the factory or at some assembly location other than the point of sale based on a customer's reaction to a test mattress used at the point of sale.

It is well known to provide foam support pads or mattresses for supporting a user reclining on the pad. For example, U.S. Pat. Nos. 4,879,776; 5,038,433; 5,077,849; 5,111,542; and 5,172,439, all to Farley, disclose mattress overlays and pads for supporting a user. In addition, U.S. Pat. No. 4,449,261 to Magnusson and U.S. Pat. No. 4,991,244 to Walker disclose mattress borders for receiving core mattresses, and U.S. Pat. No. 5,105,488 to Hutchinson et al.; U.S. Pat. No. 4,803,744 to Peck et al.; and U.S. Pat. Nos. 4,424,600 and 4,435,864 to Callaway, disclose supporting surfaces having selectively adjustable firmness.

A mattress structure in accordance with the present invention is suitable for use with a conventional mattress positioned to lie upon an articulating deck. The conventional mattress includes a head portion for supporting the scapula and the lumbar of the a seat portion for supporting the user's sacrum, a thigh portion for supporting the thighs of the user, and a foot portion. Each named mattress portion is associated respectively with the head, seat, thighs, and feet of the person resting on the sleeping surface of the bed as well as with the underlying head, seat, thigh, and foot sections of the deck.

The mattress further includes a mattress cover having a top mattress cover and a bottom mattress cover coupled to the top mattress cover. The top and bottom mattress covers define a mattress interior receiving a plurality of mattress structure components. The bottom cover can be placed on a surface and used as a template for building the mattress with a "bottom up" assembly technique placing the components on the bottom of the mattress on top of the bottom cover and building the other components thereon. The top cover may also be positioned to facilitate a "top down" assembly by starting with the top cover and first adding the components on the top of the mattress to the top cover and building the other components thereon.

The mattress structure components include a frame made from a relatively firm foam rubber such as a high resiliency, high density urethane foam. The frame is positioned generally along the perimeter of the mattress. Use of a relatively firm foam provides support characteristics that aid users as they ingress and egress to and from an upwardly-facing sleeping surface of the mattress and that prevent the user from rolling off of the sleeping surface. The frame is formed to include a central opening beneath the sleeping surface above which the user will rest.

A plurality of cores including an air bladder, "zone foam" elements, "sculptured foam" shaped from foam blocks, and combinations thereof are provided for filling the central opening. The cores are selected to customize the firmness, support, and interface pressure characteristics to meet the individual desires of each user. To customize the mattress in such a fashion requires considering the combination of each individual's height, weight, body type, weight distribution, health conditions, and preferences.

The preferred method for customizing the mattress is initiated when a potential user completes a questionnaire to aid in the analysis of that user's "sleep profile." The sleep profile assesses such factors as the user's general health and sleep habits. A firmness recommendation is computed either in terms of a pressure for various zones of a "test mattress" containing an air bladder or in terms of a foam type and density for each zone. In addition, a surface recommendation is established based on the user's responses to a surface recommendation questionnaire.

Once the 'surface and hardness recommendations are established, the user lies on a test sleeping surface containing an air bladder that is pressurized to match the firmness recommendation. Zones of the air bladder are then adjusted to match the preferences of the user and the resulting preferred firmness readings are recorded. An algorithm has been developed that translates the preferred firmness readings into a customized bed configuration. For example, the preferred firmness readings can be translated to establish the foam density that, if incorporated into a mattress, will provide the firmness and support characteristics similar to those provided by the test sleeping surface having the preferred firmness readings.

Once the customized bed configuration is established, a mattress can be assembled from a kit at the point of sale containing the plurality of cores for the user to test and verify that the mattress meets his or her preferences. If the mattress is not satisfactory, it can be adjusted at the point of sale. Once the user is satisfied, he or she can immediately take delivery of the completed customized mattress if desired. In the alternative, once the customized bed configuration is established, the data describing this configuration can be transmitted to a factory at which the mattress is assembled for delivery to the user.

The mattress structure in accordance with the present invention can be sized for a twin bed, a double bed, a queen-sized bed, or a king-sized bed. When the mattress is sized for queen-sized and king-sized beds, both sides of the mattress can be individually customized if desired to provide the firmness and support characteristics desired by individual sleep partners by customizing the core and customizing the topper to provide the desired firmness and support for each side of the bed. In such a "side-by-side" customization, the core and toppers supporting each user on separate halves of the mattress are distinct and separate. Having distinct and separate cores and toppers facilitates this customization while also serving to minimize the transmission of motion from one half of the mattress to the other when one of the sleeping partners moves.

As will be discussed in greater detail later in the specification, the mattress structure can be provided with an air bladder adjacent a foam block that is selectively adjustable by the user to provide varied firmness and support characteristics. If the same mattress is used on a bed having an articulating deck, the mattress can be provided with a hand held controller for use by the user that controls the adjustment of both the position of the deck and the bladder. In addition, the hand held controller can include a "memory set" feature that allows the user to establish preferred deck and mattress combination settings.

For example, the user may desire a first set of support characteristics at a pre-selected zone of the mattress when the deck is in a generally planar sleeping position. The user could establish this set of characteristics as the first memory setting. The user may also desire a different set of support characteristics at that zone of the mattress when the deck is positioned in a reclining position away from the generally planar sleeping position. If the user establishes this second set of characteristics as the second memory setting, the user can automatically move the bed and mattress structure to either of the first or second set of characteristics by pressing a button. Of course, even with these memory settings established, the user can move the bed and mattress to other positions as desired.

In addition, the mattress structure can be provided with combinations of air bladders, zone foam elements, and sculptured foam to produce a "combination mattress." For example, the mattress structure can be provided having an air bladder supporting the scapula, foam supporting the lumbar, an air bladder in the seat portion supporting the sacrum, and foam supporting the thighs and legs. If desired, the air bladders can be in fluid communication so that they inflate and deflate at the same times and to the same pressures or the air bladders can be independent of one another and independently controlled by the user so that they user can establish different characteristics of support and firmness for each of the scapula and the sacrum.

According to one embodiment of the present invention, a mattress structure is provided that may be customized at the point of sale to accommodate the musculoskeletal condition and interface pressure preference of the user. The mattress structure includes a frame that defines a central opening and a foam core being positioned to lie within the central opening of the frame. The foam core comprises a head-end foam block, a foot-end foam block, and a seat foam block positioned to lie between the head and foot foam blocks. Each of the foam blocks has a top side and an opposite bottom side. The mattress structure further comprises a first block that has a first block firmness and is positioned to lie between the head-end foam block and the seat foam block and a second block that has a second block firmness and is positioned to lie between the foot-end foam block and the seat foam block. The second block firmness is different than the first block firmness and may be pre-selected by the user. Further, the mattress comprises a first cover having a first cover firmness and formed for extension across the frame and between the head-end and foot-end foam blocks and a second cover having a second cover firmness and formed for extension across an opposite side of the frame between the head-end and foot-end foam blocks. The second cover firmness is different than the first cover firmness to provide the user with a plurality of firmness configurations.

In another embodiment of the present invention, a mattress core is provided that comprises a frame that defines an interior region and that has a top end and an opposite bottom end and first and second covers. The first cover is coupled to the top end of the side wall and has a first cover firmness. The second cover is coupled to the bottom end of the side wall and has a second cover firmness that is greater than the first cover firmness. The mattress core further comprises a seat-support section positioned to lie within the interior region, a first foam block, and a second foam block. The seat-support section has a top side facing the first cover, an opposite bottom side facing the second cover, and opposite walls extending between the top and bottom sides. The first foam block is positioned to lie adjacent one side of the seat-support section and has a first core firmness and the second foam block is positioned to lie adjacent the opposite side of the seat-support section and has a second core firmness that is different than the first core firmness.

In yet another embodiment of the present invention a mattress is provided that comprises a frame that defines an interior region, a one-piece inflatable bladder positioned to lie within the interior region of the frame, and a plurality of foam blocks. The foam blocks are positioned to lie upon the inflatable bladder within the interior region of the frame. In addition, the foam blocks are configured to move upon the inflatable bladder relative to one another.

In still another embodiment of the present invention a mattress is provided that comprises a frame that includes a head-end section, a foot-end section and opposing sides that extend between the head-end section and the foot-end section and define an interior region therebetween and a plurality of foam blocks positioned to lie within the interior region of the frame. The foam blocks include opposite ends that are coupled to the opposite sides of the frame by an adhesive positioned to lie between the frame and the blocks.

Further, in another embodiment of the present invention a mattress is provided that comprises a frame defining an interior region, a plurality of foam blocks positioned to lie within the interior region of the frame, and an inflatable bladder positioned to lie adjacent one of the foam blocks.

In yet another embodiment of the present invention, a mechanism for attaching a pillow top on a mattress is provided. The attachment mechanism comprises a pillow top handle coupled to the pillow top, a mattress handle coupled to the mattress vertically adjacent the pillow top handle, and a strap. The pillow top handle includes opposite ends and a handle portion that extends between the opposite ends and defines a gripping aperture. The mattress handle includes opposite ends and a handle portion that extends between the opposite ends and defines a griping aperture. The strap is sized for extension through the gripping apertures of the pillow top and mattress handles and includes opposite ends and a fastening mechanism thereon. The fastening mechanism is configured to coupled the opposite ends of the strap together.

According to the present invention a pillow top assembly is provided suitable to lie upon a top cover of a mattress so that the pillow top assembly is configured to lie between the mattress and a user resting upon the mattress. The pillow top assembly comprises first and second fabric layers and a series of zoned blocks therebetween. The first fabric layer has an external side, an opposite internal side, a head end, and an opposite foot end. The second fabric layer is coupled to the first fabric layer and has an external side and an opposite internal side that cooperates with the internal side of the first fabric layer to define an internal region therebetween. The series of zoned blocks is positioned to lie within the internal region and is configured to extend between the head end and the foot end of the first fabric layer.

According to another embodiment of the present invention, a pillow top assembly is provided suitable for use on a top cover of a mattress. The pillow top assembly comprises a fabric shell and a series of zoned blocks. The fabric shell includes a top layer, a bottom layer spaced apart from the top layer to define an interior region therebetween, a head end, and an opposite foot end. The series of zoned blocks is positioned to lie within the interior region and extends between the head and foot ends of the fabric shell. Each of the zoned blocks in the series has a first end and an opposite second end and the second end of the first zoned block in the series is movably coupled to the first end of the adjacent zoned block in the series.

According to still another embodiment of the present invention, a pillow top assembly is provided suitable for use on a mattress. The pillow top assembly includes a fabric shell and a series of zoned blocks. The fabric shell includes a top layer having a first thermal resistance and a bottom layer spaced apart from the top layer to define an interior region therebetween and having a second thermal resistance that is greater than the first thermal resistance of the top layer, a head end, and an opposite foot end. The series of zoned blocks are positioned to lie within the internal region to extend between the head end and the foot end of the fabric shell.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which:

FIG. 1(*b*) is a view similar to FIG. 1(*a*) showing a mattress including a core having a combination of zone foam blocks and air bladders with zone foam blocks positioned to support the lumbar region of the back of the user and the thighs and legs of the user and air bladders positioned to support other portions of the user;

FIG. 1(*c*) is a view similar to FIG. 1(*b*) showing a mattress including a core having a combination of zone foam blocks and air bladders with air bladders positioned to support the lumbar region of the back of the user and the thighs of the user and zone foam blocks positioned to support other portions of the user;

FIG. 8(*b*) is a view similar to FIG. 8(*a*) of a four-zone air bladder in which zones of the air bladder which are not adjacent to one another are in fluid communication showing an upper back zone in fluid communication with a seat zone through a first tube positioned outside of an internal region of the air bladder and a lower back zone in fluid communication with a foot zone through a second tube positioned outside of an internal region of the air bladder;

FIG. 26 is a perspective view with portions broken away of an alternative embodiment of the present invention showing a mattress including a frame that defines an interior opening, a one-piece bladder positioned to lie in the interior opening, and a plurality of zone blocks positioned to lie upon the one-piece bladder;

FIG. 28 is an enlarged perspective view of a portion of a slip cover in accordance with another embodiment of the present invention showing the slip cover including a top member, a bottom member, and a plurality of pockets that are spaced apart by fabric spacer regions, the pockets-being sized to receive zone blocks therein;

FIG. 29 is a cross-sectional view taken along lines 29—29 of FIG. 28 after insertion of the zone blocks in the pockets and showing the individual compression of the zone blocks relative to one another;

DETAILED DESCRIPTION OF THE INVENTION

Figure 1A:
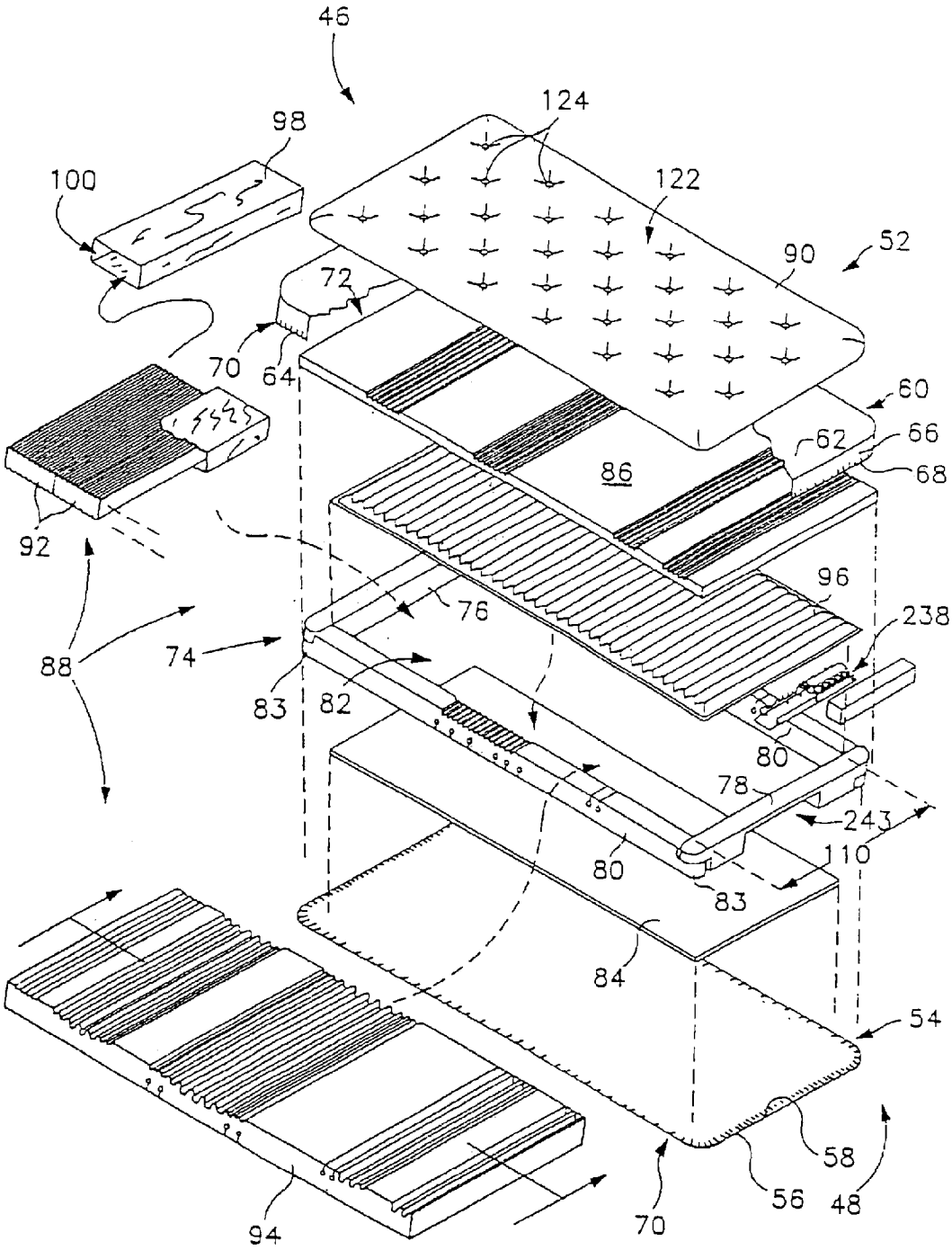
FIG. 1(*a*) is an exploded perspective view of a mattress in accordance with the present invention showing a bottom cover positioned beneath a foam bottom and a frame, a plurality of cores receivable above the foam bottom in a central opening formed in the frame, the plurality of cores including either a sculptured foam core, transversely extending zone foam blocks, an air bladder, or a combination thereof, the mattress also including a foam topper positioned to lie above the frame and the core, a top cover surrounding the topper, the frame, and the foam bottom, the top cover including a zipper half engaging a zipper half on the bottom cover to attach the top cover thereto, and a pillow top attached to the top of the top cover.
Figure 1C:
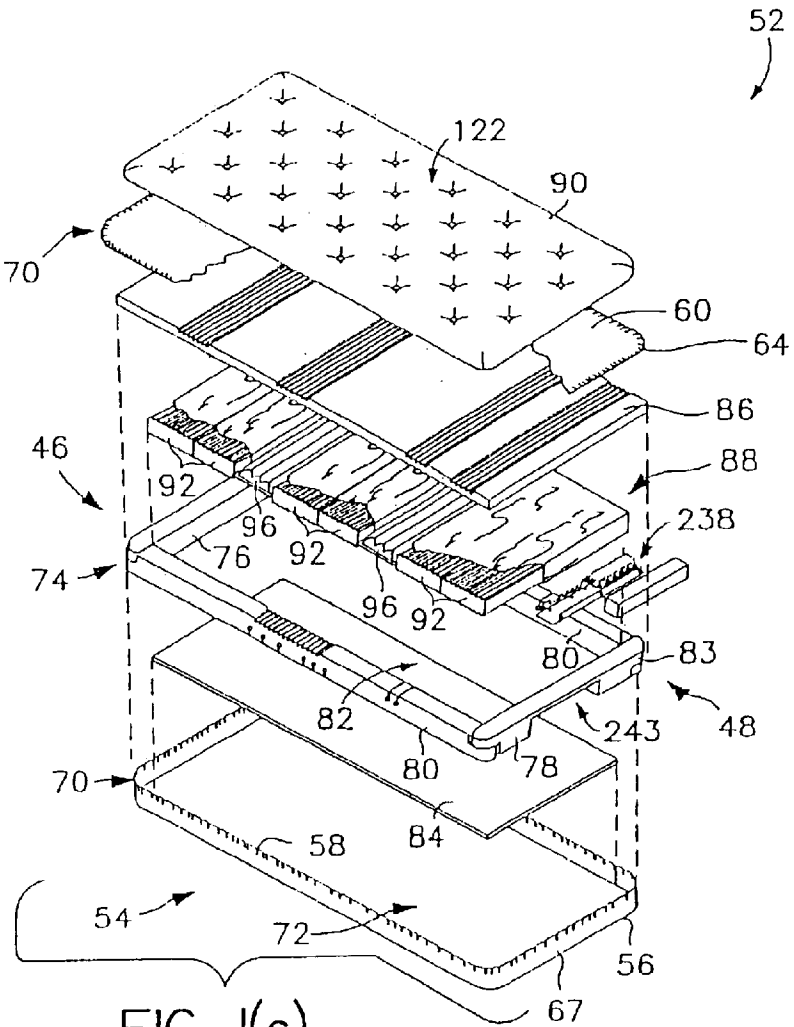
Figure 1B:
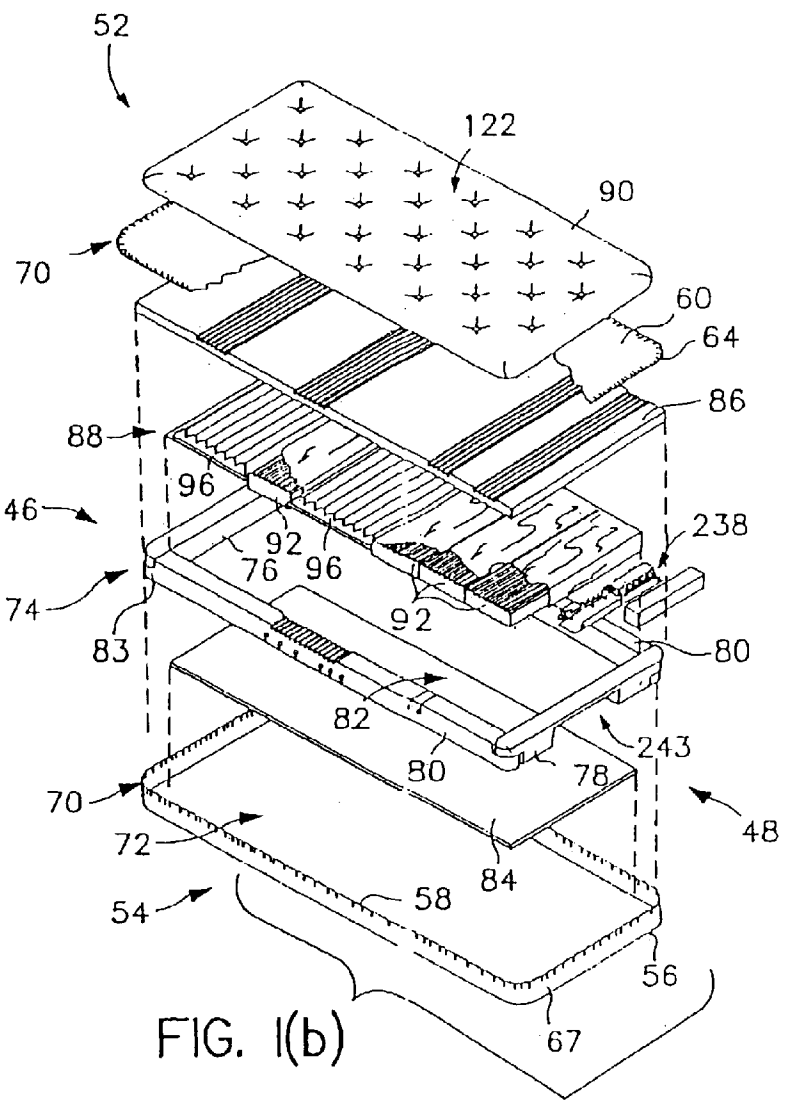

A bed and mattress structure 50 includes a mattress 52 in accordance with the present invention as illustratively shown in FIGS. 1(*a*)–(*c*). As used in this description, the phrase "head end 46" will be used to denote the end of any referred-to object that is positioned to lie nearest head end 46 of bed and mattress structure 50. Likewise, the phrase "foot end 48" will be used to denote the end of any referred-to object that is positioned to lie nearest foot end 48 of bed and mattress structure 50.

Mattress 52 includes a bottom cover 54 having a perimeter edge 56 and a first zipper half 58 attached to perimeter edge 56 as shown in FIGS. 1(*a*) and 2. Mattress 52 also includes a top cover 60 that cooperates with bottom cover 54 to define a mattress interior 72.

Top cover 60 includes an upwardly-facing top portion 62 and a downwardly-extending side portion 66 as shown in FIGS. 1(*a*) and 2. Side portion 66 includes a bottom edge 68 and a second zipper half 64 attached to bottom edge 68, second zipper half 64 attaching to first zipper half 58 to form zipper 70 that connects top cover 60 and bottom cover 54.

Although zipper 70 is positioned to lie adjacent to bottom edge 68, a bottom cover could be provided having an upwardly-extending side portion 67 as shown in FIGS. 1(*b*) and 1(*c*) defining a mattress side and the second zipper half could be attached to side portion 67 of the bottom cover so that zipper 70 could be positioned along the mattress side or the upper perimeter edge of mattress 52. Zipper 70 can therefore be positioned to lie adjacent to bottom edge 68 or at any position along the mattress side, which in preferred mattress 52 includes side portion 66, without exceeding the scope of the invention as presently perceived. However, positioning zipper 70 adjacent bottom edge 68 provides certain assembly related advantages described below while also improving the appearance of mattress 52 by allowing zipper 70 to be easily hidden.

A frame 74 having a head end foam section 76, a foot end foam section 78, and longitudinally extending side foam sections 80 joining head end and foot end foam sections 76, 78 is received in mattress interior 72 as shown in FIGS. 1(*a*) and 2. Frame 74 is formed with rounded corners to enhance the appearance of mattress 52. In addition, joints 83 connect head end foam section 76 to side foam sections 80 and foot end foam section 78 to side foam sections 80. Joints 83 are lap joints having portions of head end and foot end foam sections 76, 78 overlapping and fastened to respective portions of side foam sections 80. Forming joints 83 in this manner results in additional support provided to head end foam section 76 when mattress 52 slides past head end 46 of foundation 120 during articulation of deck 138.

Head end, foot end, and side foam sections 76, 78, 80 of frame 74 cooperate to define a central opening 82 as shown best in FIGS. 1(*a*) and 2 above which a user (not shown) will rest. A foam bottom 84 is received in central opening 82 and foam bottom 84 and frame 74 lay against bottom cover 54. A topper 86 rests against top of frame 74 and above central opening 82 to engage top portion 62 of top cover 60. A core or core structure 88 is received in central opening 82 and is positioned to lie between foam bottom 84 and topper 86. Having topper 86 sized to cover both frame 74 and core 88 minimizes the ability of the user to perceive the interface between frame 74 and core 88.

A pillow top 90 is attached to the top of top portion 62 of top cover 60 and is positioned to lie outside of mattress interior 72 as shown in FIGS. 1(*a*) and 2 to define a sleeping surface 122 on which a user will rest. Top cover 60 is made from a material having a low coefficient of friction such as a polypropylene anti-shear material to allow for the sliding movement of pillow top 90 relative to top cover 60 near head end 46 of mattress 52. In addition, top cover 60 should be somewhat elastic so that the user can "sink into" mattress 52 allowing mattress 52 to conform to the user's shape, thereby relieving interface pressure.

Pillow top 90 includes a foam pad (not shown) covered by fabric and adorned, for example, by buttons 124, ornamental stitching, or the like to enhance the appearance of pillow top 90. Pillow top 90 can be attached to top cover 60 using any suitable method such as by a zipper (not shown), adhesive (not shown), straps (not shown), or even sewing pillow top 90 to top cover 60. However, as described below with reference to FIG. 3, pillow top 90 is attached to top cover 60 using hook and loop type fasteners so that pillow top 90 is easily removable and replaceable. Mattress 52 can alternatively be provided without pillow top 90, in which case the upwardly-facing surface of top portion 62 of top cover 60 serves as sleeping surface 122.

Core 88 can alternatively include either a set of zone foam blocks 92, a sculptured foam core 94, an air bladder 96, or a combination thereof as shown in FIGS. 1(*a*)–(*c*) and 2. Frame 74, foam bottom 84, topper 86, zone foam blocks 92, sculptured foam core 94, and an interior portion (not shown) of pillow top 90 may be made from a foam rubber such as urethane foam. The firmness and support characteristics of the foam rubber can be varied in accordance with the desires of the user of mattress 52. The firmness and support characteristics of the foam rubber is varied by varying either the density of the foam or the shape of the outer surfaces of the foam.

Although urethane foam is the preferred material for these components, any material providing support and firmness characteristics similar to those provided by foam rubber can be used without exceeding the scope of the invention as presently perceived. For example, topper 86 can be made from latex foam or urethane foam, or in the alternative it can include an air bladder, a water bladder, or a bladder for other fluids without exceeding the scope of the invention as presently perceived.

Figure 3:
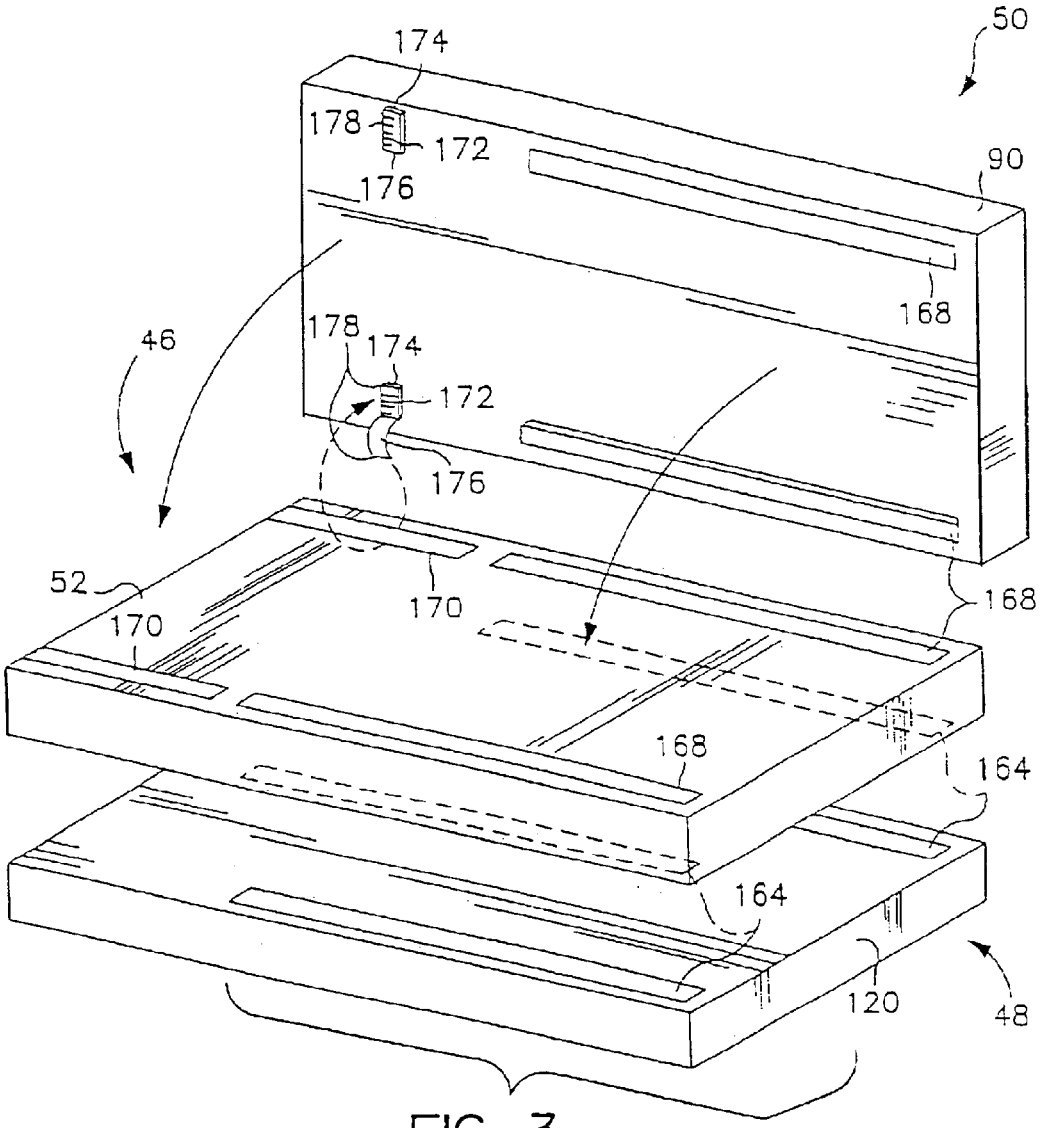
FIG. 3 is an exploded perspective view of a mattress and bed structure in accordance with the present invention including a foundation and the mattress and showing the mattress positioned to lie above the foundation and a pillow top positioned to lie above the mattress, the mattress being attached to the foundation by a pair of elongated hook and loop type fasteners attached to the foundation and to the mattress at a foot end of the mattress to allow relative longitudinal motion at a head end of the mattress and foundation during articulation of the mattress and foundation, the pillow top being connected to the top cover of the mattress by a pair of elongated hook and loop type fasteners attached to a top cover of the mattress and attached to the pillow top, the pillow top also being coupled to the mattress by a pair of elongated straps fixed to the head end of the top cover of the mattress to form longitudinal loops and short straps which feed through the loops and are attached to the pillow top so that the head end of the pillow top can slide longitudinally relative to the top cover of the mattress while remaining generally fixed in the transverse direction relative to the pillow top.

Mattress 52 rests on a foundation 120, as shown in FIG. 3, such as box springs, a stationary deck of a bed, an articulating deck of a bed, or the like. Mattress can also rest on a floor or any other generally planar, upwardly facing surface without exceeding the scope of the invention as presently perceived.

Foundation 120 and the underside of bottom cover 54 are provided with elongated mating portions of hook and loop type fasteners 164 so that mattress 52 is removably attached to foundation 120 as shown in FIG. 3. Fasteners 164 prevent lateral movement of mattress 52 relative to foundation 120. However, fasteners 164 are spaced apart from head end 46 of bed and mattress structure 50 so that head end 46 of mattress 52 can slide longitudinally relative to head end 46 of foundation 120 as described below.

In addition, the underside of pillow top 90 and the upper side of top portion 62 of top cover 60 of mattress 52 are both provided with elongated mating portions of hook and loop type fasteners 168 as shown in FIG. 3 so that pillow top 90 is removably attached to mattress 52. Mattress 52 is also provided with a pair of longitudinally extending long loops 170 and pillow top 90 is provided with a pair of transversely extending short loops 172. Each short loop 172 includes a first end 174 that is fixed to pillow top 90 and a second end 176 that is attached to pillow top 90 using hook and loop type fasteners 178. Second end 176 of each short loop 172 is received by one of long loops 170 respectively so that short loops 172 cooperate with long loops 170 to prevent transverse movement of pillow top 90 relative to mattress 52 while allowing the longitudinal sliding of pillow top 90 relative to mattress 52 during articulation of deck 138.

Figure 4:
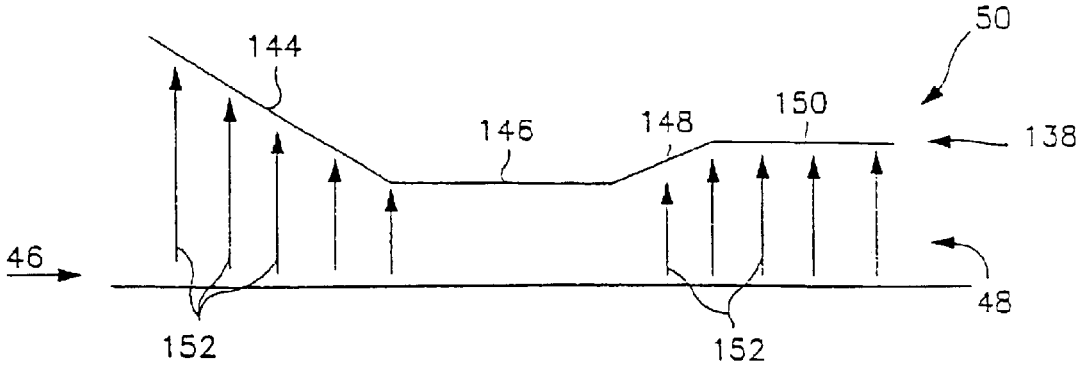
FIG. 4 is a diagrammatic view of an articulating deck for carrying the mattress in accordance with the present invention showing the deck moved to a position other than a generally planar sleeping position.

As described above, mattress 52 is configured for use on both stationary, generally planar, and upwardly facing surfaces on which mattress 52 rests during use by a user, as well as on a bed, table, or other device (not shown) having an articulating deck 138 as shown diagrammatically in FIG. 4. Illustrative articulating deck 138 includes a head section 144, a seat section 146, a thigh section 148, and a foot section 150. A light (not shown) or other illuminating device can be provided having an arm (not shown) or extending bracket attached to head section 144 so that the light extends to a position illuminating mattress 52. By attaching the arm to head section, the relative position of user's head and the light will remain generally fixed.

Seat section 146 of deck 138 is fixed relative to the bed having a generally horizontal upwardly-facing surface carrying mattress 52 and head, thigh, and foot sections 144, 148, 150 are movable with respect to the bed (not shown) and with respect to each other to move mattress 52 so that the position of mattress 52 and the position of the user on top of mattress 52 changes. Drivers for moving head, thigh, and foot sections 144, 148, 150 are diagrammatically indicated by arrows 152 in FIG. 4. In the preferred articulating deck 138, foot section 150 is movable only to positions in which foot section 150 is generally parallel to seat section 146. In addition, the movement of preferred thigh section 148 is limited to positions between the generally horizontal sleeping position and positions upwardly from the sleeping position so that the feet of the user (not shown) remain generally vertically even with or elevated above the torso of the user.

Figure 5:
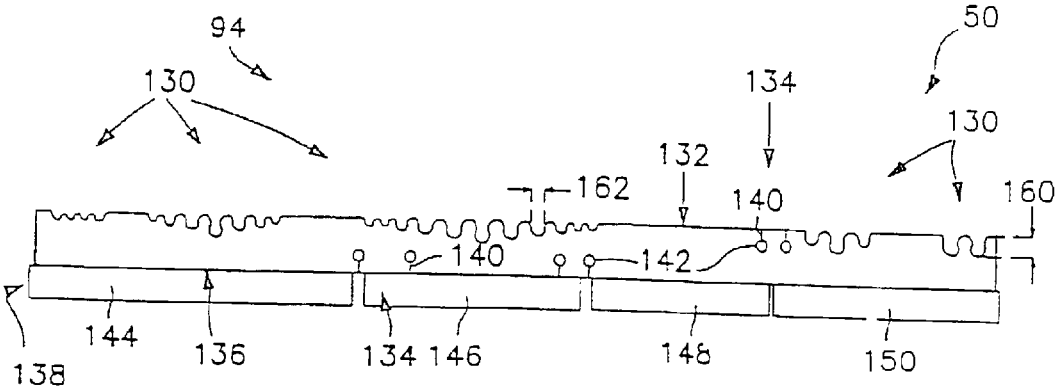
FIG. 5 is a diagrammatic sectional view taken along line 5—5 of FIG. 1(*a*) showing a sculptured foam core resting on an articulating deck of a bed, the deck being in a generally planar sleeping position.
Figure 6:
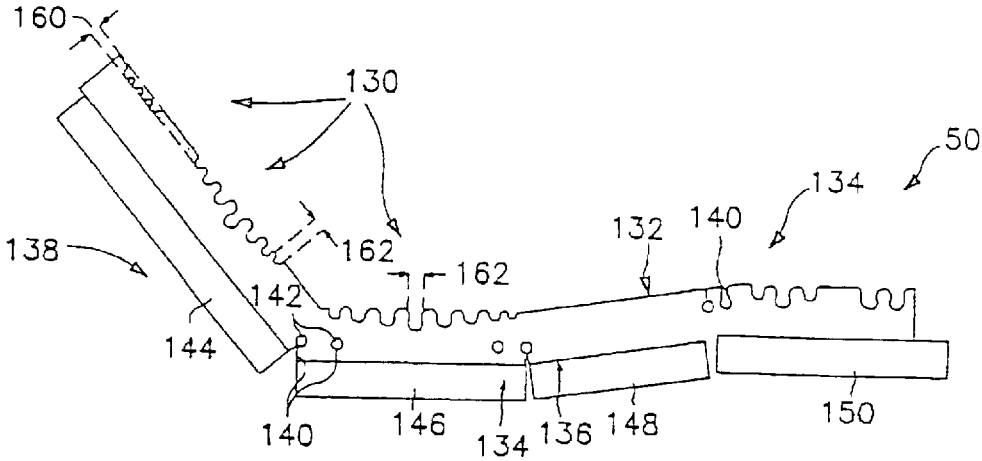
FIG. 6 is a view similar to FIG. 5 showing the deck in a position having the head section lifted to an upward raised position, the thigh section lifted slightly to an upward raised position, and the foot section elevated above and generally parallel to the seat section, cuts formed in the sculptured foam core on the surface opposite the folds allowing the sculptured foam core to generally conform to the shape of the deck.

It will be appreciated that various mechanical and electromechanical actuators and drivers may be used to raise and lower individual deck sections 144, 146, 148, 150 relative to the bed as shown in FIGS. 4–6. It is well known in the hospital bed art that electric drive motors with various types of transmission elements including lead screw drives and various types of mechanical linkages may be used to cause relative movement of portions of hospital beds. It is also well known to use pneumatic actuators including various types of air bladders powered by pressurized air to actuate and/or move individual portions of hospital beds. The terms "means for raising or lowering" in the specification and in the claims, therefore, are intended to cover all types of mechanical, electromechanical, hydraulic, and pneumatic mechanisms, including manual cranking mechanisms of all types, for raising and lowering portions of chair bed 50 of the present invention.

As indicated above, mattress 52 is attached to foundation 120 and pillow top 90 is attached to mattress 52 to allow sliding movement of head end 46 of mattress 52 relative to foundation 120 and of pillow top 90 relative to mattress 52. It will be apparent to those skilled in the art, that fixing one end of mattress 52 and pillow top 90 and then moving articulating deck 138 will cause shear forces between mattress 52 and foundation 120 and between pillow top 90 and mattress 52. Connecting mattress 52 to foundation 120 and pillow top 90 to mattress 52 as described above with respect to FIG. 3 will alleviate the shear forces by allowing head end 46 of mattress 52 and pillow top 90 to slide longitudinally relative to foundation 120 and relative to each other.

As described above, core 88 can include zone foam blocks 92. A set of zone foam blocks 92 found in mattress 52 includes a plurality of transversely extending zone foam blocks 92 that longitudinally abut one another. If mattress 52 is for use in a single bed as shown in FIG. 1(*a*) so that central opening 82 is a first width 110, each block 92 extends full width 110 of central opening 82 to engage opposing side foam sections 80. Plurality of zone foam blocks 92 fills the entire-central opening 82 so that a first of blocks 92 engages head end foam section 76, a last of zone foam blocks 92 engages foot end foam section 78, and zone foam blocks 92 therebetween engage one another.

If mattress is for use in a queen-sized bed (not shown), central opening 82 is a second width and each block 92 extends only one-half of the second width. In such instance, core 88 can alternatively include side-by-side combinations including a set of zone foam blocks 92, sculptured foam core 94, and air bladder 96. For example, sculptured foam core 94 can be received in opening 82 engaging one of side foam sections 80 and zone foam blocks 92 can be received in opening 82 engaging sculptured foam core 94 on one side and the other of side foam sections 80.

For another example, central opening 82 can receive side-by-side left and right sets of zone foam blocks 92. A first of the zone foam blocks 92 of the left set of zone foam blocks 92 engages head end foam section 76, a last of the zone foam blocks 92 of the left set of zone foam blocks engages foot end foam section 78, and each zone foam block 92 of the left set of zone foam blocks 92 engages one of side foam sections 80. A first of the zone foam blocks 92 of the right set of zone foam blocks 92 also engages head end foam section 76, a last of the zone foam blocks 92 of the right set of zone foam blocks engages foot end foam section 78, and each zone foam block 92 of the right set of zone foam blocks 92 engages the other of side foam sections 80. In addition, zone foam blocks 92 of the left set of zone foam blocks engage zone foam blocks 92 of the right set of zone foam blocks 92. Thus, in a queen-sized bed, zone foam blocks 92 abut one another longitudinally and side-by-side.

Figure 2:
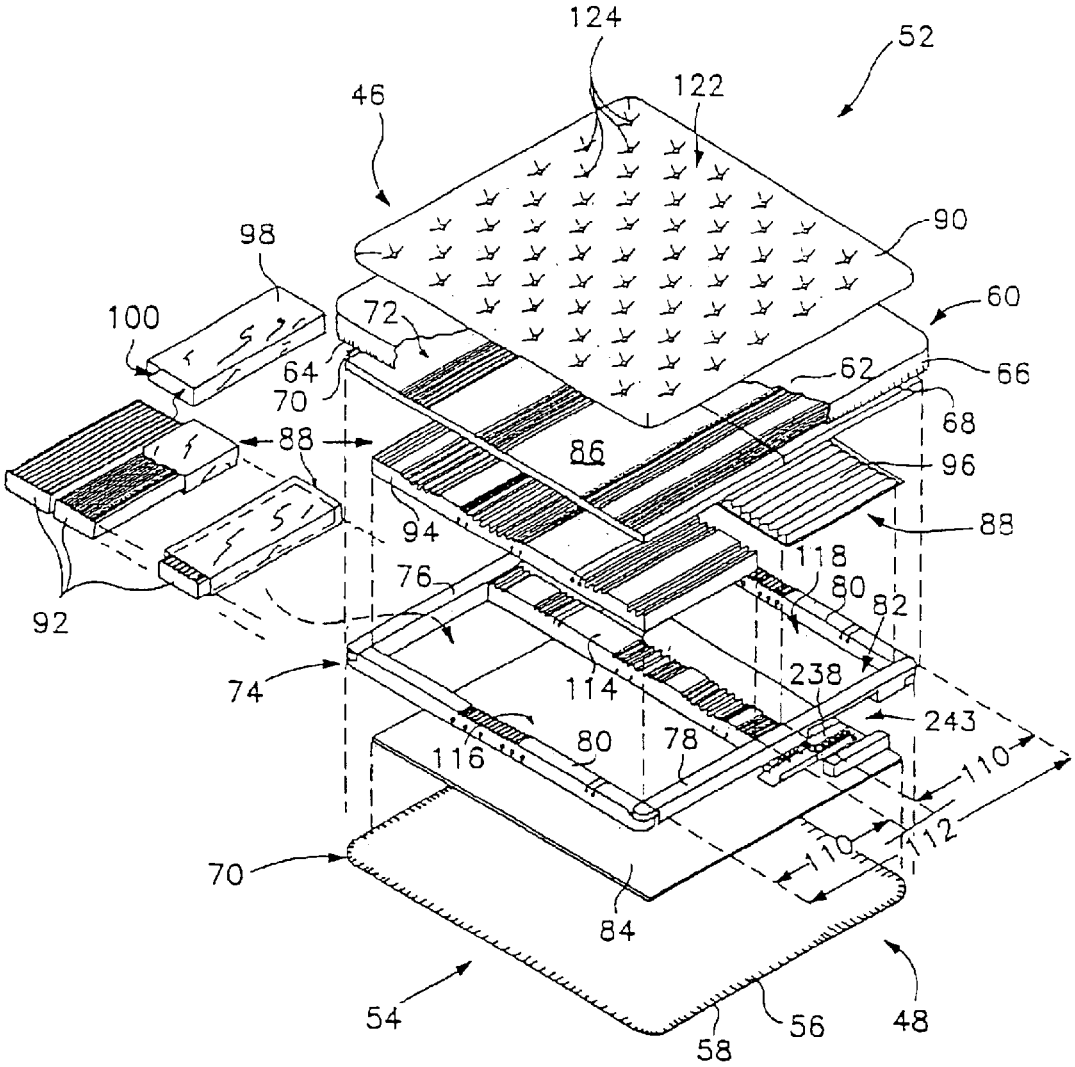
FIG. 2 is an exploded perspective view of a king-sized mattress similar to the mattress of FIG. 1(*a*) showing the bottom cover, the foam bottom, the frame, a foam divider received in the central opening of the frame to divide the central opening into two equally-sized side openings, the plurality of cores being alternatively receivable in the two side openings, the king-sized bed also including the topper, the top cover, and the pillow top.

If mattress 52 is for use in a king-sized bed as shown in FIG. 2, central opening 82 is a third width 112 and each block 92 extends less than one-half of the full width 112 of central opening 82. In such an instance, core 88 can additionally include a foam divider rail 114. Foam divider rail 114 divides central opening 82 into a first side opening 116 and a second side opening 118.

First and second side openings 116, 118 have equal widths, and foam divider rail 114 is sized so that the widths of first and second side openings 116, 118 are the same as first width 110 as shown in FIG. 2. Thus, blocks 92, sculptured foam core 94, and air bladder 96 can interchangeably fit in each of opening 82 of a single or twin bed as shown in FIG. 1(*a*) and first and second side openings 116, 118, and engage one of side rails 80 and foam divider rail 114 as shown in FIG. 2.

First opening 116 can receive any of zone foam blocks 92, sculptured foam core 94, and air bladder 96 and second opening 118 can receive any of the zone foam blocks 92, sculptured foam core 94, and air bladder 96 as shown in FIG. 2. The selection of pieces of core 88 received by first opening 116 is independent of the selection of pieces of core 88 of second opening 118, so that core 88 for a mattress for use with a king-sized bed can include foam divider rail 114, zone foam blocks 92, sculptured foam core 94, air bladder 96, or a combination thereof.

For example, if core 88 includes two sets of zone foam blocks 92 as described above for a queen-sized mattress, each block 92 will extend the full width of the respective first or second opening 116, 118 to engage foam divider rail 114 and opposing side foam section 80. Each set of zone foam blocks 92 fills the entire first or second opening 116, 118 so that a first of blocks 92 engages head end foam section 76, foam divider rail 114, and one of the side foam sections 80, a last of zone foam blocks 92 engages foot end foam section 78, foam divider rail 114, and the same of the side foam sections 80, and blocks 92 therebetween engage one another, foam divider rail 114, and the same of the side foam sections 80.

Each zone foam block is provided with an anti-shear coating so that each zone foam block 92 can move in a vertical direction independently of adjacent zone foam blocks 92 and independently of frame 74. The anti-shear coating can be a coating formed on or applied to zone foam blocks 92 as well as a sleeve 98 having an interior 100 receiving zone foam block 92 as shown in FIGS. 1(*a*) and 2. Sleeve 98 is made from a material having a low coefficient of friction such as "parachute material" or nylon.

The firmness of zone foam blocks 92 can vary from zone foam block 92 to zone foam block 92. The firmness ranges approximately between an average indention load deflection (ILD) of 15 to 98. Preferred zone foam blocks 92 are provided with ribbed upper and lower surfaces as shown in FIGS. 1(*a*)–(*c*) and 2. Ribs on the surfaces result in less force being required to compress zone foam blocks 92 than would be required without the ribs. This means that even when little weight is applied to zone foam blocks 92, blocks 92 will compress and contour to user's shape, thereby reducing interface pressures, and essentially reducing the ILD so that the ILD can be "fine-tuned" by the addition of ribs.

As described above, core 88 can also include sculptured foam core 94 as shown in FIGS. 1(*a*), 2, 5, and 6. Sculptured foam core 94 is a unitary piece of foam of uniform firmness that has been sculptured to a desired shape. However, sculptured foam core 94 can be formed from a piece of foam having firmness that varies along its length or across its width without exceeding the scope of the invention as presently perceived.

Sculptured foam core 94 is formed to include transversely extending troughs 130 along a top surface 132 of sculptured foam core 94 as well as transversely extending cuts 134 extending inwardly from both top surface 132 and a bottom surface 136 of sculptured foam core 94, as shown best is FIGS. 5 and 6 that show sculptured foam core 94 resting on a diagrammatic articulating deck 138 of a bed (not shown).

Each cut 134 includes a transversely-extending slit 140 extending inwardly from the respective surface 132, 136 and terminating in a transversely-extending cylindrical opening 142.

As described above, each of the head, thigh, and foot sections 144, 148, 150 of articulating deck 138 typically move relative to seat section 146, relative to one another, and relative to the bed as shown in FIGS. 5 and 6. Portions of sculptured foam core 94 adjacent to each of sections 144, 146, 148, 150 are configured to move with each respective section 144, 146, 148, 150. Slits 140 allow for folding movement of sculptured foam core 94 in a direction inwardly away from slits 140 as shown, for example, in FIG. 6, and openings 142 prevent the inadvertent tearing of sculptured foam core 94 when sculptured foam core 94 is folded.

Cuts 134 are positioned so that at least one of cuts 134 lies generally between the head and seat sections 144, 146, at least one of cuts 134 lies generally between the seat and thigh sections 146, 148, and at least one of cuts 134 lies generally between the thigh and foot sections 148, 150 as shown in FIGS. 5 and 6. Sculptured foam core 94 is provided with a plurality of cuts 134 at each position as shown best in FIGS. 5 and 6 so that the above holds true when sculptured foam core 94 is used with a variety of beds having articulating decks, the longitudinal lengths of the head, seat, thigh, and foot sections 144, 146, 148, 150 of which may vary from bed to bed.

As mentioned above, sculptured foam core 94 is also provided with transversely extending troughs 130 formed on top surface 132 shown best in FIGS. 5 and 6. Troughs 130 can be positioned to facilitate the folding of sculptured foam core 94 as shown in FIG. 6 by providing additional space for the surface 132, 136 opposite cuts 134 to compress upon itself. However, troughs 130 are not necessary for the portions of sculptured foam core 94 to move with the head, seat, thigh, and foot sections 144, 146, 148, 150 or articulating deck 138.

Each trough 130 is formed to include a depth 160 and a width 162 as shown best in FIGS. 5 and 6, and both of depth 160 and width 162 can be varied to vary the characteristics of support and firmness exhibited by sculptured foam core 94 adjacent to troughs 130. For example, by increasing depth 160 of troughs 130, sculptured foam core 94 adjacent to troughs 130 provides the user (not shown) with support and firmness characteristics that would be expected from a non-sculptured foam mattress having foam that is less firm than the foam comprising sculptured foam core 94. Likewise, by increasing width 162 of troughs 130, sculptured foam core 94 adjacent to troughs 130 provides the user (not shown) with support and firmness characteristics that would be expected from a non-sculptured foam mattress having foam that is less firm than the foam comprising sculptured foam core 94. Thus, by varying depth 160 and width 162 of troughs 130, the support and firmness characteristics of portions of sculptured foam core 94 can be varied.

Troughs 130 are formed in top surface 132 of sculptured foam core 94. It has been found, however, that by sculpturing troughs 130 onto the surface of sculptured foam core 94 engaging the bed so that sculptured foam core 94 presents a generally planar top surface 132 provides for decreases of the firmness and support characteristics of mattress 52 carrying sculptured foam core 94, these decreases being less than the decreases experienced when the sculptured surface faces upwardly. Thus, by sculpturing sculptured foam core 94 on the downward surface engaging the bed, the firmness and support characteristics of mattress 52 can be further adjusted. It is within the scope of the invention as presently perceived to sculpt the sculptured foam core to include troughs 130 only on top surface 132, only on the downwardly-facing surface of sculptured foam core 94 engaging the bed, and on both above-mentioned surfaces.

Figure 7:
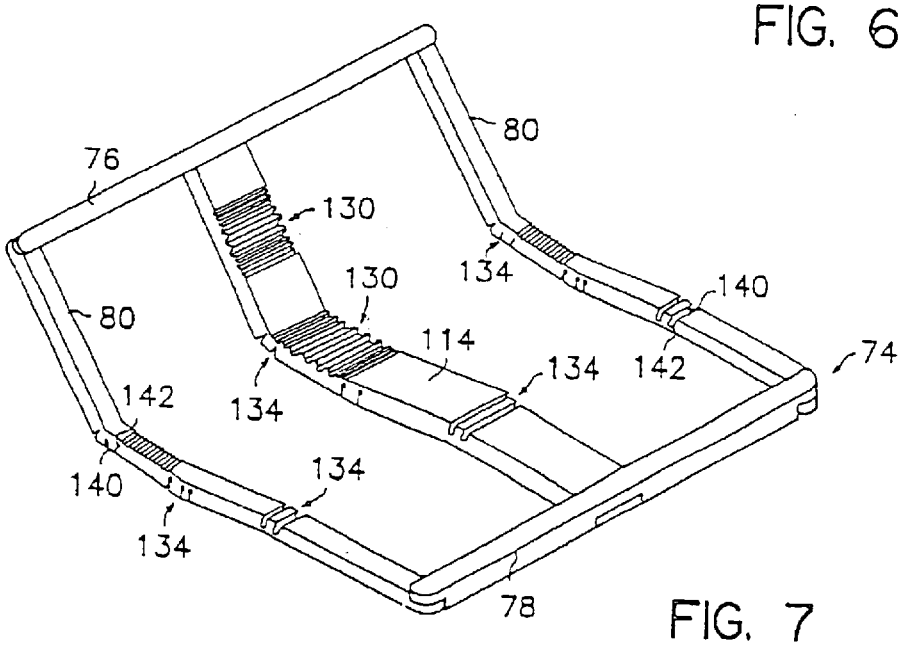
FIG. 7 is a perspective view of the frame and the foam divider of FIG. 2 showing the frame and the foam divider rail moved by an articulating deck (not shown) to a position other than the generally planar sleeping position, cuts formed in side foam sections of the frame on the surface opposite the bends and cuts formed in the foam divider rail on the surface opposite the bends allowing the frame and foam divider rail to generally conform to the shape of the deck.

Side foam sections 80 of frame 74 and foam divider rail 114 can also be sculptured to allow for each of these members 80, 114 to move as shown in FIG. 7 along with head, seat, thigh, and foot sections 144, 146, 148, 150 of articulating deck 138. Foam divider rail 114 is typically sculptured to have the same pattern of troughs 130 and cuts 134 as described above with respect to sculptured foam core 94.

Frame 74 is formed from foam having a significantly greater firmness than core 88 so that frame 74 provides additional support along the sides and ends of mattress 52. Such additional support is particularly useful when a user enters and exits the bed. However, use of such additionally firm side foam sections 80 requires that side foam sections 80 are sculptured to ensure that side foam sections 80 move with the head, seat, thigh, and foot sections 144, 146, 148, 150 of deck 138.

As with sculptured foam core 94, side foam sections 80 of frame 74 are provided with transverse cuts 134 having slits 140 and cylindrical openings 142 as shown in FIG. 7. Side foam sections 80 can also be provided with troughs 130 to vary the firmness and support characteristics of side foam sections 80 as described above with respect to sculptured foam core 94.

Core 88 can also include air bladder 96 as shown in FIGS. 1(*a*), 2, and 8(*a*)–15. Air bladder 96 is preferably inflated and deflated using air, however any acceptable fluid such as other gasses or liquids such as water and water having additives to adjust the viscosity of the resultant liquid can be used to inflate air bladder 96 without exceeding the scope of the invention as presently perceived. Thus, throughout the specification and claims such fluid will be referred to as air, although it is understood that other fluids may be used.

Air bladder 96 can be a "one-zone" air bladder (not shown) having one continuous air pocket extending through the air bladder so that the entire air bladder is uniformly inflated and deflated each time air is added to or removed from the air bladder. Air bladder 96 is a multiple-zoned air bladder having independently inflatable zones. Preferred and illustrative air bladder 96 is a "four-zone" air bladder 96 as shown in FIGS. 8(*a*) and 9 having independently inflatable zones including an upper back zone 192 supporting the scapula, a lower back zone 194 supporting the lumbar region, a seat zone 196 supporting the sacrum, and a foot zone 198 supporting the thighs, legs, and feet of the user.

Figure 8A:
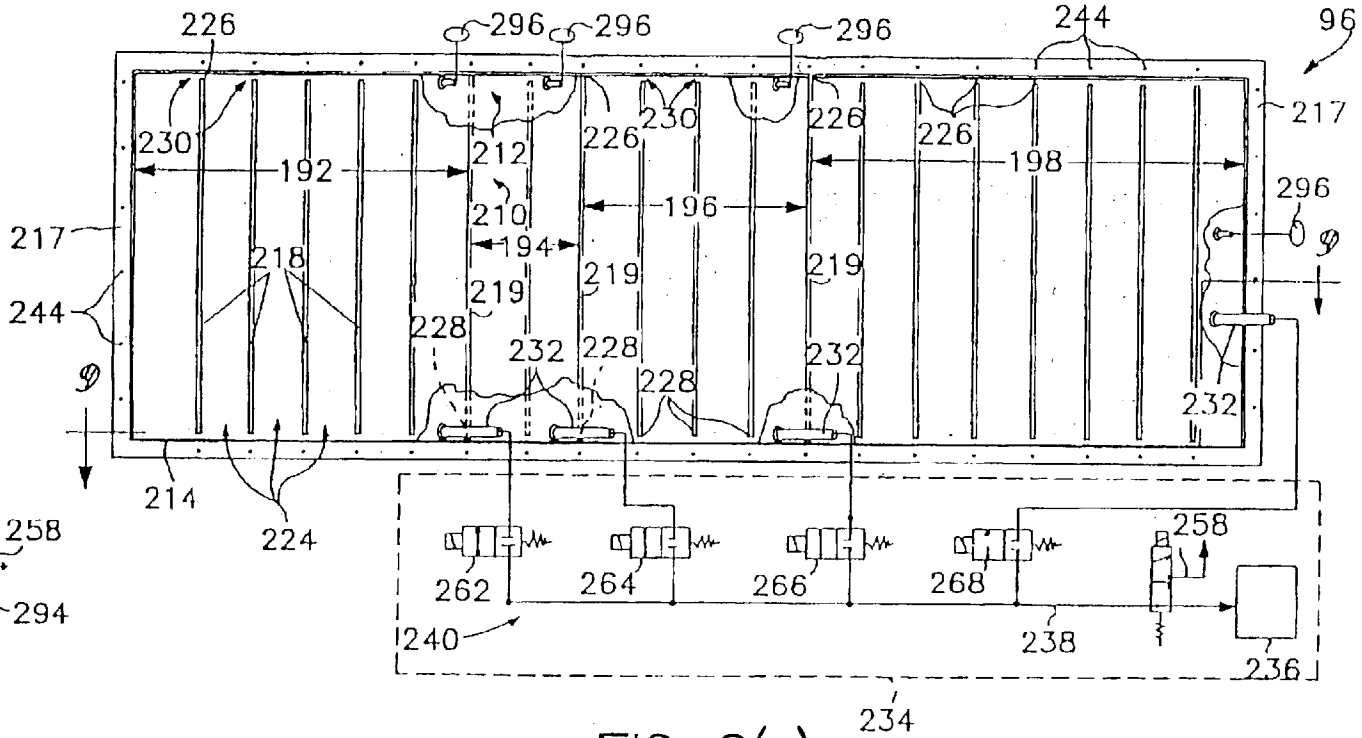
FIG. 8(*a*) is a diagrammatic bottom view of a "four-zone" air bladder and pressurized air supply with portions broken away showing the pockets formed in the air bladder by I-beams (not shown) attached to the interior of the air bladder, and showing each I-beam having first and second transverse ends, the first and second ends of a first set of I-beams being spaced-apart from the edge of the air bladder to form openings allowing fluid communication between pockets, and a diagrammatic manifold of the pressurized air supply.
Figure 8B:
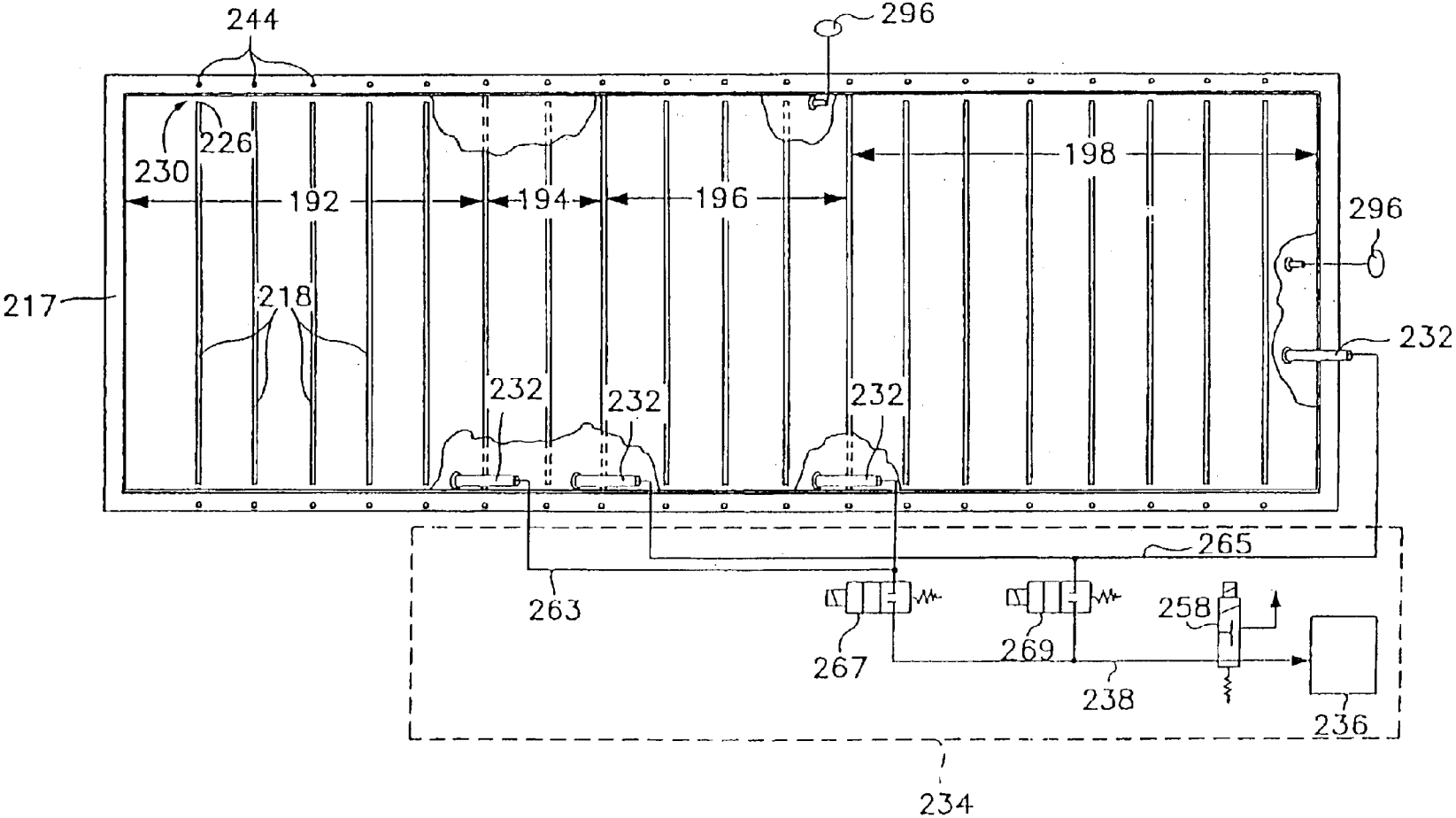

Air bladder 96 is constructed from an upper sheet 210 of an air impermeable material that is adhesively connected to a lower sheet 212 of an air impermeable material by a perimetral bead 214 of adhesive applied therebetween as shown in FIGS. 8(*a*), 8(*b*), and 9 to form an air-tight perimetral seal. Upper and lower sheets 210, 212 cooperate with bead 214 to define an internal region 216 of air bladder 96 that is air impermeable. Bead 214 is slightly spaced apart from outer edges of upper and lower sheets 210, 212 forming a two-layered perimetral flange 217.

Transversely extending I-beams 218, 219 are received inside of internal region 216 as shown in FIGS. 9 and 11–15. Each I-beam 218, 219 includes a top lip 220 sewn and adhesively attached to upper sheet 210 and a lower lip 222 sewn and adhesively attached to lower sheet 212 as shown best in FIGS. 11 and 14. The adhesive forms an air impermeable seal between top lip 220 and upper sheet 210 and between lower lip 222 and lower sheet 212. Each I-beam 218, 219 cooperates with upper sheet 210, lower sheet 212, and each adjacent I-beam 218, 219 to define a pocket 224 so that when air bladder 96 is inflated it defines a longitudinally extending series of transverse pockets 224 as shown best in FIGS. 8(*a*), 8(*b*), 9, and 11–15. Each pocket 224 is a predetermined size when pocket 224 is inflated to its full capacity.

Each I-beam 218, 219 has a transverse first end 226 and a transverse second end 228 as shown in FIG. 8(*a*). First and second ends 226, 228 of I-beams 218 are spaced apart from bead 214 to define openings 230 in fluid communication with adjacent pockets 224 defined by I-beams 218, thereby allowing the passage of air therebetween. However, first and second ends 226, 228 of I-beams 219 are adhesively attached to bead 214 to form air impermeable seals between adjacent pockets 224 defined by I-beams 219. Thus, adjacent pockets 224 defined by I-beams 219 are not in fluid communication through I-beams 219. I-beams 219 are placed to define each of the separate and distinct upper back, lower back, seat, and foot zones 192, 194, 196, 198 of air bladder 96 as shown in FIGS. 8(*a*), 8(*b*), and 9.

Each zone 192, 194, 196, 198 is provided with a tube 232 in fluid communication with pockets 224 of each respective zone 192, 194, 196, 198, and tubes 232 are each in fluid communication with a pressurized air supply 234 as shown diagrammatically in FIG. 8(*a*). Preferred pressurized air supply 234 includes a source of compressed air 236 such as an air compressor, a pressurized air tank, or the like, a manifold 238 connecting each tube 232 to source of compressed air 236, and valves 240 individually controlling the flow of compressed air to and from each tube 232 as shown in FIGS. 1(*a*), 2, and 8(*a*). Manifold 238 is positioned to lie in an opening 243 formed in foot end foam section 78 of frame 74 as shown in FIGS. 1(*a*) and 2.

Valves 240 include a three-way normally open source/exhaust valve 260 connecting manifold 238 to source of compressed air 236 when source/exhaust valve 260 is open, as shown in FIGS. 8(*a*) and 8(*b*), and connecting manifold 238 to an exhaust line 258 when source/exhaust valve 260 is energized. An upper back valve 262 is a normally closed valve that connects upper back zone 192 to manifold 238 when upper back valve 262 is energized. A lower back valve 264 is a normally closed valve that connects lower back zone 194 to manifold 238 when lower back valve 264 is energized. A seat valve 266 is a normally closed valve that connects seat zone 196 to manifold 238 when seat valve 266 is energized. A foot valve 268 is a normally closed valve that connects foot zone 198 to manifold 238 when foot valve 268 is energized.

To increase the support and firmness characteristics of mattress 52 having four-zone air bladder 96 adjacent to upper back zone 192, the user energizes upper back valve 262 to bring upper back zone 192 into fluid communication with manifold 238 as shown in FIG. 8(*a*). Source/exhaust valve 260 is normally open so that when upper back zone 192 is in fluid communication with manifold 238, upper back zone 192 is also in fluid communication with source of compressed air 236 so that upper back zone 192 inflates. Likewise, to increase the firmness and support characteristics of matters 52 adjacent to lower back, seat, or foot zones 194, 196, 198, the user simply energizes lower back valve, seat valve, or foot valve 264, 266, 268 respectively to bring the respective zone 194, 196, 198 of air bladder 96 into fluid communication with source of compressed air 236. To increase the firmness and support characteristics of the entire mattress 52 simultaneously, the user simply energizes all four of the upper back, lower back, seat, and foot valves 262, 264, 266, 268 simultaneously to bring all four zones 192, 194, 196, 198 into fluid communication with source of compressed air 236 at the same time.

To decrease the support and firmness characteristics of mattress 52 having four-zone air bladder 96 adjacent to upper back zone 192 to provide the user with a more plush feel, the user energizes source/exhaust valve 260 to bring manifold 238 into fluid communication with exhaust line 258 as shown in FIGS. 8(*a*) and 8(*b*), and then energizes upper back valve 262 to bring upper back zone 192 into fluid communication with manifold 238. Typically, exhaust line 258 vents directly to the atmosphere, so that energizing both source/exhaust valve 260 and upper back valve 262 brings upper back zone 192 into fluid communication with the atmosphere, causing upper back zone 192 to deflate and providing mattress 52 with a more plush feel for the user.

Likewise, to decrease the firmness and support characteristics of mattress 52 adjacent to lower back, seat, or foot zones 194, 196, 198, the user simply energizes lower back valve, seat valve, or foot valve 264, 266, 268 respectively to bring the respective zone 194, 196, 198 of air bladder 96 into fluid communication with manifold 238, and thus the respective zone 194, 196, 198, and at the same time energizes source/exhaust valve 258 to bring manifold 238, and thus the respective zone 194, 196, 198, into fluid communication with exhaust line 258 as shown in FIGS. 8(*a*) and 8(*b*). To decrease the firmness and support characteristics of the entire mattress 52 simultaneously, the user simply energizes all five of the upper back, lower back, seat, foot, and source/exhaust valves 262, 264, 266, 268, 260 simultaneously to bring all four zones 192, 194, 196, 198 into fluid communication with exhaust line 258 at the same time so that all four zones 192, 194, 196, 198 simultaneously vent to the atmosphere.

If desired, manifold 238 and valves 240 can be rearranged to "link" the performance of separate zones of four zone air bladder 96 as shown in FIG. 8(*b*). For example, tube 232 communicating with upper back zone 192 can also be brought into fluid communication with tube 232 communicating with seat zone 196 by connector tube 263 communicating with both upper back zone 192 and seat zone 196. Connector tube 263 can be brought into fluid communication with source of compressed air 236 through an upper back and seat valve 267 and manifold 238 so that both upper back and seat zones 192, 196 are inflated generally simultaneously and to the same extent to increase the firmness and support characteristics of these zones 192, 196 of mattress 52. Connector tube 263 can also be brought into fluid communication with exhaust line 258 to simultaneously and to the same extent deflate both upper back and seat zones 192, 196, and decrease the firmness and support characteristics of mattress 52 accordingly.

As can be seen, any two or more of zones 192, 194, 196, 198 can be linked by a connector tube to cause separate portions of mattress 52 to provide similar firmness and support characteristics. Likewise, a second connector tube 265 can be formed to bring tubes 232 not connected to the first common line into fluid communication. For example, if upper back and seat zones 192, 196 are in fluid communication through connector tube 263, tube 232 communicating with lower back zone 194 can be brought into fluid communication with tube 232 communicating with foot zone 198 by second connector tube 265 so that lower back zone 194 is in fluid communication with foot zone 198. By bringing second connector tube 265 into fluid communication with source of compressed air 236, both lower back and foot zones 194, 198 will simultaneously inflate, increasing the firmness and support characteristics of mattress 52 adjacent to lower back and foot zones 194, 198 at the same time and to the same extent. Likewise, by bringing the second connector tube 265 into fluid communication with exhaust line 258, the firmness and support characteristics of mattress 52 adjacent to lower back and foot zones 194, 198 will decrease generally simultaneously and generally to the same extent. Thus, independent zones of air bladder 96 can be linked so that the support and firmness characteristics of mattress 52 adjacent to the linked zones change at the same time to the same extent when adjusted by the user.

In mattress 52 that has four-zone or one-zone air bladder 96, the pressure of each zone 192, 194, 196, 198 can be automatically controlled by placing air bladder 96 into "computer" mode. Once a user establishes a desired pressure for each zone 192, 194, 196, 198 that results in the desired firmness and support characteristics, the pressure in one or more of the zones 192, 194, 196, 198 can change. For example, if the user moves so that a heavier or lighter portion of the user's body is supported by the affected zone, the pressure in the affected zone will change, changing the firmness and support characteristics of the affected zone.

Each zone 192, 194, 196, 198 of air bladder 96 is provided with a transducer 296 for providing an output signal in response to the pressure of each respective zone 192, 194, 196, 198 so that the pressure in each zone 192, 194, 196, 198 can be monitored, and bed and mattress structure 50 can be configured to compensate for these changes in pressure. For example, if the pressure in upper back zone 192 decreases from a set point established by the user, upper back valve 262 can be automatically energized to bring upper back zone 192 into fluid communication with source of compressed air 236 until the pressure in upper back zone 192 increases back to the set point, thus increasing the firmness and support characteristics of mattress 52 to the selected level. Likewise, if the pressure in seat zone 196 increases above the set point established by the user, seat valve 266 and source/exhaust valve 260 can be automatically energized to bring seat zone 196 into fluid communication with exhaust line 258, deflating seat zone 196 until the pressure is reduced back to the set point, thus returning the support and firmness characteristics of mattress 52 adjacent to seat zone 196 to the selected level. By monitoring and adjusting the pressure in each zone 192, 194, 196, 198 of air bladder 96, the user's selected support and firmness characteristics can be maintained.

When mattress 52 is sized for a king- or queen-sized bed as shown in FIG. 2 and core 88 includes two side-by-side air bladders 96, one source of compressed air 236 can be used to inflate and deflate both air bladders 96. Typically, each air bladder 96 is provided with manifold 238 and valves 240, with each source/exhaust valve 260 being in fluid communication with a "T-connector" (not shown) bringing each source/exhaust valve 260 into fluid communication with source of compressed air 236.

As described above, both air bladders 96 can operate in a "computer" mode wherein the pressure of each respective zone 192, 194, 196, 198 is maintained by automatically inflating and deflating each zone to compensate for movement of the user that changes the load carried by each respective zone. The above-described valve configuration in accordance with the present invention prevents a "continuous run" condition. A continuous run condition is present in side-by-side air bladders 96, both of which are on computer mode, when one air bladder 96 is exhausting so that one manifold 238 is in fluid communication with exhaust line 258 at the same time the other air bladder 96 is inflating so that the other manifold 238 is in fluid communication with source of compressed air 236. Since both manifolds 238 are connected by the T-connector, the possibility exists that compressed air source 236 might be in fluid communication with exhaust line 258 so that neither air bladder 96 reaches the desired state, causing the system to run continuously as it attempts to inflate and deflate each air bladder.

However, each source/exhaust valve 260 is a three-way valve that positively blocks the flow between exhaust line 258 and manifold 238 when source/exhaust valve 260 is open to bring manifold 238 into fluid communication with source of compressed air 236. In addition, source/exhaust valve 260 blocks the flow from source of compressed air 236 when source/exhaust valve 260 is energized to bring manifold 238 into fluid communication with exhaust line 258. Thus, use of a three-way valve for source/exhaust valve 260 eliminates the possibility of inadvertently achieving a continuous run condition when operating two side-by-side air bladders.

Figure 10:
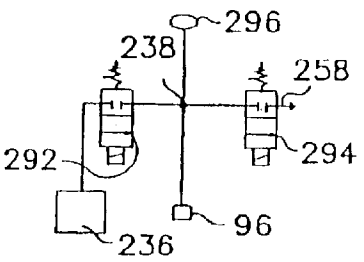
FIG. 10 is a schematic view of a valve manifold for a one-zone air bladder showing a compressed air line, an exhaust line, an air line in fluid communication with the interior region of the air bladder, and a transducer for transducing a pressure measurement to an electronic output signal.

The operation of a one-zone air bladder 96 as shown in FIG. 10 is simpler than the operation of four-zone air bladder 96. An inlet valve 292 is normally closed to block the fluid communication between source of compressed air 236 and manifold 238. Likewise, an exhaust valve 294 is normally closed to block the fluid communication between exhaust line 258 and manifold 238. Manifold 238 is in fluid communication with air bladder 96 and a transducer 296 for converting a measured pressure to an output signal for use by a controller 370 is in fluid communication with air bladder 96 through manifold 238. To increase the firmness and support characteristics of mattress 52 having one-zone bladder 96, user simply energizes inlet valve 292 to restore fluid communication between source of compressed air 236 and air bladder 96 through manifold 238 to inflate air bladder 96. To decrease the firmness and support characteristics of mattress 52, user energizes exhaust valve 294 to restore fluid communication between exhaust line 258 and air bladder 96 through manifold 238 to deflate air bladder 96.

Figure 9:
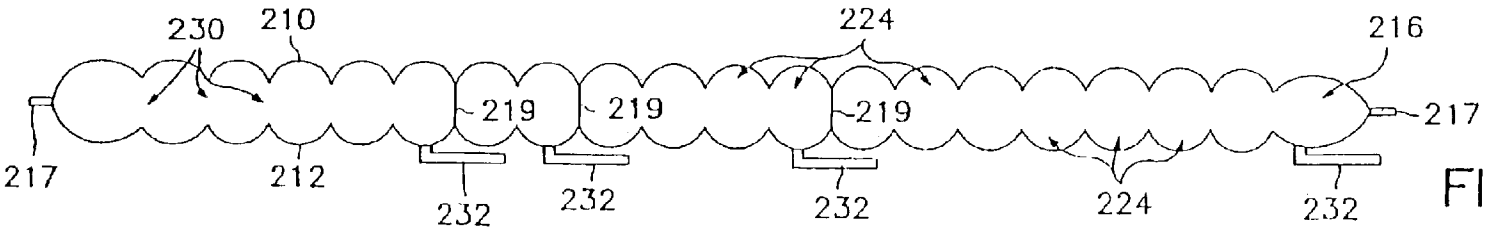
FIG. 9 is a diagrammatic illustration of a sectional view taken along line 9—9 of FIG. 8(*a*) showing the four-zone air bladder having pockets separated by I-beams with the selected I-beams defining the zones of the air bladder, the ends of a second set of I-beams sealingly engaging the edge of the air bladder to separate pockets adjacent to the I-beams to form separate and independently inflatable and deflatable zones of the air bladder.

I-beams 218, 219 are generally of similar height so that pockets 224 are generally uniform in size and shape as shown in FIG. 9. The height of I-beams 218, 219 can be varied as shown in FIGS. 11–14 for I-beams 218' which are taller than I-beams 218, 219 to produce pockets 224' defined by I-beam 218' that inflate to a size larger than pockets 224 that are not adjacent to I-beam 218'. Pockets 224' produce a portion on mattress 52 adjacent to pockets 224' at which the user perceives additional support and firmness. By placing I-beam 218' as shown in FIGS. 11–15, air bladder 96 will provide additional support and firmness for the lumbar portion of the user's adjacent to the lower back zone 194.

Typically, I-beams 218, 219 are generally the same height so that pockets 224 are generally uniform in size and shape as shown in FIG. 9. Air bladder 96 can be made, however, having selected I-beams 218' which are taller than I-beams 218, 219 as shown in FIGS. 11–15 to produce pockets 224' defined by taller I-beams 218' that inflate to a size larger than pockets 224 defined only by I-beams 218, 219 so that upper and lower sheets 210, 212 adjacent to pockets 224' project beyond upper and lower sheets 210, 212 adjacent to pockets 224 defined only by I-beams 218, 219 when pockets 224, 224' are fully inflated, as shown best in FIG. 15. By including isolated pockets 224' that project past the other surfaces of air bladder 96, mattress 52 provides additional firmness and support characteristics at longitudinal zones adjacent to projecting pockets 224'.

Figure 11:
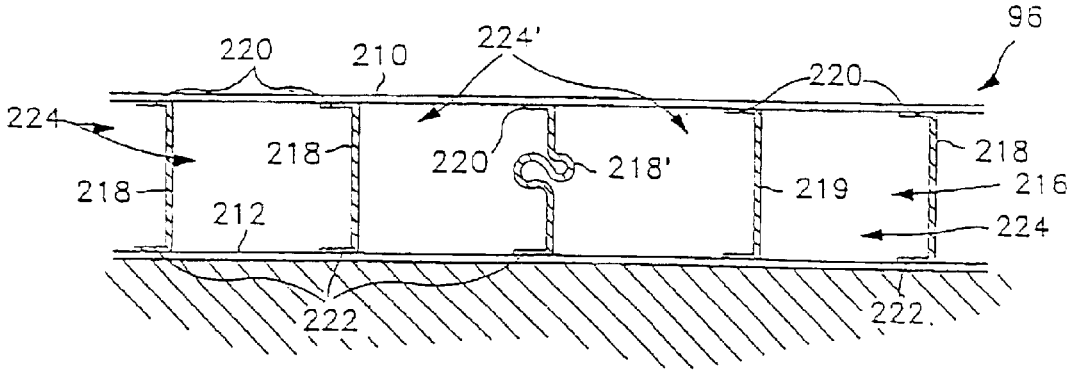
FIG. 11 is a diagrammatic sectional view of the bladder taken along line 11—11 of FIG. 8(*a*) showing an interior region of the partially inflated air bladder including I-beams of generally uniform height with one I-beam being significantly taller than the remaining I-beams.
Figure 12:
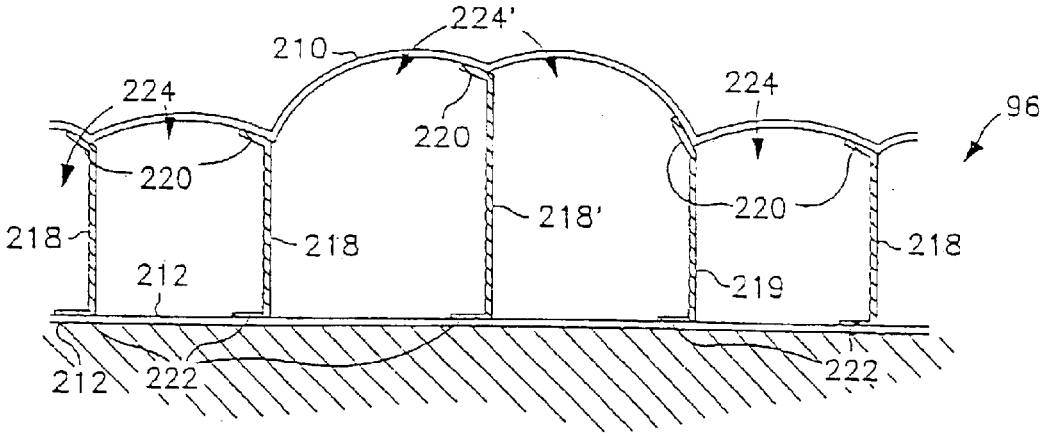
FIG. 12 is a view similar to FIG. 11 showing the air bladder fully inflated so that the air bladder adjacent to the pockets defined by the significantly taller I-beam project above the air bladder adjacent to the other pockets so that the mattress adjacent to the projecting pockets provides a user with additional support and firmness.
Figure 14:
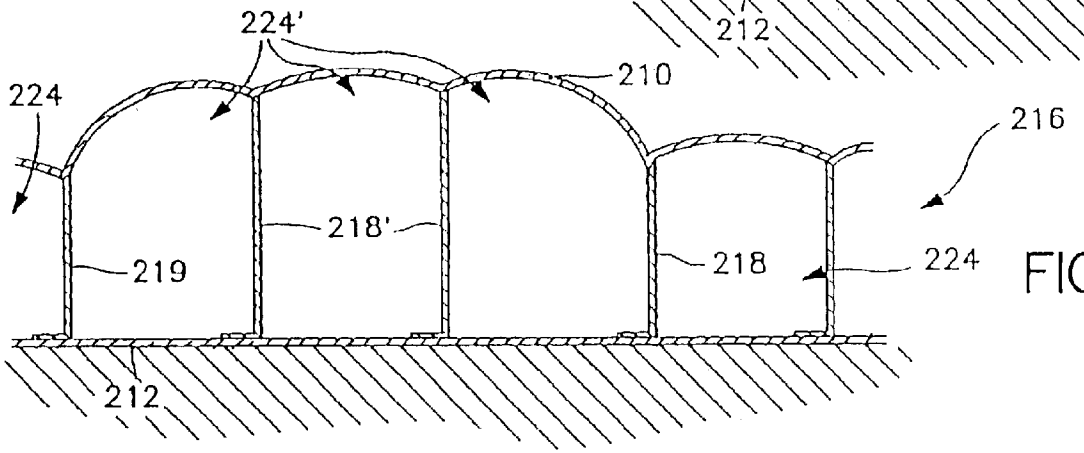
FIG. 14 is a view similar to FIG. 13 showing the air bladder fully inflated so that the air bladder adjacent to the pockets defined by the significantly taller I-beams project above the air bladder adjacent to the other pockets so that the mattress adjacent to the projecting pockets provides a user with additional support and firmness.

For example, a single I-beam 218' can be positioned to lie between two I-beams 218, 219 as shown diagrammatically in FIGS. 11 and 12 for air bladder 96 resting on a generally planar surface. When air bladder 96 is fully inflated, upper sheet 210 adjacent to two adjacent pockets 224, which are both defined in part by I-beam 218', projects above upper sheet 210 adjacent to pockets 224 as shown in FIG. 11. Likewise, two adjacent I-beams 218' can be positioned to lie between I-beams 218, 219 as shown diagrammatically in FIGS. 13 and 14 for air bladder 96 resting on a generally planar surface. When air bladder 96 is fully inflated, upper sheet 210 adjacent to three adjacent pockets 224', each of which are defined at least in part by I-beams 218', projects above upper sheet 210 adjacent to pockets 224 as shown in FIG. 14. Although only one and two adjacent I-beams 218' that are taller than I-beams 218, 219 are shown in FIGS. 11–15, the height of any number of adjacent I-beams 218' may be varied to cause a desired portion of upper and lower sheets 210, 212 of air bladder 96 to project beyond the remaining portions of upper and lower sheets 210, 212.

Figure 15:
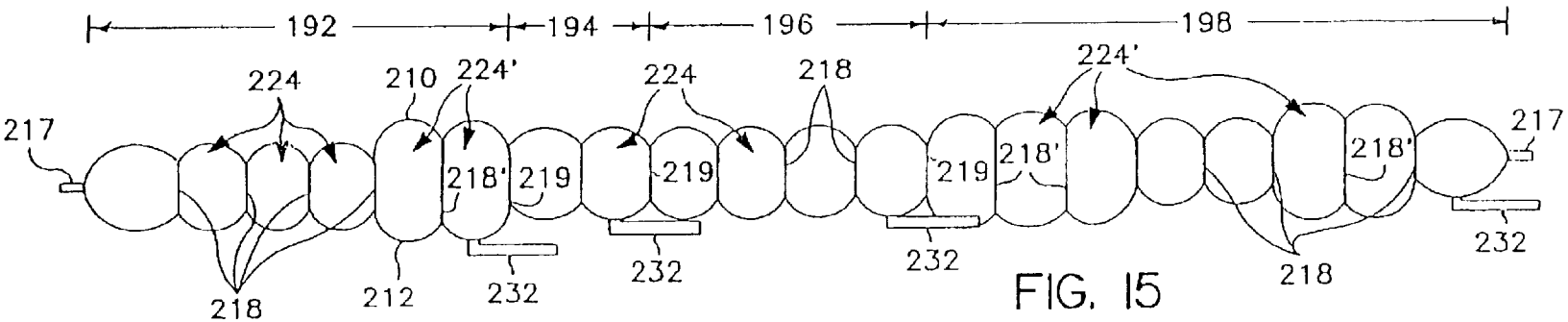
FIG. 15 is a view similar to FIG. 9 showing the air bladder having a plurality of significantly taller I-beams so that the air bladder adjacent to pockets adjacent to the lumbar region of the user, pockets adjacent to the thigh of the user, and pockets adjacent to the ankles of the user project above the air bladder adjacent to the other pockets to provide a user with additional support and firmness near portions of the mattress adjacent to the projecting pockets and to provide additional pressure relief to the heels of the user.
Figure 17:
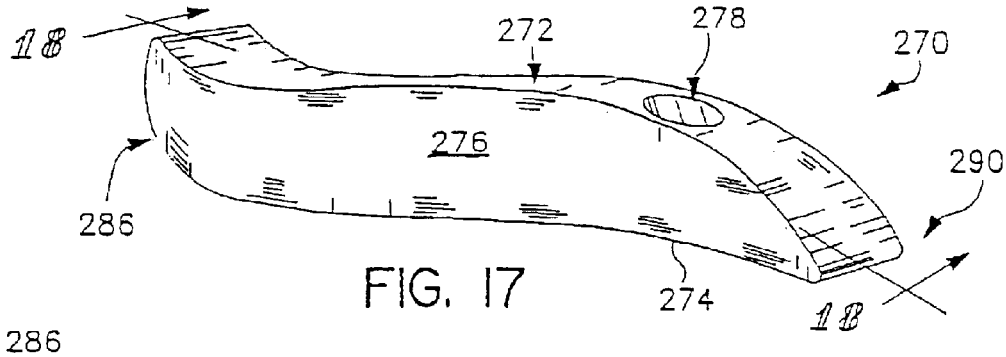
FIG. 17 is a perspective view of an arm rest in accordance with the present invention.
Figure 18:
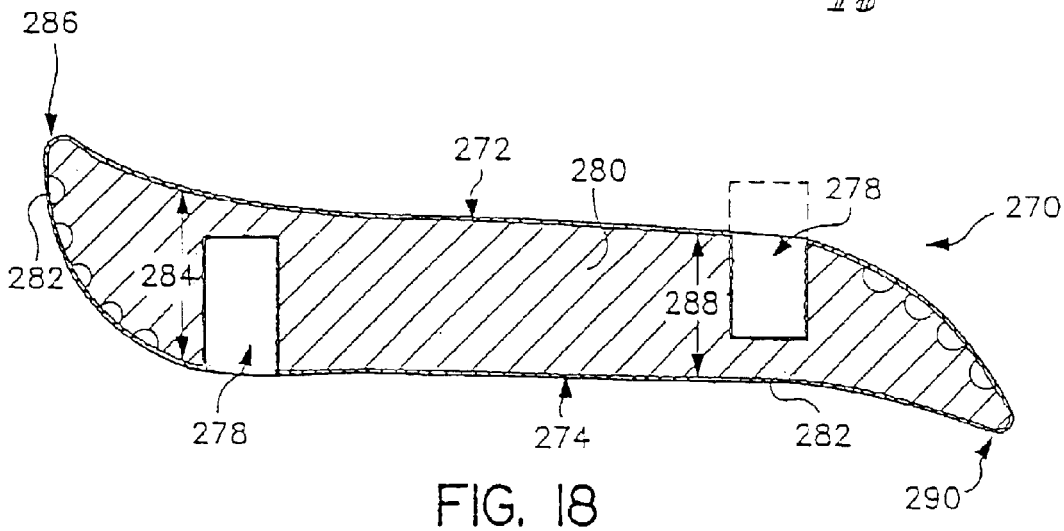
FIG. 18 is a sectional view of taken along line 18—18 of FIG. 17 showing a cover surrounding the arm rest and showing a cup (in phantom) received in a cup holder formed in the arm rest.

Taller I-beams 218' can be used to provide firmness and support characteristics that vary longitudinally along mattress 52 including air bladder 96 as shown in FIG. 15, even if air bladder 96 is a one-zone air bladder. In addition, use of taller I-beams 218' can cause each zone of a multiple zone air bladder 96 to provide mattress 52 with multiple firmness and support characteristics adjacent to the zone.

For example, I-beams 218' can be used to form pockets 224' in foot zone 198 adjacent to seat zone 196 as shown in FIG. 15. Mattress 52 including air bladder 96 with such pockets 224' will provide the user with additional firmness and support adjacent to his or her thighs. Thus foot zone 198, which includes pockets 224, 224' that are all in fluid communication so that the air pressure in each pocket 224, 224' of foot zone 198 is generally equivalent, will simultaneously provide the portion of mattress 52 adjacent to foot zone 198 with multiple firmness and support characteristics.

For another example, I-beams 218' can be used to form pockets 224' in foot zone 198 adjacent to the ankles of the user as shown in FIG. 15. Mattress 52 including air bladder 96 with such pockets 224' will provide the user with additional firmness and support adjacent to his or her ankles. In addition, by providing this additional support adjacent to the ankles of the user, mattress 52 will operate to relieve interface pressure against the heels of the user to help alleviate pressure ulcers that can develop on the heels of the user. Air bladder 96 can thus be used to adjust the support and firmness characteristics of mattress 52 both by having adjustable air pressure in one or multiple longitudinal zones, for example zones 192, 194, 196, 198, and by using I-beams 218' that are taller than other I-beams 218, 219 so that portions of upper and lower sheets 210, 212 of air bladder 96 project beyond portions of upper and lower sheets 210, 212 adjacent only to I-beams 218, 219.

Flange 217 of air bladder 96, which is positioned to lie outside of perimetral bead 214 as shown in FIGS. 8(*a*), 8(*b*), and 9, is formed from outer portions of both the upper and lower sheets 210, 212. Flange 217 is formed to include a plurality of spaced-apart openings 244 that extend therethrough. Openings 244 are used during the manufacturing process to stabilize air bladder 96 as manufacturing operations are performed thereon.

Openings 244 can also be used, however, to stabilize air bladder 96 in mattress 52. For example, when mattress 52 is provided for a queen-sized bed (not shown) so that core 88 includes elements in side-by-side abutting engagement, if core 88 includes side-by-side air bladders 96, then openings 244 of the first air bladder 96 can be tied to openings 244 of the second air bladder 96 to prevent relative transverse movement of the first air bladder 96 relative to the second air bladder 96. Even if core 88 includes side-by-side elements only one of which is an air bladder 96, openings 244 can still be used to stabilize air bladder 96 if desired.

Figure 16:
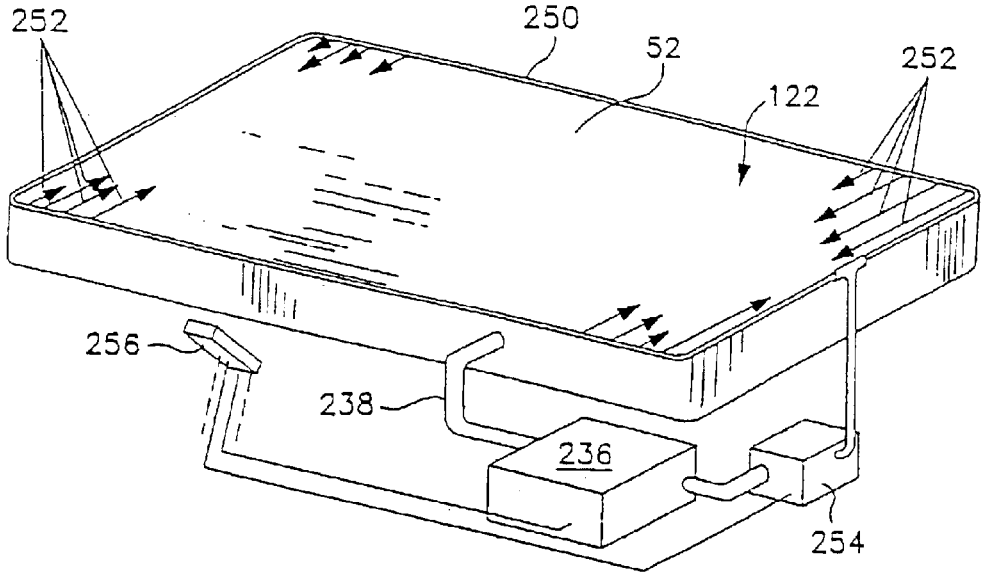
FIG. 16 is a view of the mattress of FIGS. 1(*a*) and 2 showing an air supply providing pressurized air to an air bladder inside of the mattress and to an enclosed channel formed along the perimeter of the upwardly-facing sleeping surface of the mattress and an air heater interposed between the air supply and the channel to heat the air received by the channel, the material enclosing the channel being formed to include small openings that direct a small volume of air from the channel across the sleeping surface to warm or cool the user.
Figure 13:
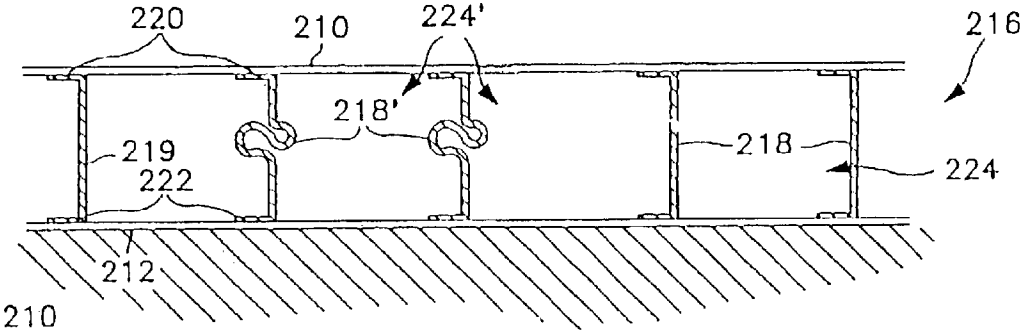
FIG. 13 is a diagrammatic sectional view taken along line 13—13 of FIG. 8(*a*) showing an interior region of the partially inflated air bladder including I-beams of generally uniform height with two I-beams being significantly taller than the remaining I-beams.

In bed and mattress structure 50, top cover 60 of mattress 52 can be formed to include an enclosed "warm air release" channel 250 receiving air from source of compressed air 236 as shown in FIG. 16. Enclosed channel 250 is preferably made from a light weight and air impermeable material so that air is directed along the length of channel 250. The material is formed to include small openings (not shown) that allow a small amount of air to escape from channel 250. The openings direct the air across the surface of mattress 52 as shown by arrows 252 in FIG. 12.

An air heater 254 is interposed between source of compressed air 236 and channel 250 as shown in FIG. 16 so that heated air can be provided to channel 250. Air heater 254 can be selectively operated so that when air heater 254 is operating, air 252 is the warm air release warming the user and particularly warming the extremities of the user. When air heater 254 is not operating, air 252 is a room temperature air release cooling the user during operation of channel 250. Of course, a valve is positioned between source of compressed air 236 and channel 250 so that channel 250 can be operated or not operated at the discretion of the user.

Channel 250 can be positioned about the perimeter of top cover 60 as shown in FIG. 16. As mentioned above, the preferred material of construction of much of mattress 52 is foam rubber which is a thermal insulator. As such, it is important that channel 250 be as close as possible to sleeping surface 122 and the user. As a result, if mattress 52 includes pillow top 90, then channel 250 can be formed around an outer edge of pillow top 90 rather than top cover 60 so that channel 250 is adjacent to sleeping surface 122.

Also, a hand held controller 256 is provided for use by the user as shown in FIG. 16 for controlling the operation of bed and mattress structure 50. Hand held controller 256 can operate both source of compressed air 236 and air heater 254 as well as other mattress functions as described in detail below with reference to FIGS. 21 and 22.

Bed and mattress structure 50 can additionally be provided with arm rests 270 as shown in FIGS. 17–20. Arm rest 270 includes a curved top surface 272, a curved bottom surface 274, and generally planar sides 276. Top and bottom surfaces 272, 274 can each be formed to include openings 278 sized to receive drinking glasses, drinking cups, beverage cans, or the like (shown in phantom in FIG. 18). The preferred arm rest 270 includes a foam rubber pad 280 and a fabric covering 282 conformingly shaped to fit around pad 280 as shown best in FIG. 18. Top and bottom surfaces 272, 274 are spaced apart by a first distance 284 near a first end 286 of arm rest 270 and taper together so that top and bottom surfaces 272, 274 are spaced apart by a second distance 288 near a second end 290 of arm rest 270.

Figure 19:
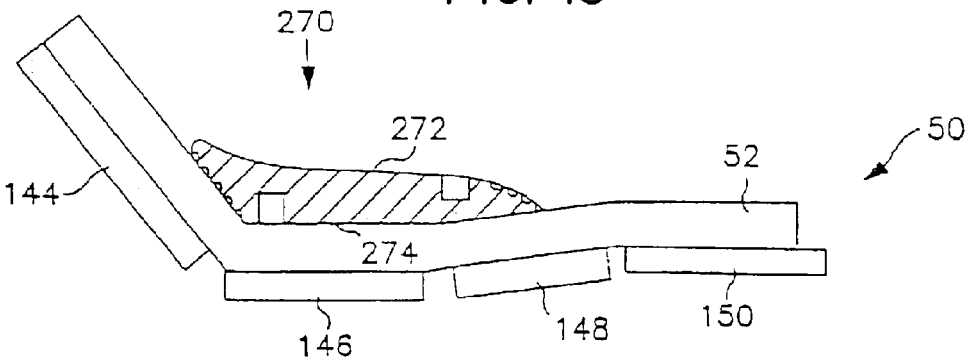
FIG. 19 is a view similar to FIG. 18 showing a bed having an articulated deck moved to a position away from the generally planar sleeping position, a mattress received on the deck, and the arm rest in a first orientation.
Figure 20:
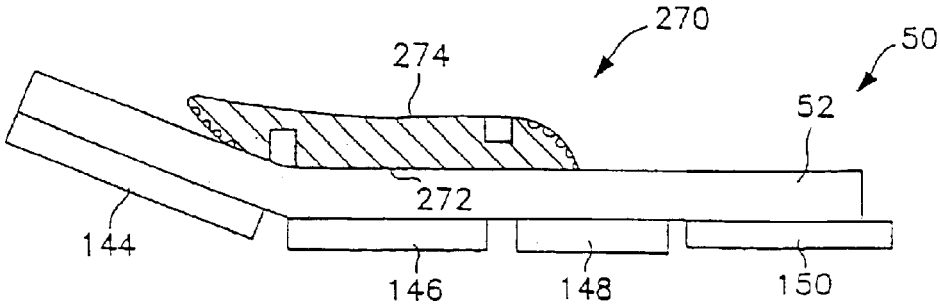
FIG. 20 is a view similar to FIG. 19 showing the deck moved to a different position away from the generally planar sleeping position, the mattress on the deck, and the arm rest in a second orientation.

Arm rest 270 is positioned between the elbow of the user (not shown) and sleeping surface 122. The distance between the elbow and sleeping surface 122 varies somewhat between users resting on sleeping surface 122. By moving arm rest 270 longitudinally relative to the elbow of the user, most users will find a position on arm rest 270 having a distance between top and bottom surfaces 272, 274 at which the user can comfortably rest his or her elbow. If the user finds that it is most comfortable to rest his or her elbow nearer to first end 286 than to second end 290, the user will most likely prefer to use arm rest 270 with top side 272 facing upwardly as shown in FIG. 19 so that upwardly-facing opening 278 is on the portion of arm rest 270 extending longitudinally away from seat section 146. Conversely, if the user finds that it is most comfortable to rest his or her elbow nearer to second end 290 than to first end 286, the user will most likely prefer to use arm rest 270 with bottom side 274 facing upwardly as shown in FIG. 20 so that once again upwardly-facing opening 278 is on the portion of arm rest 270 extending longitudinally away from seat section 146. It can be seen in each instance that the shapes of top and bottom surfaces 272, 274 generally conform to the shape of sleeping surface 122 of mattress 52 when deck 138 is articulated away from the generally planar sleeping position.

Figure 22:
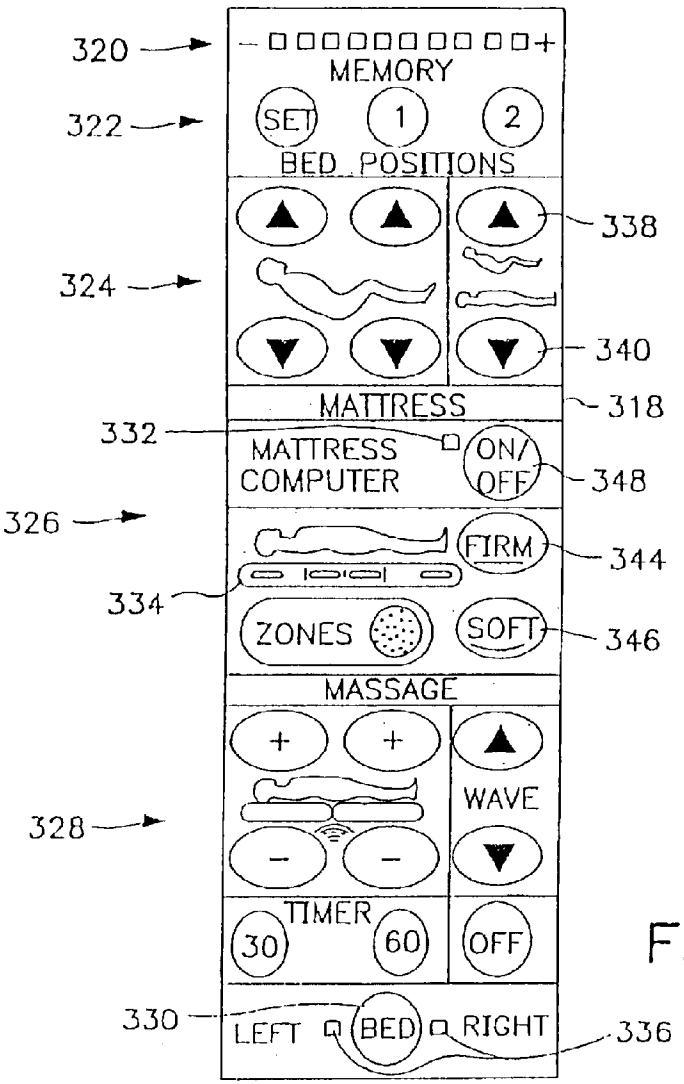
FIG. 22 is a plan view of a portion of the hand held controller of FIG. 21 showing the indicia on the hand held controller and showing "bed position buttons" on a first end, the buttons being arranged in a "use-frequency arrangement" having the most frequently used buttons positioned to lie adjacent to the first end, the least frequently used buttons positioned to lie adjacent to the second end which is opposite the first end, and the remaining buttons positioned to lie therebetween arranged in order of the frequency of use with the more frequently used buttons being positioned closer to the first end than the less frequently used buttons.
Figure 21:
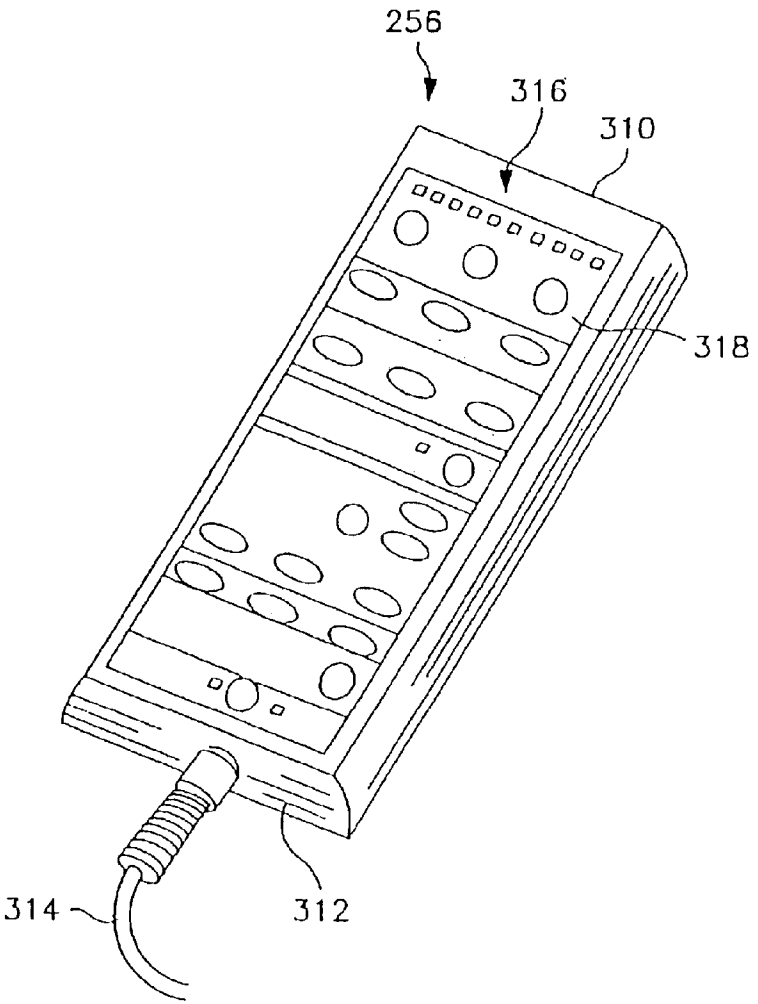
FIG. 21 is a perspective view of the hand held controller of FIG. 16 for controlling the positions of the articulating portions of the articulating deck of the bed, controlling the pressure of air in the four zones of the bladder, and for pre-setting in memory air pressures selected by the user corresponding to deck positions selected by the user so that by pressing a single button the deck will adjust to the preselected position and the bladder will adjust pressures in the four zones to the preselected pressures.

As mentioned above, hand held controller 256 is provided as shown in FIGS. 16, 21, and 22 for controlling the operation of bed and mattress structure 50. Hand held controller 256 includes a first end 310, a second end 312, a power and communication cord 314 extending away from second end 312 and toward bed and mattress structure 50, an upper face 316, and a key pad 318 carried on upper face 316 for receiving inputs from the user, bed and mattress structure 50 adjusting its various features in response to the inputs from keypad 318 as described below. When the user is holding hand held controller 256 to operate bed and mattress structure 50, hand held controller 256 will typically be held in a generally upright orientation as shown in FIG. 21 having first end 310 positioned to lie generally above second end 312.

Illustrative key pad 318 includes a light emitting diode (LED) primary display 320, memory buttons 322, bed position buttons 324, mattress control buttons 326, massage control buttons 328, and a bed select button 330 as shown in FIG. 22. In addition, key pad 318 includes an LED computer on/off display 332, an LED zone display 334, and an LED bed select display 336. As described below, illustrative key pad 318 is configured for use with a king- or queen-sized bed having an articulating deck 138 and having at least one four-zone air bladder 96. Other beds having other features would include hand held controller 256 having a key pad 318 including at least some of these buttons.

Key pad 318 is arranged so that primary display 320 is positioned adjacent to first end 310 of key pad 318 as shown in FIG. 22. The remaining buttons and displays are positioned to lie in longitudinally spaced-apart relation between primary display 320 and second end 312. Memory buttons 322 are positioned adjacent to primary display 320, bed position buttons 324 are positioned adjacent memory buttons 322, mattress control buttons 326 are positioned adjacent bed position buttons 324, massage control buttons 328 are positioned adjacent mattress control buttons 326, and bed select button 330 is positioned adjacent massage control buttons 328 and adjacent second end 312 of key pad 318.

Memory buttons 322 provide the user with the ability to establish one or more preferred "memory positions" of articulating deck 138. In addition, the memory positions include a corresponding air pressure in zones 192, 194, 196, 198 of air bladder 96 selected by the user to provide selected firmness and support characteristics to correspond to each preferred position of articulating deck 138, as shown in FIG. 22 in which illustrative key pad 318 allows the user to establish two memory positions. Once the user establishes the memory positions, the user simply presses the memory button corresponding to the desired position and articulating deck 138 will automatically move to its prescribed position while each zone 192, 194, 196, 198 of air bladder 96 is automatically inflated or deflated to its prescribed pressure so that mattress 52 provides the preselected firmness and support characteristics selected by the user to correspond to the selected position of articulating deck 138.

Bed position buttons 324 allow the user to manipulate the articulating sections of articulating deck 138. In addition, certain of the individual LEDs of primary display 320 will be energized to indicate the relative position of articulating deck 138. In addition, primary display 320 indicates the relative air pressure in zones 192, 194, 196, 198 of air bladder 96. Primary display 320 will provide an indication for the last button pressed. If more than one function is running at one time or if memory buttons 322 are pressed, primary display 320 will indicate the relative position of head section 144 of deck 138. Also, bed position buttons 324 include a preset "lounge" button 338 and a preset "bed flat" button 340 which are additional memory keys that are set during assembly of mattress 52 in accordance with inputs from the customer profile sheet.

Mattress control buttons 326 shown in FIG. 22 include a "zones" button 342 for selecting a zone 192, 194, 196, 198 of air bladder 96 in response to user pressing zones button 342, zone display 334 including LED indicators, one of which will be energized to indicate the selected zone 192, 194, 196, 198, a "firm" button 344 for increasing the air pressure in the selected zone in response to user pressing firm button 344 to increase the firmness of mattress 52 adjacent to the selected zone, and a "soft" button 346 for decreasing the air pressure in the selected zone in response to user pressing soft button 346 to decrease the firmness of mattress 52 adjacent to the selected zone. As described above, when the user presses zones button 342 to select a selected zone, primary display 320 will indicate the relative air pressure in the selected zone.

In addition, mattress control buttons 326 include a mattress computer on/off button 348. Once a user has selected a desired air pressure for each zone 192, 194, 196, 198, the user may move relative to air bladder 96. As the user moves, heavier or lighter body parts of the user may be supported by each respective zone 192, 194, 196, 198 than were supported by the zone when the desired air pressure was originally selected. If the amount of air in zones 192, 194, 196, 198 were fixed, this movement of user could change the forces exerted on each zone 192, 194, 196, 198, thus changing the air pressure in each zone and the support and firmness characteristics of mattress 52 adjacent to each zone 192, 194, 196, 198.

Mattress 52 preferably includes transducers 296, described above with reference to FIGS. 8(*a*), 8(*b*), and 10, for measuring the air pressure in each zone 192, 194, 196, 198. If, after selecting the desired firmness and support characteristics for each zone 192, 194, 196, 198 the user presses computer on/off button 348 to turn on the "computer mode," an internal computer will monitor output signals provided from each transducer 296 in response to the air pressure in each zone 192, 194, 196, 198 and will automatically operate valves 240 when necessary and in the manner described above with reference to FIGS. 8(*a*) and 8(*b*) to maintain the pressure in each respective zone 192, 194, 196, 198 at a set point that corresponds to the firmness and support characteristics chosen by the user. If computer mode is turned on, the LED of computer on/off display 332 will be energized to indicate such status.

Mattress 52 can also be provided with a massage feature. The presently preferred massage feature is provided by first and second motors (not shown), the first motor being attached to articulating deck 138 adjacent to head section 144 and the second motor being attached to articulating deck 138 adjacent to foot section 150. Each motor rotates a generally horizontally extending shaft. An off-center weight is fixed to each shaft so that as each shaft rotates, each shaft, each motor, and deck 138 adjacent to each motor vibrates. To increase the level of vibration felt by the user, the rotation speed of the shafts is increased and to decrease the level of vibration felt by the user, the rotation speed of the shaft is decreased.

As mentioned above, mattress control buttons 326 include massage control buttons 328, including head end massage increase button 350, head end massage decrease button 352, foot end massage increase button 354, foot end massage decrease button 356, and wave buttons 358. When the user presses head end massage increase button 350, the motor attached to articulating deck 138 adjacent to head section 144 increases the rotational speed of its shaft until a maximum rotational speed is reached at which point the rotational speed of the shaft cannot be further increased.

When the user presses head end massage decrease button 352, the motor attached to articulating deck 138 adjacent to head section 144 decreases the rotational speed of its shaft until a minimum rotational speed is reached. The motor will halt the rotation of the shaft if head end massage decrease button 352 is pressed when the shaft is rotating at the minimum rotational speed. Likewise, pressing foot end massage increase button 354 and foot end massage decrease button 356 causes the motor attached to articulating deck 138 adjacent to foot section 150 to increase and decrease the rotational speed of its shaft. Pressing wave buttons 358 causes the motors to operate together to provide a coordinate massage effect.

Finally, if mattress 52 is for a queen- or king-sized bed having side-by-side air bladders 96, hand held controller 256 will control both halves of bed and mattress structure 50. Pressing bed select button 330, shown in FIG. 22, will toggle between the two halves of the bed and mattress structure 50 so that when the "left" LED of bed select display 336 is energized control inputs from the user to key pad 318 will operate to manipulate the left side of bed and mattress structure 50, and when the "right" LED of bed select display 336 is energized, control inputs from the user to key pad 318 will operate to manipulate the right side of bed and mattress structure 50.

Typically when the user operates bed and mattress structure 50 including articulating deck 138 and four-zone air bladder 96 using illustrative key pad 318 shown in FIG. 22, the user will press one of memory buttons 322. However, on occasion, the user may choose to adjust the position of articulating deck 138 using bed position buttons 324 and may, probably less frequently, wish to adjust the support and firmness characteristics of mattress 52 by pressing mattress control buttons 326. Occasionally, the typical user will utilize the massage feature by pressing massage control buttons 328.

Thus, illustrative key pad 318 is arranged so that buttons are ordered from first end 310 to second end 312, or from top to bottom, in order of the frequency of use of the buttons so that the most frequently used buttons are positioned to lie nearest the top or first end 310 of key pad 318 and the least frequently used buttons are nearest the bottom or second end 312 of key pad 318. In addition, it can also be seen that illustrative key pad 318 is arranged so that buttons are ordered from first end 310 to second end 312, or from top to bottom of key pad 318, generally in the order that the user will use the buttons so that the first buttons generally used in a typical operation sequence are nearest the top of key pad 318 and the last buttons used in a typical operation sequence are nearest the bottom of key pad 318.

Figure 23:
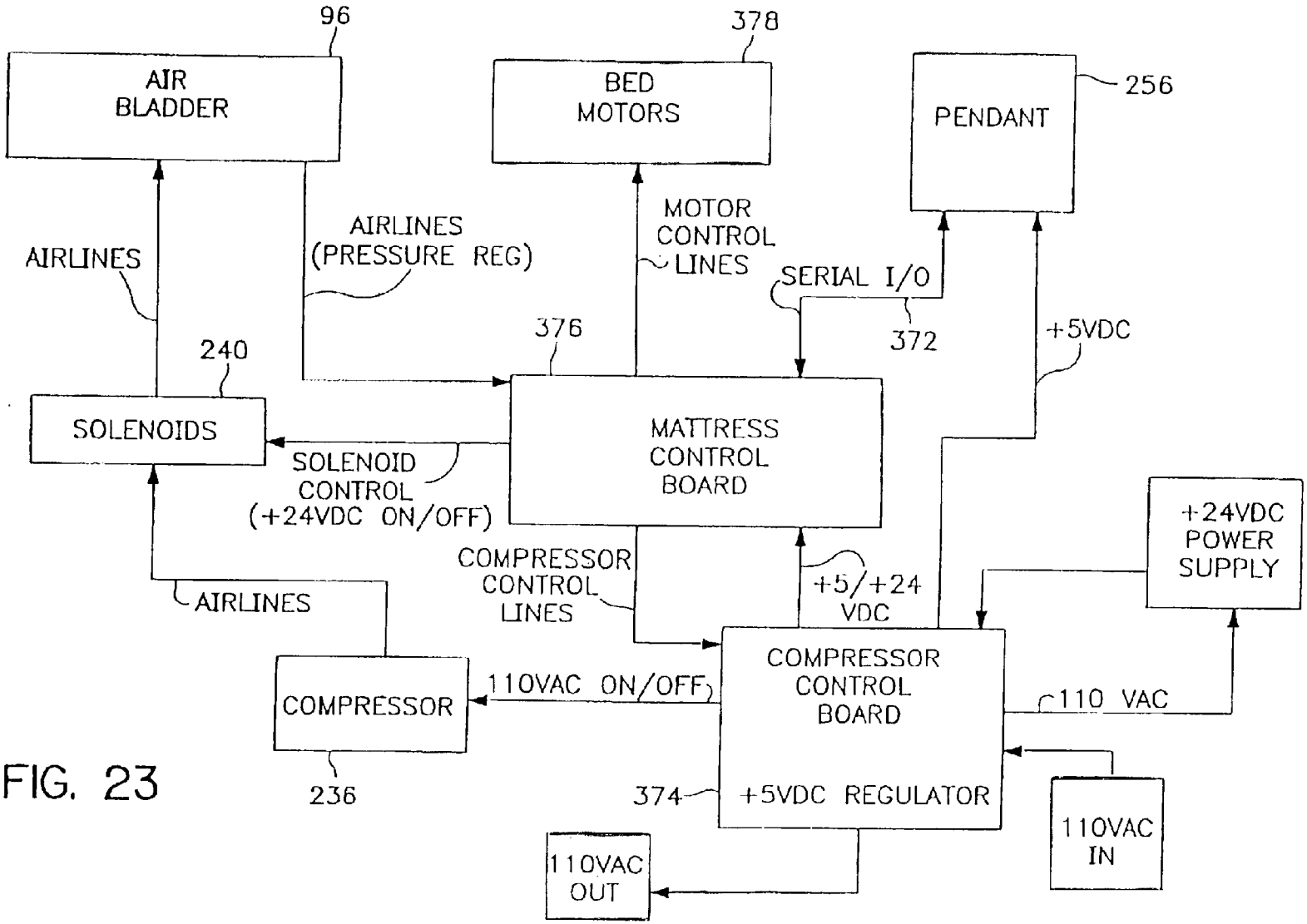
FIG. 23 is a schematic block diagram illustrating the electrical components of a control system for controlling features of the bed and mattress structure in accordance with the present invention.

Hand held controller 256 provides the man-machine interface for the user. By depressing buttons 322, 324, 326, 328, 330 (graphically displayed) the user can select various operations. These operations are bed position, mattress computer, memory, massage, mattress zones, and firm or soft controls. These commands are sent by way of an RS232 wire connection 372 to the compressor board 374 as shown in FIG. 23. The compressor board 374 acts as an interconnection interface to the mattress control board 376, massage and bed position motors 378. Signals generated at hand held controller 256 pass through compressor board 374 to mattress control board 376. Mattress controller operates valves 240 to control the flow of compressed air or exhaust from zone to zone. Mattress controller also receives signals from transducers 296 that monitor the air pressure at each zone and provides signals back to hand held controller 256 for display.

Hand held controller 256 is a microprocessor based control system capable of remotely controlling up to eight bladders or individual air zones of air bladders 96 via a serial link with pressure control system. The system will also receive and display relative pressure information by way of the serial link. The link itself is to be either a wire or a wireless link.

The system is based on a Microchip 16 C series surface mount one time programmable device. There are two microcontrollers used. One located in hand held controller 256 and the other is in mattress control board. They communicate VIA an RS232 serial link.

The primary benefit of the Microchip device is the implementation of control algorithms due to the controller's reduced instruction set. Additional benefits include:

- Simplified memory requirement predictions, and timing calculations due to the single line, predominantly single cycle instructions.
- Low Cost.
- No additional program memory required.
- Software is directly portable to other devices in the large family allowing for easier upgrades.
- Specialized sleep capability, and external interrupts allow a power consumption savings.
- Built in, independent watch dog timer prevents system crash due to an unresponsive controller.
- Separate program and data memory prevents unintentional program corruption due to accidental program memory access.

A salient feature for this system is the implementation of a direct feed back display on key pad 318 at the man-machine interface. Primary display 320 presents the user with direct real time feed back of control operations. Mattress control board 376 receives signals from transducers 296 in response to the air pressure in each zone and uses that information to display pressure setting and the controlled zones of air bladder 96 on primary display 320 of hand held controller 256.

Mattress 52 is ideally suited for providing a user with sleeping surface 122 that is customized to provide firmness and support characteristics established by and for the user. As described above, mattress 52 can include air bladder 96 having either one zone or multiple zones, and within each zone air bladder 96 can be provided with I-beams of varying height to provide multiple firmness and support characteristics within each zone. Mattress 52 can also include sculptured foam core 94 or zone foam blocks 92 as described above. In addition, however, mattress 52 may be provided with combinations of the above as shown in FIGS. 1(*b*) and 1(*c*).

Mattress 52 can be provided with a combination of zone foam blocks 92 and air bladders 96 as shown in FIG. 1(*b*) which illustratively shows air bladders 96 for supporting the scapula and sacrum of the user and zone foam blocks 92 for supporting the lumbar region and the thighs and legs of the user. Air bladders 96 can operate individually and separately, or air bladders 96 can be brought into fluid communication with one another in a manner similar to that described above with respect to FIG. 8(*b*) so that they inflate and deflate generally at the same time and to generally the same extent.

Likewise, mattress 52 can illustratively include zone foam blocks 92 positioned to support the upper back, the seat, and the lower legs of the user and air bladders 96 to support the lumbar region and thighs of the user as shown in FIG. 1(*c*). As mentioned above, air bladders 96 can operate individually and separately, or air bladders 96 can be brought into fluid communication with one another in a manner similar to that described above with respect to FIG. 8(*b*) so that they inflate and deflate generally at the same time and to generally the same extent. As can be seen, any combination or positioning of zone foam blocks 92 and air bladders 96 can be provided in mattress 52 to meet the desired firmness and support characteristics of the user. Although preferred sculptured foam core 94 generally extends the full length of central opening 82, shorter sculptured foam cores (not shown) can be provided for use in combination with air bladders 96 and zone foam blocks 92 if desired to provide the user with his or her preferred firmness and support characteristics without exceeding the scope of the invention as presently perceived.

Mattress 52 along with a "test mattress" (not shown) containing a multiple zone air bladder 96 can be used to determine the firmness, support, and interface pressure preferences of the user and to use the same to customize mattress 52 for each user. The preferred method for customizing mattress 52 is initiated when a potential user completes a questionnaire to aid in the analysis of that user's "sleep profile." The sleep profile assesses such factors as the user's general health and sleep habits. A firmness recommendation is computed either in terms of a pressure for various zones of the test mattress or in terms of a foam type and density for each zone. In addition, a surface recommendation is established based on the user's responses to a surface recommendation questionnaire.

Once the surface and hardness recommendations are established, the user lies on the test mattress and air bladder 96 is pressurized to match the firmness recommendation. Zones of air bladder 96 are then adjusted to match the preferences of the user and the resulting preferred firmness readings are recorded.

An algorithm has been developed that correlates the air bladder pressure readings once the preferred firmness and support characteristics have been established by the user into a customized bed configuration. For example, the preferred firmness readings can be translated to establish the foam density that, if incorporated into a mattress will provide the firmness and support characteristics similar to those provided by the test sleeping surface having the preferred firmness readings.

This correlation can be developed by comparing the deformation of air bladder 96 having a selected air pressure when a known force is applied thereto by a probe of a known size, and then determining a foam ILD that provides the same deflection when the same force is applied to the foam by the same probe. A pressure deformation response curve can be developed that shows the foam ILD that provides generally the same deflection as air bladder 96 for various air pressures within bladder 96.

Once the air pressure readings have been found that provide the user with his or her preferred firmness, support, and interface pressure characteristics, mattress 52 can be prepared using the pressure deformation response curve so that mattress 52 has mattress structure components or cores 88 including sculptured foam core 94, zone foam blocks 92, air bladder 96, or a combination thereof that provide the user with the preferred characteristics. In addition, if desired, a computer can be used to map the pressure readings of the test mattress after finding the user's preferred firmness and support characteristics and a program can utilize the pressure map and the pressure deformation response curve to determine the arrangement of mattress structure components that will provide mattress 52 that meets the user's preferences.

Once the customized bed configuration is established, mattress 52 can be assembled from a kit at the point of sale containing the plurality of cores 88 for the user to test and verify that assembled mattress 52 meets his or her preferences. If mattress 52 is not satisfactory, cores 88 can be replaced at the point of sale. Once the user is satisfied with the arrangement of cores 88, he or she can immediately take delivery of the completed customized mattress if desired. In the alternative, once the customized bed configuration is established, the data describing this configuration can be transmitted to a factory at which the mattress 52 can be assembled for delivery to the user.

In addition, if the user determines after assembly and delivery that the user prefers alternate firmness or support characteristics, cores 88 can again be readjusted or upgraded until the mattress 52 provides the desired firmness and support characteristics. If desired, a kit of cores 88 can be provided to the user so that the user can adjust the firmness and support characteristics.

The method for selecting mattress structure components or cores 88 to provide a customized foam mattress 52 to accommodate the musculoskeletal condition of the user includes providing a plurality of mattress structure components arranged for selective assembly of the components. The components comprise a plurality of foam cores 88 for filling longitudinally extending central opening 82 in mattress 52 above which the user rests. Foam cores 88 should have a variety of shapes and support and firmness characteristics from which to select a desired assembly.

The method also includes providing a test mattress having a similar longitudinally extending central opening filled with a plurality of longitudinally spaced apart air bladders extending transversely across the central opening and an air supply for selectively filling each air bladder to various pressures. A user is placed above the central opening of the test mattress and supported on the plurality of air bladders. The air pressure in each bladder is adjusted to a selected pressure to provide the support and firmness desired by the user. An equivalent foam core having the desired support and firmness characteristics corresponding to the selected air pressures is then selected and placed in the central opening to provide the customized mattress.

The mattress 52 in accordance with the present invention can be sized for a twin bed or a double bed as shown in FIGS. 1(*a*)–1(*c*), or a queen-sized or a king-sized bed as shown in FIG. 2. When mattress 52 is sized for the queen and king-sized beds, both sides of mattress 52 can be individually customized if desired to provide the firmness and support characteristics desired by individual sleep partners. Both cores 88 and toppers 86 can be selected for each side of mattress 52 to provide the desired firmness and support for each side of the bed. This flexibility results from the separate cores 88 that are provided for each side of mattress 52.

In addition to this flexibility, use of distinct cores 88 for each half of mattress 52 operates to reduce the transmission of movement from one side of mattress 52 to the other. Thus, when one sleeping partner moves, the amount of movement experienced by the other sleeping partner as a result is minimized.

As mentioned above, mattress 52 can be provided with an air bladder having independent zones that are selectively adjustable by the user to provide varied firmness and support characteristics. If the same mattress 52 is used on a bed having articulating deck 138, mattress 52 can be provided with hand held controller 256 for use by the user to control the adjustment of both the position of deck 138 and the support characteristics of each zone of air bladder 96. In addition, hand held controller 256 can include a "memory set" feature which allows the user to establish preferred combination settings for deck 138 and mattress 52.

In addition, the mattress can be provided with combinations of air bladders 96, zone foam elements 92, and sculptured foam core 94 to produce a "combination mattress." Illustratively, mattress 52 can be provided having air bladder 96 supporting the scapula of the user, zone foam blocks 92 supporting the lumbar of the user, air bladder 96 in the seat portion supporting the sacrum of the user, and zone foam blocks 92 supporting the thighs and legs. If desired, air bladders 96 can be in fluid communication so that they inflate and deflate at the same times and to the same pressures or air bladders 96 can be independent of one another and independently controlled by the user so that the user can establish different characteristics of support and firmness for each of the scapula and the sacrum.

Figure 24:
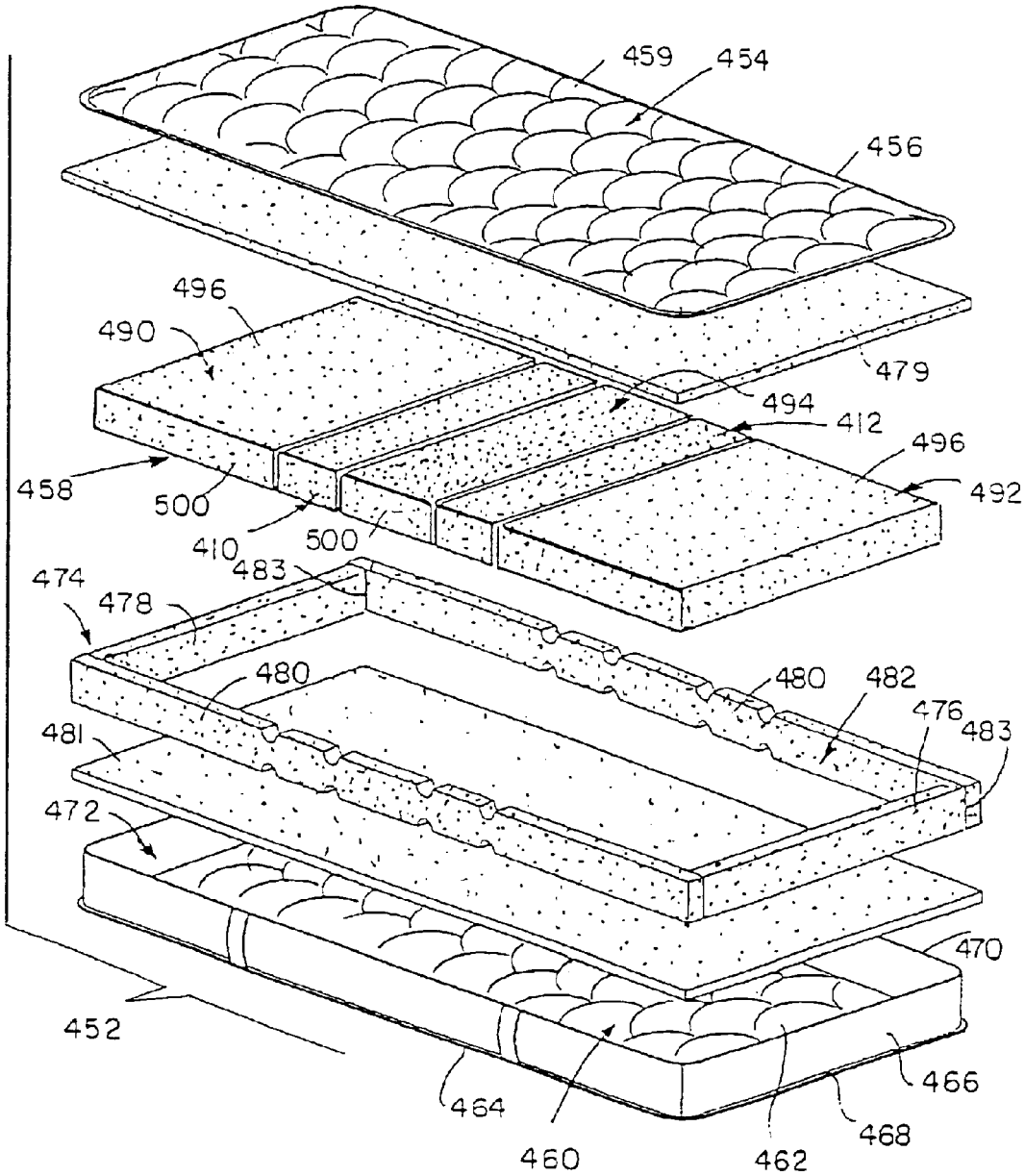
FIG. 24 is an exploded perspective view of an alternative embodiment of a mattress apparatus of the present invention, with portions broken away showing a top quilted panel, a bottom quilted panel, a frame defining a central opening positioned between the top and bottom quilted panels, a mattress core positioned in the central opening and including a head-end block, a foot-end block, and a seat block, a first zone block having a first block firmness and positioned to lie between the head-end block and the seat block, and a second zone block having a second block firmness and positioned to lie between the foot-end block and the seat block.

In an alternative embodiment of the present invention illustrated in FIG. 24, a mattress apparatus 452 is provided that includes at least four different combinations of firmness feels. Mattress apparatus 452 enables retailers to use a single testing apparatus to present a user with at least four different firmness feels prior to purchase. Thus, mattress apparatus 452 allows the retailer to conserve floor space by having fewer test mattresses in the store and the user to customize the feel of a mattress that they plan to purchase from retailer. The various firmness feels are accomplished by having mattress apparatus 452 provide users with vertical zoning (hereinafter "controlled compression") and well as head-to-toe zoning. This generally two-dimensional zoning minimizes interface pressure between the user and mattress apparatus 452 by distributing the weight loading of the user on apparatus 452.

Referring to FIG. 24, mattress apparatus 452 includes a top quilted panel 454 and an opposite bottom quilted panel 460. Top quilted panel 454 has an upwardly facing top portion 459, an opposite bottom portion (not shown), and a perimeter edge 456. Illustratively, top portion 459 of top quilted panel 454 is stitched to include a quilt pattern. Top quilted panel 454 is made from a material that is somewhat elastic so that the user can "sink into" mattress apparatus 452. Mattress apparatus 452 therefore conforms to the user's shape and relieves interface pressure.

Figure 25:
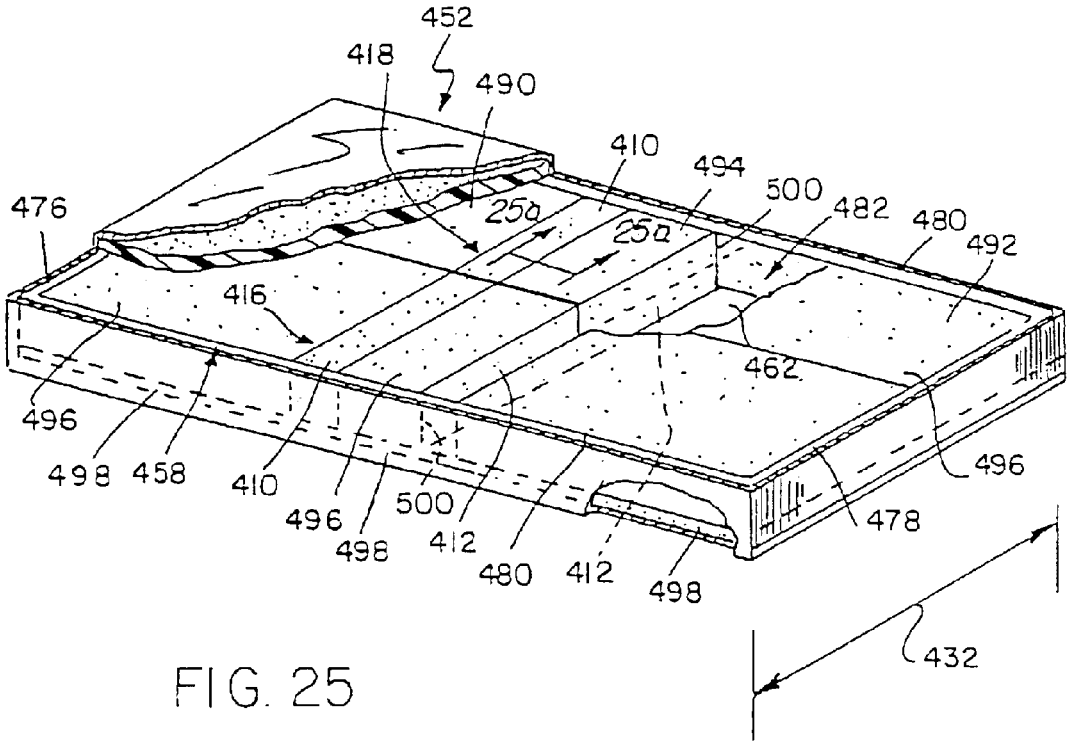
FIG. 25 is a perspective view with portions broken away of the mattress apparatus of FIG. 24 that is configured to accommodate two users, showing a first set of blocks and a second set of blocks positioned to lie in a side-by-side relationship.

Bottom quilted panel 460 of mattress apparatus 452 cooperates with top quilted panel 454 to define a mattress interior 472 as shown in FIGS. 24 and 25. Bottom quilted panel 460 includes an inwardly-facing top portion 462, an opposite external bottom portion 464, and an upwardly-extending side portion 466; Side portion 466 includes a bottom edge 468 adjacent bottom portion 464 and a top edge 470 formed for attachment to perimeter edge 456 of top quilted panel 454. As shown in FIG. 1(*a*), a top quilted panel 454 could, however, be provided having a downwardly-extending side portion 67 defining a mattress side. Top edge 470 and perimeter edge 456 are attached by a sewn construction, such as a seam. It is understood, however, that a zipper and other attachment mechanisms such as hooks, buttons, tabs, and the like could be used to couple top and bottom quilted panels 454, 460 together. Similar to top portion 459, bottom portion 464 of bottom quilted panel 460 is stitched to include a shell quilt pattern and is manufactured from a material that is somewhat elastic. See FIG. 24. While a shell quilt pattern is illustrated, it is understood that a wide variety of quilting patterns are contemplated in accordance with the present invention for top and bottom portions 459, 464. In addition, top and bottom portions 459, 464 of top and bottom quilted panels 454, 460 may be constructed from a wide variety of materials having a variety elasticities to provide apparatus 454 with different firmness feels.

Mattress apparatus 454 also includes a core 458, a frame 474 that surrounds core 458 and has a head end section 476, a foot end section 478, and longitudinally extending side sections 480 joining head end and foot end sections 476, 478, an upper topper foam 479, and a lower topper foam 481. While the term "head end section" and "foot end section" will be used hereafter, it is understood that either section may be used to support a user's head and feet. Frame 474 is constructed of foam that is firmer than core 458 to provide additional support to the user when entering or exiting mattress apparatus 454. It is understood, however, that a wide variety of materials having various firmnesses may be used to construct frame 474. As shown in FIG. 24, frame 474 is received in mattress interior 472. Head end and foot end sections 476, 478 are coupled to side sections 480 at joints 483. Head end section 476, foot end section 478, and side section 480 of frame 474 cooperate to define a central opening 482 above which the user will lie. Frame 474 is sandwiched between upper and lower topper foam 479, 481.

Referring to FIG. 24 vertical upper topper foam 479 has a pre-selected first foam firmness and lower topper foam 481 has a pre-selected second foam firmness. In accordance with the present invention, the upper topper firmness is different than the lower topper firmness. The difference between the upper and lower topper firmness may vary. It is understood, however, that as the difference between the upper and lower topper firmness increases, so does the difference in mattress feel to the user due to the difference in the controlled compression.

Core 458 is received in central opening 482 of frame 474 and is positioned to lie between upper and lower topper foam 479, 481. Topper foam 479, 481 provides vertical controlled compression and core 458 provides head-to-toe zoning in mattress apparatus 454.

Core 458 includes a head-end block 490, a foot-end block 492, a seat block 494 positioned to lie between head-end and foot-end blocks 490, 492, and zoned blocks 410, 412. As shown in FIG. 25, each block 490, 492, 494 includes a top side 496 facing top quilted panel 454, an opposite bottom side 498 facing bottom quilted panel 460, and opposite side edges 500 extending between top and bottom sides 496, 498.

Each block 490, 492, 494 of core 488 has an individual pre-selected block firmness. Illustratively, each block 490, 492, 494 of core 488 is constructed of foam rubber, although it is understood that blocks 490, 492, 494 may be constructed of a wide variety of compressible materials and may be formed as inflatable bladders or the like. The firmness and support characteristics of the foam rubber may be pre-selected by the retailer to provide users with a test mattress apparatus that helps them customize a particular mattress feel. The firmness of blocks 490, 492, 494 range approximately between an ILD of about 15 to about 98, although the firmness of blocks 490, 492, 494 may vary in accordance with the present invention. While each block 490, 492, 494 of core 488 has an individual pre-selected block firmness, it is understood that blocks 490, 492, 494 may have identical firmnesses if desired.

As shown in FIG. 24, zone blocks 410, 412 of core 488 are positioned to lie in general alignment with the user's lumbar region and the thigh region. Blocks 410, 412 are constructed of foam rubber, although it is understood that blocks 410, 412 may be constructed of a wide variety of compressible materials or may be formed as air bladders. The firmness and support characteristics of the foam rubber may be pre-selected by the retailer to provide users with a test mattress apparatus that helps them customize a particular mattress feel. The firmness of blocks 410, 412 range approximately between an ILD of about 15 to about 98. It is understood, that the firmness of blocks 410, 412 may vary in accordance with the present invention.

First block 410 is positioned to lie between and longitudinally abuts head-end block 490 and seat block 494. Thus, first block 410 is generally aligned with the user's lumber region (not shown) when the user's head is positioned adjacent head-end block 490 on top quilted panel 454. In addition, first block 410 has a pre-selected firmness. Preferably, the firmness of first block 410 is greater than the firmness of head-end and seat blocks 490, 494 to provide additional support for the user's lumbar. Second block 412 is positioned to lie between and longitudinally abuts foot-end block 492 and seat block 494. Thus, second block 412 is generally aligned with the user's upper thigh region (not shown) when the user's head (not shown) is positioned adjacent head-end block 490 on top quilted panel 454. Second block 412 has a pre-selected firmness. Preferably, the firmness of second block 412 is different than the firmness of first block 410 and is greater than the firmness of foot-end and seat blocks 492, 494 to provide additional support for the user's thighs. It is understood that the firmness of second block 412 can be greater than, less than, or equal to the firmness of first block 410 in accordance with the present invention.

Figure 25A:
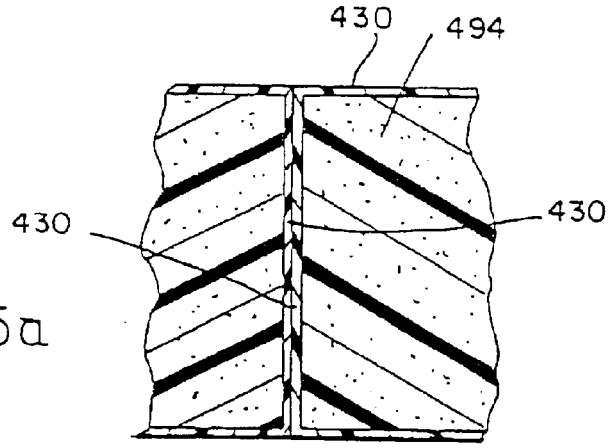
FIG. 25*a* is a cross-sectional view taken along line 25*a*—25*a* of FIG. 25 showing an anti-shear coating positioned upon the first zone block and the seat block.

As shown in FIG. 25*a*, block 410 and seat block 494 are provided with an anti-shear coating 430. Illustratively anti-shear coating 430 is applied to each block 490, 410, 412, 494, and 496 so that blocks 410, 412 can move in a vertical direction independently of adjacent blocks 490, 492, 494 enabling head-to-toe zoning. Anti-shear coating can be a coating formed on or applied to blocks 410, 412, 490, 494, 496, as shown in FIGS. 1(*a*) and 2. Anti-shear coating may also be a sleeve 98 having an interior 100 receiving block 410, 412. Sleeve 98 is made from a material having a low coefficient of friction such as such as a polypropylene anti-shear material or nylon. Moreover, slip cover 598 or sleeve 638 as will be described hereafter may be used as an anti-shear coating in accordance with the present invention.

If mattress apparatus 452 is sized to accommodate one user, each block 410, 412 extends the entire width of central opening 482 to engage opposing side sections 480. If, however, as shown in FIG. 25, mattress apparatus 452 is sized to accommodate two users, central opening 482 is a pre-determined width 432 and first and second blocks 410, 412 extend only one-half of width 432. In such an instance, central opening 482 can receive side-by-side left and right sets 416, 418 of first and second blocks 410, 412, providing the retailer with eight different testing mattress feels. Thus, each first block 410 of left and right sets 416, 418 engages head-end block 490 and seat block 494. Second block 412 of left and right sets 416, 418 engages foot-end block 492 and seat block 494. In addition, blocks 410, 412 of left set 416 about blocks 410, 412 of right set 418 longitudinally.

It is understood that mattress apparatus 452 can be used to provide the user with multiple firmness configurations on a foundation, such as box springs, a stationary deck of a bed, an articulating deck of a bed, or the like. Mattress apparatus 452 may also rest upon a floor, a table, or any generally planer, upwardly facing surface without exceeding the scope of the invention as presently claimed.

Mattress apparatus 452 of the present invention is capable of providing each user with at least four different firmness configurations, depending upon the orientation of the mattress apparatus 452 relative to the user. Each of these four firmness configurations will have a unique vertical and head-to-toe controlled compression feel. For example, the user may experience two firmness configurations when resting upon top quilted panel 454. Once upon top quilted panel 454, the user's head may be positioned above either head-end block 490 or foot-end block 492, each having a pre-selected firmness. When the user's head is positioned over head-end block 490, the user's lumbar region will be aligned with first block 410 having the first block firmness. When the user's head is positioned over foot-end block 492, the user's lumbar region will be aligned with second block 412 having the second block firmness.

In order for the user to experience two additional firmness configurations, mattress apparatus 452 must simply be tuned over so that the user will lie upon bottom quilted panel 460. Since lower topper foam 481 adjacent panel 460 has a different firmness than upper topper foam 479 adjacent panel 454, the user will experience a different overall vertical controlled compression feel. The head-to-toe zoning will also vary depending upon whether the user's head is positioned over head-end block 490, or over foot-end block 492 as previously described. While mattress apparatus 452 has been described with reference to a retail test apparatus, it is understood that mattress apparatus 452 may be purchased by the user for personal use in the home or other care facility. In addition, mattress 452 is configured to provide the user with a favorite combination of firmness, depending upon the user's head position, and the orientation of mattress 452 relative to the user.

In another embodiment of the present invention, shown in FIG. 26, a mattress 552 is provided that permits a user upgrade from two-dimensional zoning to three-dimensional zoning at a low cost. Mattress 552 achieves the three-dimensional zoning at a low cost by providing a one-piece bladder 590 and a plurality of zone blocks 592 mounted upon bladder 590. The combination of one-piece bladder 590 and zone blocks 592 above bladder 590 can provide the "feel" of a costlier system including a multi-chambered air mattress. Mattress 552 is upgradable, meaning that the user may upgrade to bladder 590 from a less costly foam, conventional springs, water tubes, or the like. Zone blocks 592 will cooperate with the foam to provide vertical controlled compression as well as head-to-to controlled compression.

Upgraded mattress 552 is shown in FIG. 26 has three-dimensional zoning and includes an upper quilted panel 554 having a perimeter edge 556 and a lower quilted panel 560. Upper and lower quilted panels 554, 560 cooperate to define a mattress interior 572 which houses bladder 590. Lower quilted panel 560 includes an upwardly-facing panel portion 562 constructed of a foam/fiber blend and an upwardly-extending side portion 566. Side portion 566 includes a top edge 568 that is coupled to perimeter edge 556 with a zipper. It is understood that upper and lower quilted panels 554, 560 can be coupled together by hooks, snaps, and the like in accordance with the present invention. It is also understood, that a seam may be used to couple panels 554, 556 together without exceeding the scope of the present invention.

Figure 27:
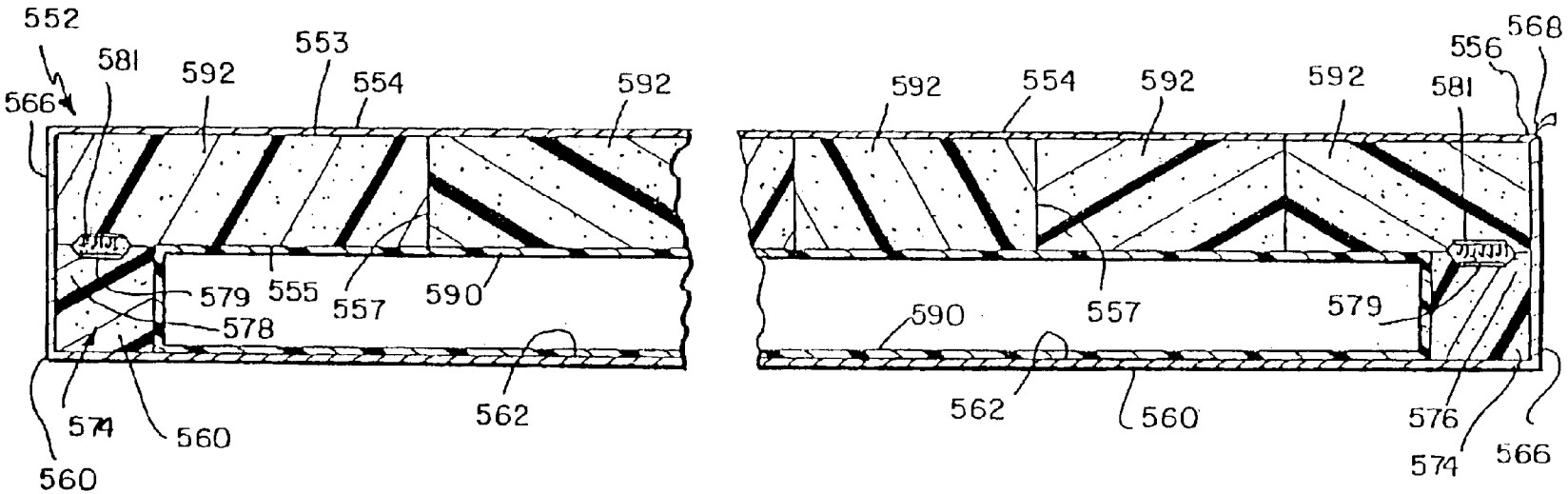
FIG. 27 is a cross-sectional view of the mattress of FIG. 26 showing the mattress including a lower quilted panel and an upper quilted panel and showing the one-piece bladder resting upon the lower quilted panel and the zone blocks positioned to lie between the one-piece bladder and the upper quilted panel.

Mattress 552 includes a frame 574 that is received in mattress interior 572. Frame includes a head-end foam section 576, a foot-end foam section 578, and longitudinally extending side foam sections 580 joining head-end and foot-end sections 576, 578 to define a central opening 582. Hook and loop type fasteners 579 are mounted on sections 576, 578, 580 of frame 574 as will be discussed below. It is understood that fasteners may be hooks, snaps, and the like in accordance with the present invention. Referring to FIG. 27, frame 574 rests upon panel portion 562 of lower quilted panel 560 and blocks 592 are positioned to lie between bladder 590 and upper quilted panel 554. Upper quilted panel 554 is constructed of material similar to lower quilted panel 560 and is configured to minimize the ability of the user to perceive the interface between blocks 592 and frame 574.

Bladder 590 is positioned to lie within central opening 582 of frame 574 and rests upon panel portion 562. Bladder 590 is a one-piece air bladder, although it is understood that bladder 590 may be a water bladder, or a bladder that is suitable for containing other fluids. Bladder is filled with air to a capacity that permits bladder 590 to compress depending upon the weight of the load. It is understood that the amount of allowable compression will vary depending upon the volume of air within air bladder 590.

As shown in FIG. 26, blocks 592 cooperate with the air bladder 590 to provide three-dimensional zoning. Zone blocks cooperate to provide vertical controlled compression and head-to-toe zoned controlled compression, and bladder 590 acts to provide side-to-side zoning based upon the volume of air within bladder 590. Each block 592 extends the full width of central opening 582 to rest upon opposing side sections 580. In addition, a first one of blocks 592 engages head-end section 576, a last one of blocks 592 engages foot-end section 578, and blocks 592 therebetween engage one another. Blocks are generally rectangular in shape and include an upper side 553 engaging panel 554, and opposite lower side 555, and opposite sides 557 that longitudinally abut one another. Upper side 553 of blocks 592 may be affixed to upper quilted panel 554 to prevent migration on bladder 590. In addition, lower side 555 of blocks 592 include hook and loop fasteners 581 that cooperate with fasteners 579 on frame 574 to hold blocks 592 in position within mattress interior 572. While two blocks 592 as shown with fasteners 581 it is understood that greater or fewer than two blocks may include fasteners in accordance with the present invention. In addition, it is understood that a variety of releasable fasteners such as snaps, zippers, etc. may be used in accordance with the present invention.

Each block 592 can be provided with an anti-shear coating 430 as shown in FIG. 25*a* so that each block 592 can compress in a vertical direction independently of adjacent blocks 592 and provide head-to-toe controlled compression. Anti-shear coating 430 is constructed as previously discussed in the specification. Alternatively, as shown in FIG. 28, a slip cover 598 may be provided to serve as an anti-shear coating in accordance with the present invention. Slip cover 598 includes a top member 630 and a bottom member 632 coupled to top member 630 in order to form a plurality of pockets 634 therebetween. Pockets 634 are spaced apart by seams 636. Referring now to FIG. 29, pockets 634 receive blocks 592. In addition, pockets 634 permit individual compression of blocks 592 as shown by arrows 595 relative to one another. Moreover, pockets 634 beneficially inhibit migration of blocks 592 within mattress 552. When slip cover 598 is used, hook and loop fasteners can be sewn to slip cover 598 or slipcover 598 may permitted to simply rest upon frame. Slip cover 598 like coating 430 allows independent action of blocks 592 and thus head-to-toe controlled compression.

Frame 574 and blocks 592 may be made from a foam rubber such as urethane foam. Frame 574 is firmer than blocks 592 to provide additional support to the user when entering or exiting mattress. The firmness and support characteristics of the foam rubber can be customized in accordance with the desires of the user of mattress 552. The firmness and support characteristics of the foam rubber is customized by techniques previously described in the specification. Although urethane foam is the preferred material for these components, any material providing support and firmness characteristics similar to those provided by foam rubber, for example polyester fiber and latex foam, can be used without exceeding the scope of the invention as presently perceived.

If mattress 552 is for use in a queen-sized or king-sized bed, central opening 582 is a second width and each block 592 extends only one-half of the second width. In such instance, central opening 582 can receive side-by-side left and right sets (not shown) of blocks 592.

Figure 30:
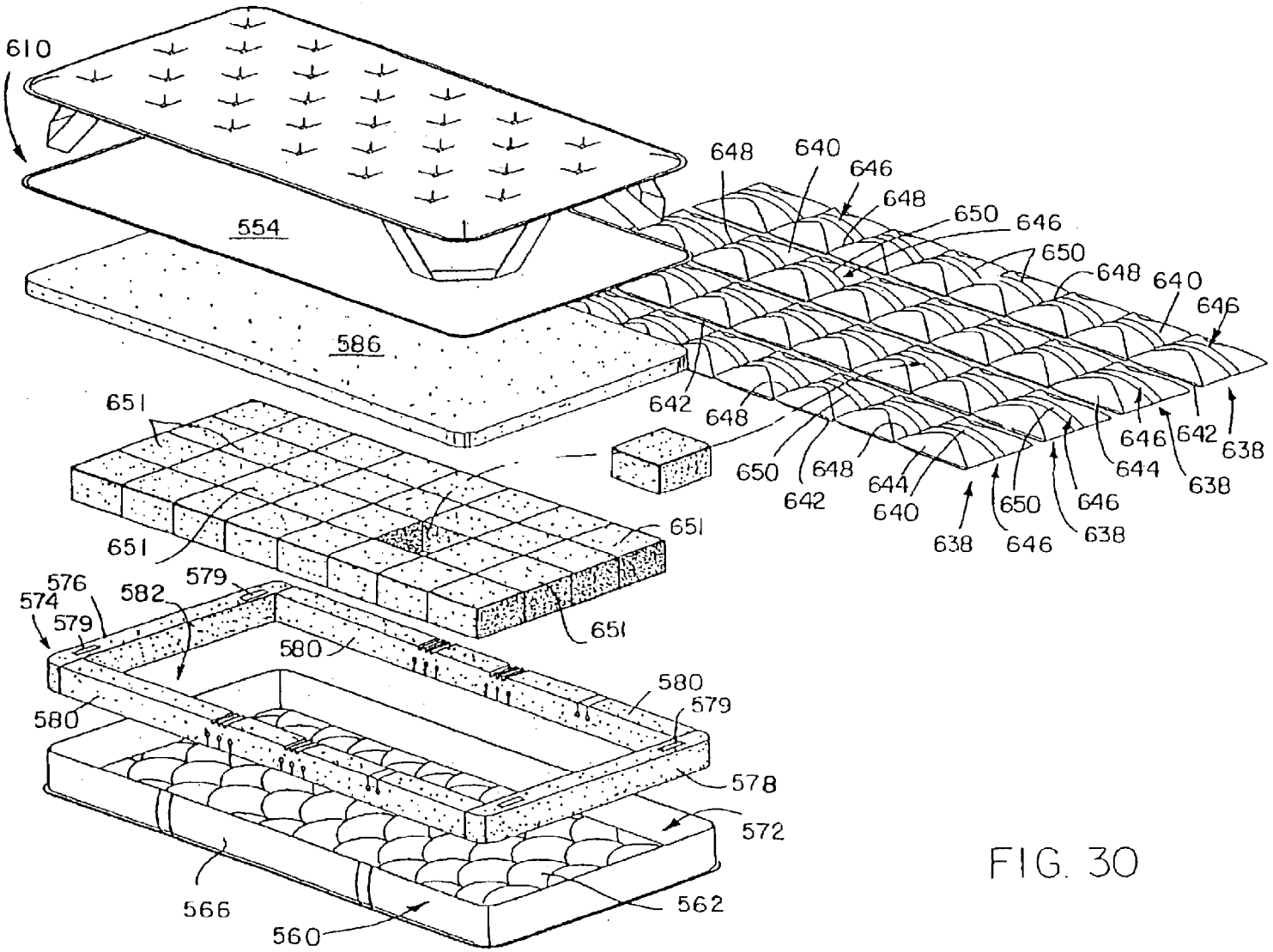
FIG. 30 is an exploded perspective view of an alternative embodiment of the present invention showing a shell, a frame, a topper, sleeve each including a top cover, a bottom cover, a plurality of pockets therebetween defined by seams, and a slot formed in the top cover and zoned blocks sized for insertion through the slots into the pockets of the sleeves.

An alternative embodiment of mattress apparatus 610 is illustrated in FIG. 30. Apparatus 610 has three-dimensional zoning and includes upper quilted panel 554 and lower quilted panel 560 as previously discussed. Frame 574 cooperate to surround blocks 651. Sleeves 638 are provided to act as an anti-shear-coating for blocks 651. Each sleeve 638 includes an upper panel 640, a lower panel 642, and side panels 644 coupling upper and lower panels 640, 642 together. In addition, sleeve 638 includes a plurality of spaced-apart pockets 646 therein that are defined by seams 648. Each upper panel 640 includes slots 650 therethrough. Slots 650 define an opening into pockets 646 and are sized to receive zoned blocks 651 therethrough. Blocks 651 are similar to blocks 592 except are formed to have a reduced dimension. Similar to slip cover 598, sleeve 638 permits individual compression of blocks 651 and thus a third-dimension of zoning.

Sleeve 638 enables three-dimensional zoning by enabling vertical zoning ("controlled compression"); head-to-toe zoning; and side-to side zoning. Blocks 651 within sleeve 638 provide vertical zoning ("controlled compression") and positioning of blocks 651 extending between head end 576 and foot end 578 of frame 574 provides the second dimension of support. As shown in FIG. 30 the positioning of sleeves 638 give support variation in a third side-to-side direction. Placing blocks 651 in sleeves 638 secures blocks 651 in position and provides a neat appearance, durability, and ease of assembly. In addition, sleeves 638 are of a uniform size and shape and are used in a twin, double, queen, or king sized mattress. The uniform dimensions of sleeves 638 enable a manufacturer to reduce inventory. It is understood, that blocks 651 are also uniform in size and shape so as to extend through pockets 646. It is also understood that side panels 644 of sleeves 638 may be coupled together to form a matrix to prevent individual sleeves 638 from turning and to hold sleeves 638 in position relative to one another. Mattress apparatus 610 also rests on a foundation 596 such as box springs, a stationary deck of a bed, an articulating deck of a bed, or the like. Mattress apparatus 610 can also rest on a floor or any other generally planar, upwardly facing surface without exceeding the scope of the invention as presently perceived.

Figure 31:
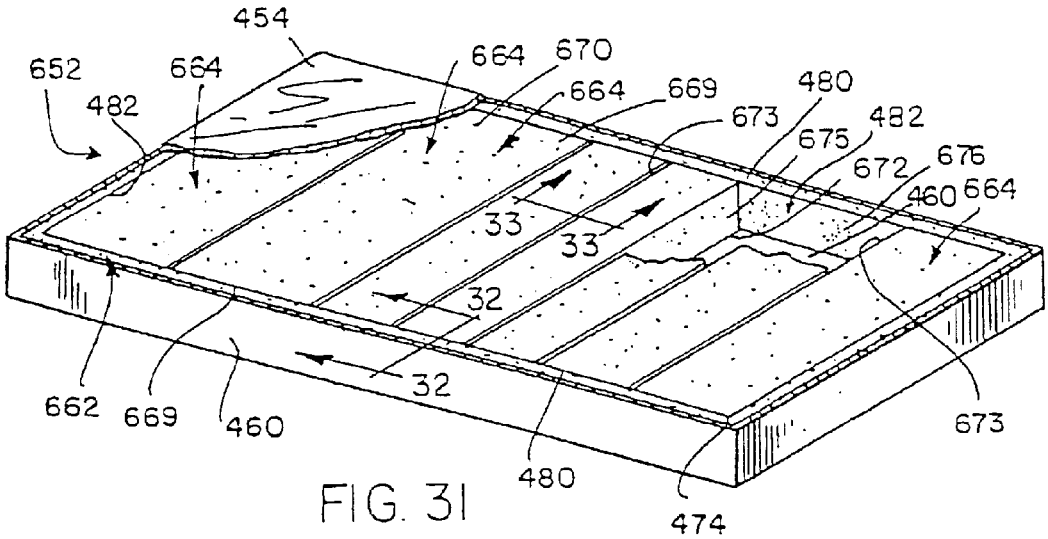
FIG. 31 is a perspective view with portions broken away of an alternative embodiment of the present invention showing a frame that defines an interior region and includes a head-end, a foot-end, and opposite sides extending between the head-end and the foot-end, a plurality of zoned blocks positioned to lie within the interior region, each of the blocks including opposite ends coupled to the opposite sides of the frame by an adhesive.

In another embodiment of the present invention, an economy mattress 652 that enables two-dimensional zoning is provided. As shown in FIG. 31, mattress 652 enables a user to create a customized firmness configuration with vertical controlled compression and head-to-toe controlled compression. To the extent that mattress 652 resembles mattress apparatus 452 illustrated in FIG. 24, like reference numerals will be used to denote like components. Core 662 of mattress 652 includes a set of transversely extending blocks 664 made from materials similar to blocks 592 as previously discussed.

Figure 32:
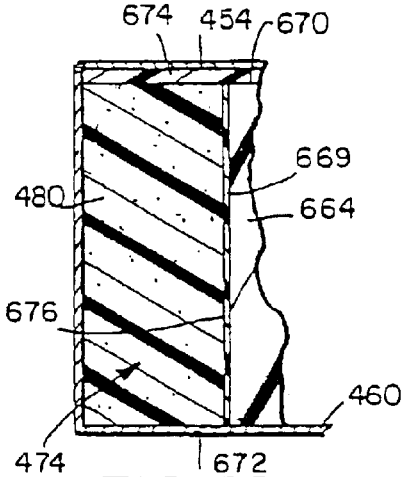
FIG. 32 is a cross-sectional view taken along lines 32—32 of FIG. 31 showing one zone block including an end coupled to the frame by an adhesive.

Referring to FIG. 31, core 662 is received in central opening 482 of frame 474 and is positioned to lie between lower quilted panel 460 and upper quilted panel 454. Blocks 664 of core 662 longitudinally abut one another in central opening 482. Blocks 664 include opposite ends 669, a top side 670, an opposite bottom side 672, and side edges 673, 675 extending therebetween when mattress 652 is for use in a single bed, each block 664 extends the full width of central opening 482 and opposite ends 669 are coupled to opposing side sections 480 of frame 474. As shown, for example in FIG. 32, top side 670 of block 664 is coupled to topper 674. The ability of blocks 664 to migrate throughout central opening 482 is minimized by coupling topper 674 to both frame 474 and to core 662. In preferred embodiments, blocks 664 are coupled to side sections 480 and topper 674 by an adhesive 676. It is understood that a wide variety of commercially available adhesives 676 can be used in accordance with the present invention so long as the adhesive chosen is compatible with the materials being adhered. Moreover, blocks 664 may be coupled to side sections 480 and topper 674 by releasable connectors such as hook-and-loop type connectors, buttons, snaps, and the like. It is understood that zone blocks 664 may be coupled to only topper 674 or only to side sections 480 without exceeding the scope of the present invention.

Figure 33:
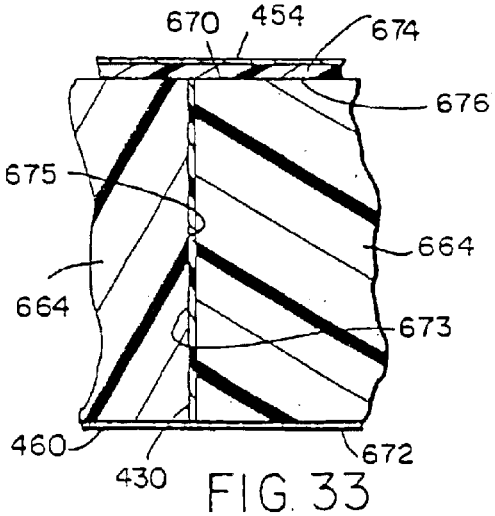
FIG. 33 is a cross-sectional view taken along lines 33—33 of FIG. 31 showing a sleeve positioned to lie between adjacent zone blocks of the mattress.

Referring now to FIG. 33, anti-shear coating 430 having a low coefficient of friction may be positioned to lie between each block 664 to encourage movement therebetween. The relative movement enables head-to-toe zoning. For example, since blocks 664 move relative to one another and will have various firmness levels, a user resting upon top quilted panel 454 will experience various firmness levels from head-to-toe. It is understood that slip cover 598 or sleeve 638 may also be used in accordance with the present invention. When, however, greater than one sleeve 638 is used, three-dimensional zoning as previously discussed with reference to FIG. 30 will result.

Figure 34:
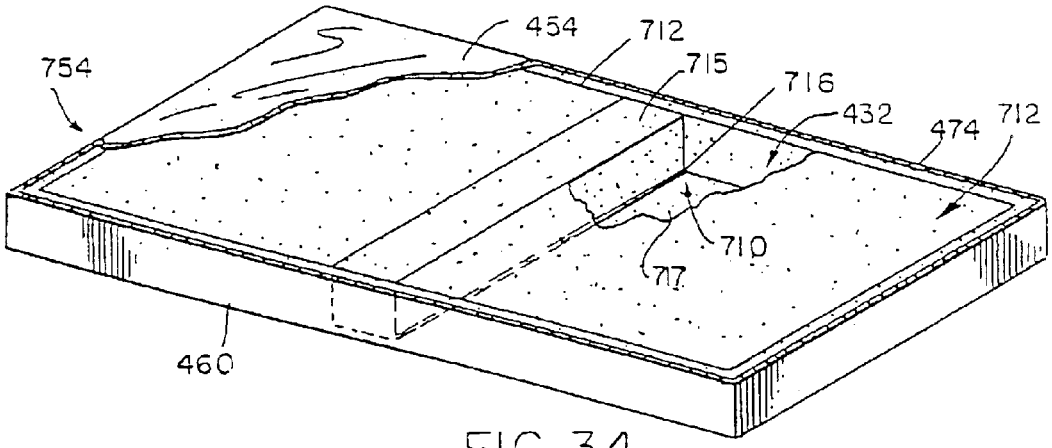
FIG. 34 is a perspective view with portions broken away of an alternative embodiment of the present invention showing a frame defining an interior region and a modular block component portioned within the interior region, and the block component includes a zone block and a bladder positioned adjacent the zone block to selectively increase or decrease the firmness of the zone block.

In an additional embodiment of the present invention, a movable support component 710 is provided as shown in FIG. 34. While support component 710 is shown with mattress 754, component 710 is suitable for use with a variety of mattress apparatuses 452, 552, 652, etc. Support component 710 includes an individual inflatable air bladder 716 that may be positioned in a variety of locations within or upon mattress 710. By moving component 710, air bladder 716 provides the user with selective localized controlled compression.

Bladder 716 is shown in FIG. 34 being positioned between block 715 and foam bottom 717 of frame 474. Bladder 716 may also be positioned to lie between block 715 and upper quilted panel 454, or between quilted panel 454 and the user. Support component 710 can be aligned with the lumbar region of a user or with any other region such as under the user's thigh, feet, head or any other region if desired. In addition, bladder 716 is preferably an air bladder and may be inflated and deflated by the user to adjust the firmness of support component 710. Bladder 716 is manipulated by a control system such as that previously described in the specification with reference to hand controller 256. Although a wide variety of commercially available controllers may be used in accordance with the present invention. Thus, the user of mattress 754 is permitted to alter selectively the firmness of a particular section of mattress 754.

Figure 35:
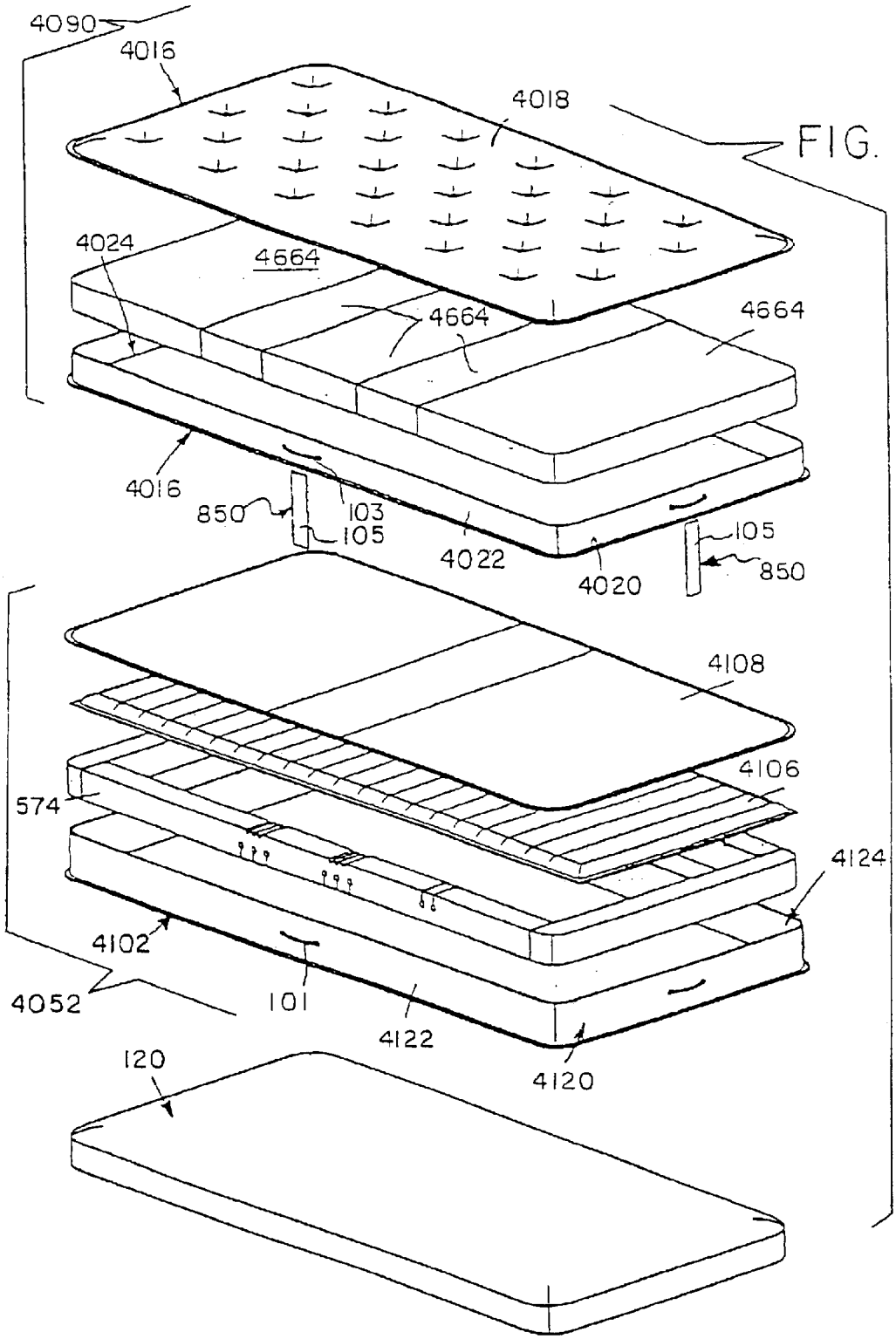
FIG. 35 is an exploded perspective view of an alternative embodiment of the present invention showing a super pillow top having a fabric shell with handles and a plurality of zoned blocks positioned to lie within the shell, an attachment mechanism, and a foundation.

FIG. 35 illustrates still another embodiment of the present invention wherein a super pillow top 4090 and an attachment mechanism 850 are provided. Attachment mechanism 850 cooperates with an anti-slip material 1036, as will be discussed hereafter, to secure super top 4190 on a mattress 4052. Super top 4090 in accordance with the present invention provides the user with two-dimensional zoning upon a wide variety of surfaces. For example, super top 4090 will provide zoning to a variety of commercially available spring-coil mattresses, single chamber air mattresses, water beds, and the like. Super top 4090 includes a shell 4016 and a set of transversely extending blocks 4664, made from materials similar to blocks 592 as previously discussed, positioned to lie within shell 4016. While blocks 4664 are illustrated and described, it is understood that a foam block with a pre-determined generally single firmness or a convoluted block having a variety of firmnesses may be used in accordance with the present invention. In any event, super top 4090 is thicker than pillow tops 724, 1010, 1210 as will be discussed hereafter.

Figure 35A:
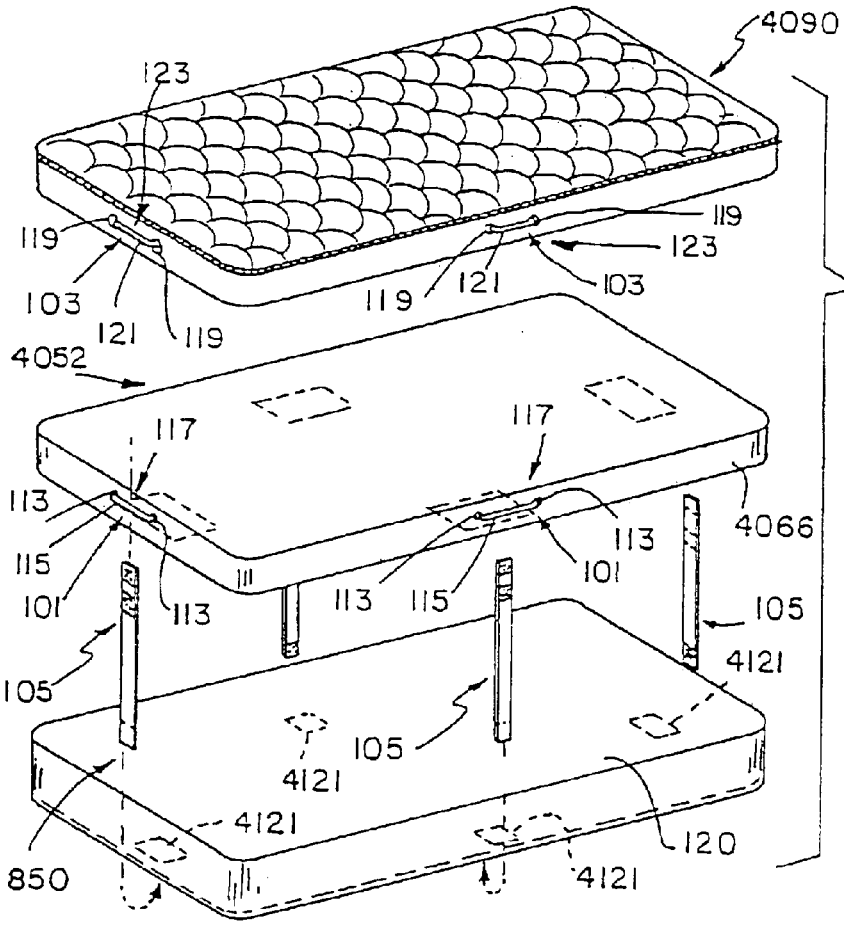
FIG. 35*a* is an exploded perspective view of the super top, mattress, foundation, and attachment mechanism of FIG. 35 showing the attachment mechanism including a strap with hook and loop type fasteners and the mattress having a handle.

Shell 4016 includes a top quilted panel 4018 and a bottom quilted panel 4020 coupled to top panel 4018 by a seam. It is understood, however, that a zipper and other attachment mechanisms such as hooks, buttons, tabs, and the like could be used to couple top and bottom quilted panels 4018, 4012 together. In fact, when a seam is not used to couple top and bottom panels 4018, 4012 together, blocks 4664 are held in an adjacent relationship relative to one another by a sleeve 4050 (FIG. 35*c*). Bottom panel 4020 includes side walls 4022 extending upwardly toward top panel 4018 to define an interior region 4024 in which to receive blocks 4664. In addition, super top 4090 may be formed with a "summer top" and a "winter top" as will be discussed hereafter with reference to pillow top assembly 1010. If super top 4090 is for use in a queen-sized bed (not shown) or a king-sized bed (not shown), each block 4664 extends only one-half of the interior region 4024. In such instance, super top 4090 can alternatively include side-by-side combinations including a set of zone foam blocks 4664, sculptured foam core (not shown), and air bladder (not shown). Handles 103 are coupled to side walls 4022 of super top 4090. As shown in FIG. 35*a*, each handle 103 includes opposite ends 119 and a handle portion 121. Handle portion 121 cooperates with super top 4190 to define a griping aperture 123.

Super top 4090 in accordance with the present invention is configured to lie on a mattress 4052 having an outer shell 4102, frame 574, and a one-piece air bladder 4106. Shell 4102 includes a top panel 4108 and a bottom panel 4120. Bottom panel 4120 includes side walls 4122 extending upwardly toward top panel 4108 to define an interior region 4124 in which to receive frame 574 and bladder 4106. Handles 101 are coupled to side walls 4122. As shown in FIG. 35*a*, each handle 101 includes spaced-apart ends 113 and a handle portion 115 therebetween. Handle portion 115 cooperates with side portion 4066 of mattress 4052 to define a gripping aperture 117. Handles 10 are positioned to lie vertically adjacent handles 103 once super top 4190 is positioned upon mattress 4052. While mattress 4052 is illustrated and described, it is understood that interior region 4124 of mattress may include foam, conventional springs, water tubes, or the like in accordance with the present invention.

Figure 35B:
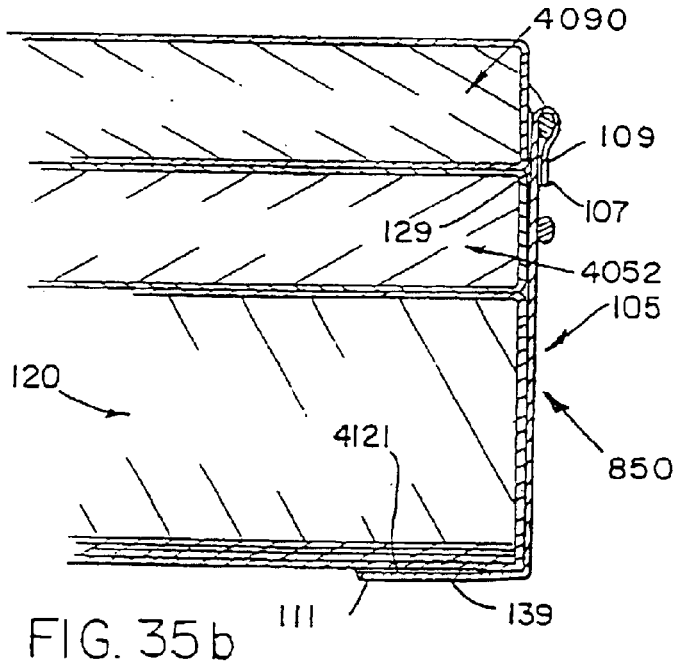
FIG. 35*b* is a cross-sectional view of the mattress, pillow top and attachment mechanism of FIG. 35*a* showing the strap extending through the handles of the pillow top and mattress and coupled to hook and loop type fasteners on the foundation.
Figure 35C:
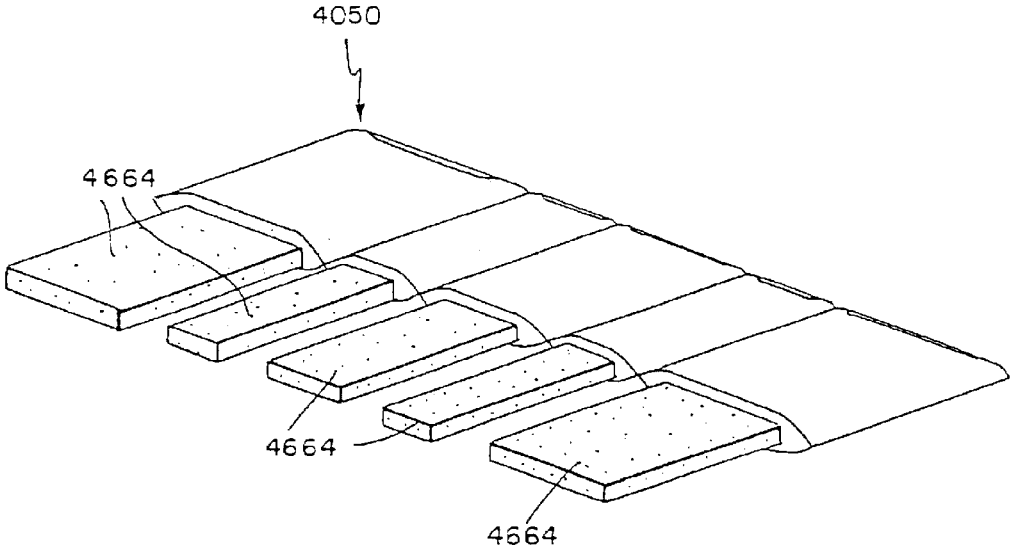
FIG. 35*c* is a perspective view of a sleeve receiving the blocks of FIG. 35 for use in a super top in accordance with an alternative embodiment of the present invention.

Mattress 4052 is configured to lie upon mattress foundation 120, as shown in FIG. 35*b*. Foundation 120 has hook and loop type fasteners 4121 coupled thereto. Foundation 120 may be any number of a wide variety of platforms, such as box springs, a stationary deck of a bed, an articulating deck of a bed, or the like. Mattress 4052 can also rest on a floor or any other generally planar, upwardly facing surface without exceeding the scope of the invention as presently perceived.

Figure 36:
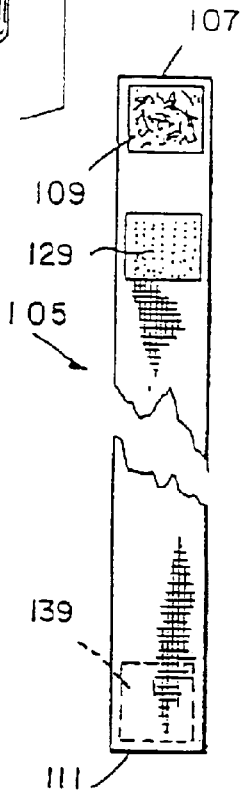
FIG. 36 is an enlarged view of one strap of FIG. 35*b* showing the strap including opposite ends with hook and loop type fasteners.

Attachment mechanism 850 includes at least one strap 105 that is sized for extension through gripping apertures 117, 123 of respective handles 101, 103. Referring now to FIG. 36, strap 105 includes a first end 107 with hook and loop type fasteners 109, 129 and a second end 111 having hook and loop type fasteners 139. Although hook and loop type fasteners 109, 129, 139 are illustrated and described, it is understood that various releasable or permanent fastening mechanisms such as snaps, buttons, adhesives, zippers, rivets and the like are not outside the scope of the present invention.

To couple super top 4190 to mattress 4052, second end 111 of strap 105 is extended through gripping apertures 117, 123 of handles 101, 103 as shown in FIG. 35*b* and fasteners 139 are coupled to hook and loop type fasteners 4121 on foundation 120. First end 107 of strap 105 is then folded over handle 103 so that hook and loop type fasteners 109, 129 engage one another. Although only two handles 101, 103 are illustrated on super top 4190 and mattress 4052, it is understood that any number of handles, such as four handles or greater than or fewer than four handles, could be provided as desired on each. In addition, while mattress 4052 is illustrated, it is understood that attachment mechanism 850 is suitable for use with a wide variety of mattresses.

Figure 37:
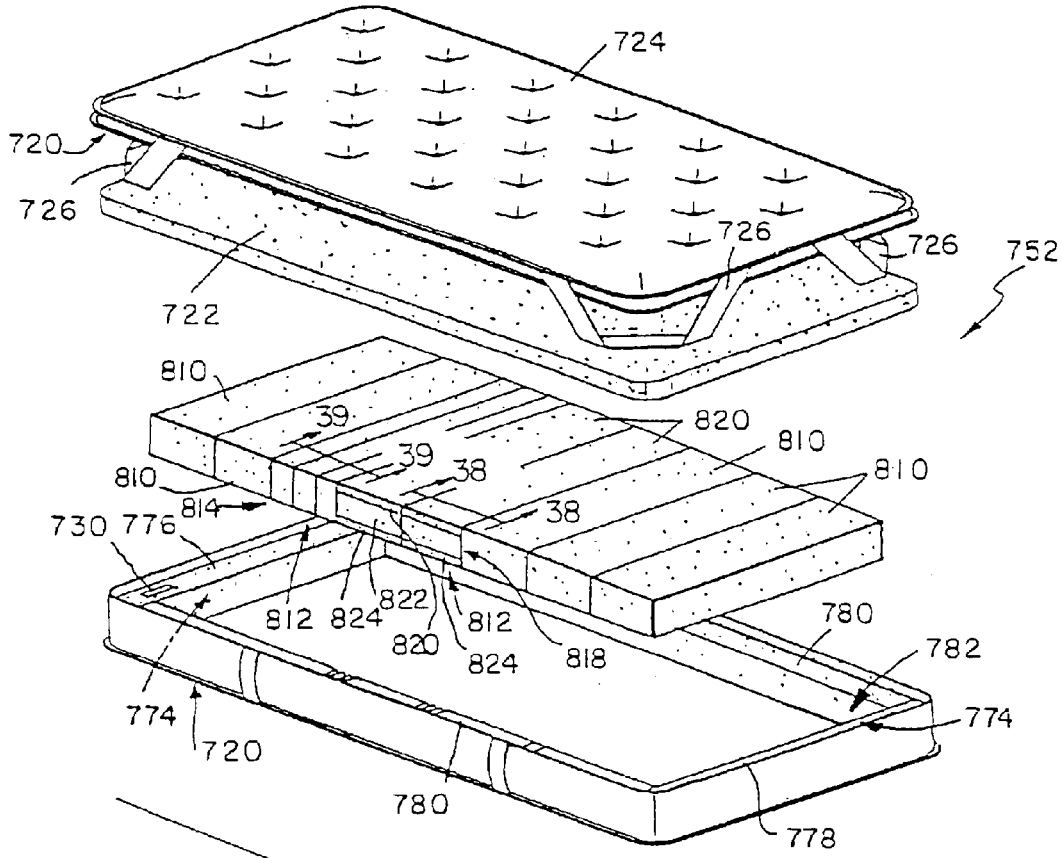
FIG. 37 is an exploded perspective view of a bed in accordance with yet another embodiment of the present invention showing the bed including a frame, a plurality of zone foam blocks, a seat block, a lumbar block, a topper, and a pillow topper.

In accordance with yet another embodiment of the present invention, a mattress 752 is provided and illustrated in FIG. 37. Mattress 752 includes a fabric shell 720, a frame 774 positioned to lie within shell 720, zoned blocks 810 providing two-dimensional zoning, seat section blocks 812, a lumbar section block 814, a topper 722, and a pillow top 724 including flexible straps 726 extending about fabric shell 720 to couple pillow top 724 to shell 720. Frame 774 includes a head-end foam section 776, a foot-end foam section 778, and longitudinally extending side foam sections 780 joining head-end and foot-end sections 776, 778 to define a central opening 782. Releasable connectors 730 such as hook-and-loop type connectors are coupled to sections 776, 778 and topper 772 to hold topper upon frame 774. It is understood that releasable connectors such as buttons, snaps, and the like may be used without exceeding the scope of the present invention.

As shown in FIG. 37, zone blocks 810, seat section blocks 812, and lumbar section block 814 are sized for positioning within central opening 782 of frame 774. Blocks 810, 812, and 814, are constructed of foam rubber, although it is understood that blocks 810, 812, and 814 may be constructed of a wide variety of compressible materials or may be formed as air bladders. The firmness and support characteristics of the foam rubber may be pre-selected by the retailer or customer. It is also understood that mattress 752 may include any number of blocks 810 in any number of sections, mattress 752 may include only blocks of the type in seat section 812 shown in FIGS. 37 and 38, mattress 752 may include only blocks if the type in lumbar section 814 shown in FIGS. 37 and 39, or mattress 752 may include both blocks of the types in seat and lumbar sections 812, 814 in accordance with the present invention.

Figure 38:
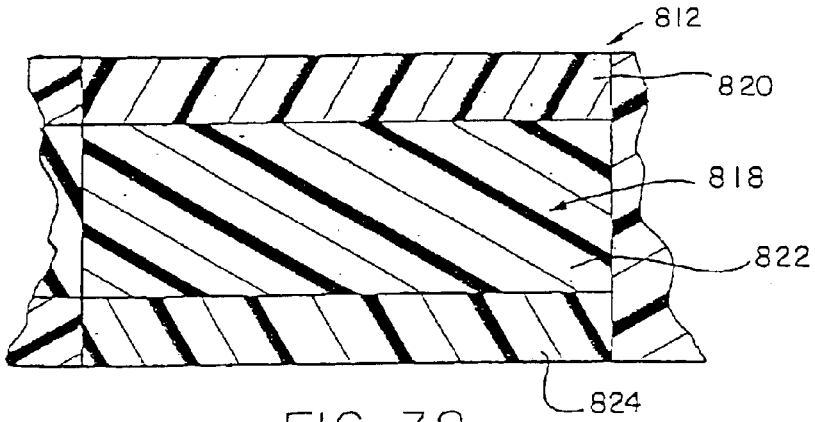
FIG. 38 is a cross-section taken along lines 38—38 of FIG. 37 showing the seat block including a thin upper layer, a thick inner core, and a thin lower layer of different firmness.
Figure 38A:
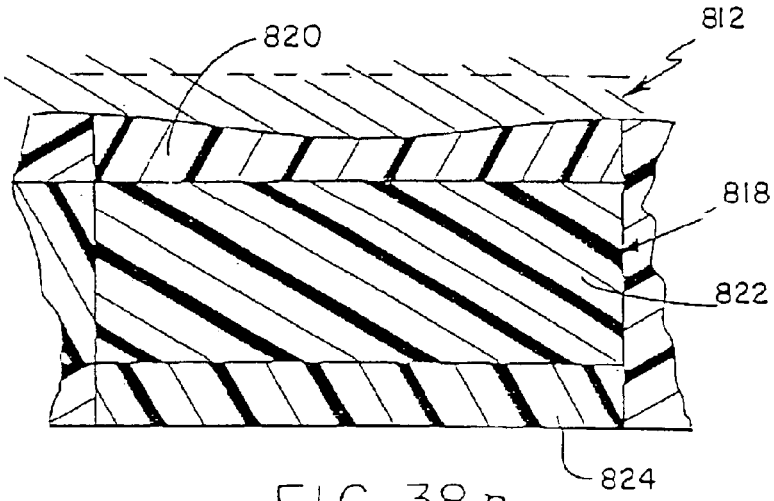
FIG. 38*a* is a view similar to FIG. 38 showing the seat block when the user is lying down on block to distribute the load across block.
Figure 38B:
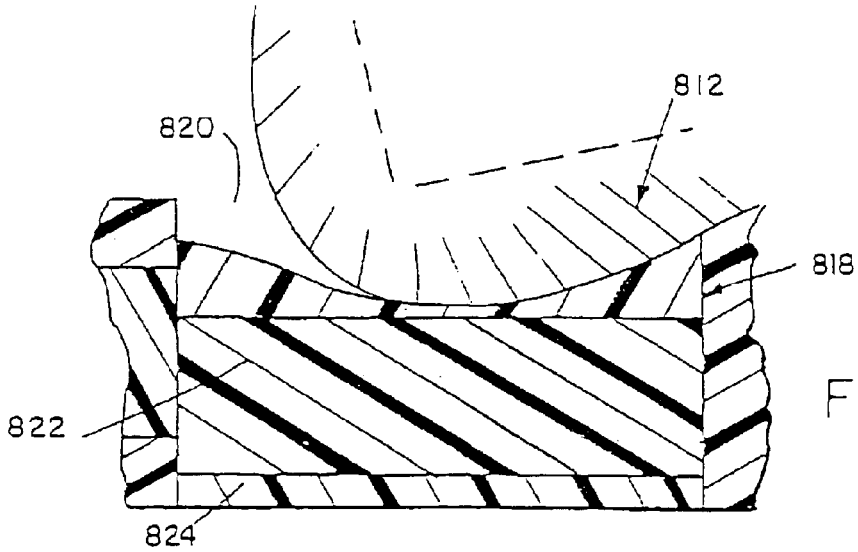
FIG. 38*b* is a view similar to FIG. 38 showing the seat block when the user weight is directed toward the core of seat block.

Referring now to FIG. 38, each seat section block 812 is a composite block 818, which provides the user with targeted controlled compression. Composite block 818 includes a softer upper section 820, a firm core section 822 and a soft lower section 824. Composite block 818 is illustratively about four inches (10.2 cm) thick with about a two inch (5.1 cm) thick core 822. Upper and lower sections 820, 824 are about one inch (2.5 cm) thick and cover core section 822. It is understood that the dimensions of composite block 818 may vary without exceeding the scope of the present invention. As shown in FIG. 38*a*, when the user is lying down on block 812, the load is distributed generally uniformly across soft layer 820 causing soft layer 820 to compress slightly to absorb the load. As shown in FIG. 38*b*, when the user raises to a sitting position, significant compression occurs in layers 820, 824 while center core remains relatively in position to provide support. Thus, when in a sitting position, the user's weight is directed down against core 822 rather than being distributed across the entire surface of composite block 818. So, composite block 818 provides a softer feel (see FIG. 38(*a*) when the user's weight is distributed across the whole surface of composite block 818 (and compressed only into upper section 820) plus necessary firmness when (FIG. 38(*b*) most of the user's weight is directed toward core 822.

Upper and lower sections 820, 824 may be coupled to the core 822 by releasable or permanent fastening mechanisms such as adhesives, hook and loop type fasteners, straps, sleeves, and the like. Although the, thickness and number of layers of composite block 818 are illustrated and described, it is understood that a variety of thickness and layers may be used so long as a firm core is surrounded by softer upper and lower sections.

Figure 39:
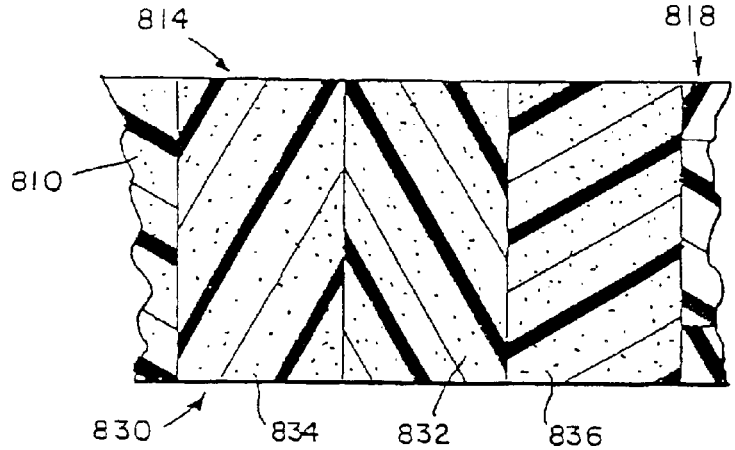
FIG. 39 is a cross-section taken along lines 39—39 of FIG. 37 showing the lumber block including a thick center core and spaced-apart thin side layers of different firmness sandwiching the center core therebetween.

In accordance with still another embodiment of the present invention, lumbar block 814 is provided for use with mattress 752 to provide greater resolution in head-to-toe zoning. As shown in FIG. 39, lumbar block 814 includes a composite block 830 having three sections 832, 834, 836 positioned to lie in a side-by-side relationship. Sections 832, 834, 836 have predetermined firmness levels to provide a desired firmness to a user's pre-determined "sweet spot". Illustratively, composite block 830 includes a firm center section 832 and softer side sections 834, 836 positioned to lie on either side of the center section 832. Thus, lumbar block 8.14 provides firmness to a user's predetermined "sweet spot", while providing softer support on either side of that pre-determined sweet spot. It is understood, that center section 832 is not necessarily firmer than side sections 834, 836 as the firmness of sections 832, 834, 836 may vary without exceeding the scope of the present invention.

As shown in FIG. 39, side sections 834, 836 of lumbar block 814 are positioned to lie adjacent different blocks 810 in a series of blocks 810 to provide the targeted head-to-toe zoning. Composite block 830 illustratively extends nine inches (22.9 cm) between blocks 810 and is four inches (10.2 cm) deep. Center section 832 is three inches (7.6 cm) wide and each of the two side sections is three inches (7.6 cm) wide to form the nine inch (22.9 cm) width of composite block 814. Side sections 834, 836 may be coupled to the center section 832 by releasable or permanent fastening mechanisms such as adhesives, hook and loop type fasteners, sleeves, straps, and the like.

Figure 40:
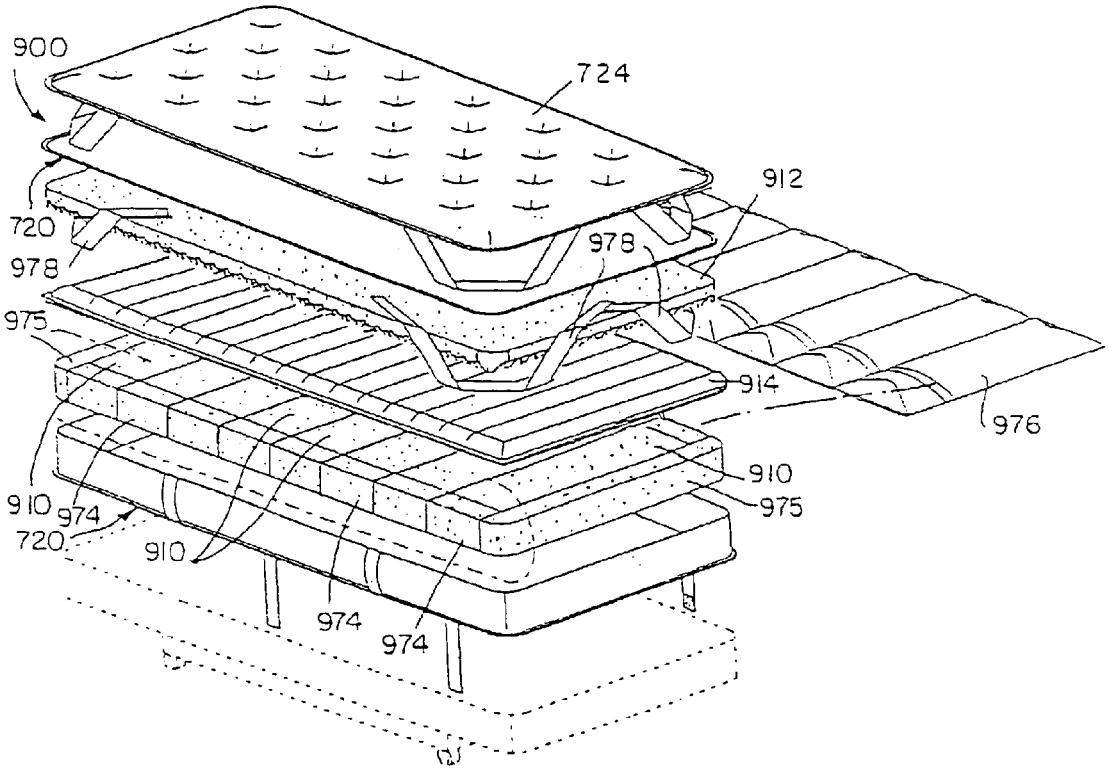
FIG. 40 is an exploded perspective view of a mattress structure in accordance with still another embodiment of the present invention showing the mattress structure including shell, a plurality of zone blocks, a topper, and a thin air chamber positioned to lie between the zone blocks and the topper.
Figure 41:
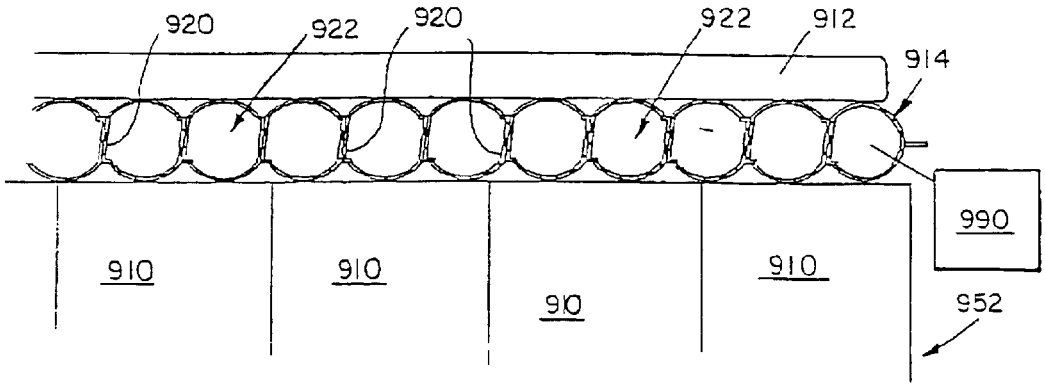
FIG. 41 is a cross-section of the mattress structure of FIG. 40 showing the air chamber including a plurality of inner supports defining tube-like cavities therein.

Mattress structure 900 in accordance with another embodiment of the present invention is shown in FIGS. 40 and 41 and provides the user with three-dimensions of zoning. Mattress structure 900 includes a fabric shell 720, zoned blocks 910, foam side rails 974, foam end rails 975, a slip cover 976, a topper 912, an air chamber 914 positioned to lie between the blocks 910 and the topper 912, and pillow top 724. Topper 912 provides vertical controlled compression and includes flexible straps 978 configured to extend about air chamber 914 and blocks 910 to hold topper 912 upon chamber 914. Straps 978 are coupled to topper 912 using an adhesive, although it is understood that a wide variety of releasable and non-releasable fastening mechanisms such as hook-and-loop type fasteners, snaps, buttons, and seams may be used in accordance with the present invention.

Individual blocks 910 have a variety of sizes and firmness levels that can vary to create zones within mattress structure 900 of various firmness. Thus blocks 910 produce a "customized" mattress structure 900 that is proportioned to fit the needs of a particular size and shaped person (not shown) air bladder mattress structure 900 to provide the user with three-dimensional zoning, as previously discussed. Blocks 910 and topper 912 are preferably constructed of a foam material similar to blocks 592 and topper 586. As shown in FIG. 40, air chamber 914 is positioned to lie over blocks 910. Chamber 914 is selectively inflatable and provides the user with side-to-side zoning. Air chamber 914 is capable of approximately 2.5 inches (6.4 cm) of thickness. Thus, the thin air chamber 914 positioned over the blocks 910 is configured to permit the user lying on bed 900 to adjust the amount of air in air chamber 914 and thus the side-to-side firmness feel of bed 900 as well as magnifying or minimizing the head-to-toe zoning by varying the pressure in the air chamber. It is understood that the thickness of air chamber 914 may be varied in accordance with the present invention.

Referring now to FIG. 41, air chamber 914 includes a plurality of inner supports 920 therein. Inner supports 920 cooperate to define air channels 922 in air chamber 914. Air channels 922 maybe in fluid communication with one another or be individual channels. Controller 990 permits user to inflate or deflate channels 922 to provide desired mattress feel. Controller 990 may be a hand-held or headboard/sideboard mountable controller in accordance with the present invention. It is understood that controller may be any one of a wide variety of controllers as previously described herein or any one of a variety of commercially available inflation/deflation controllers.

Figure 42:
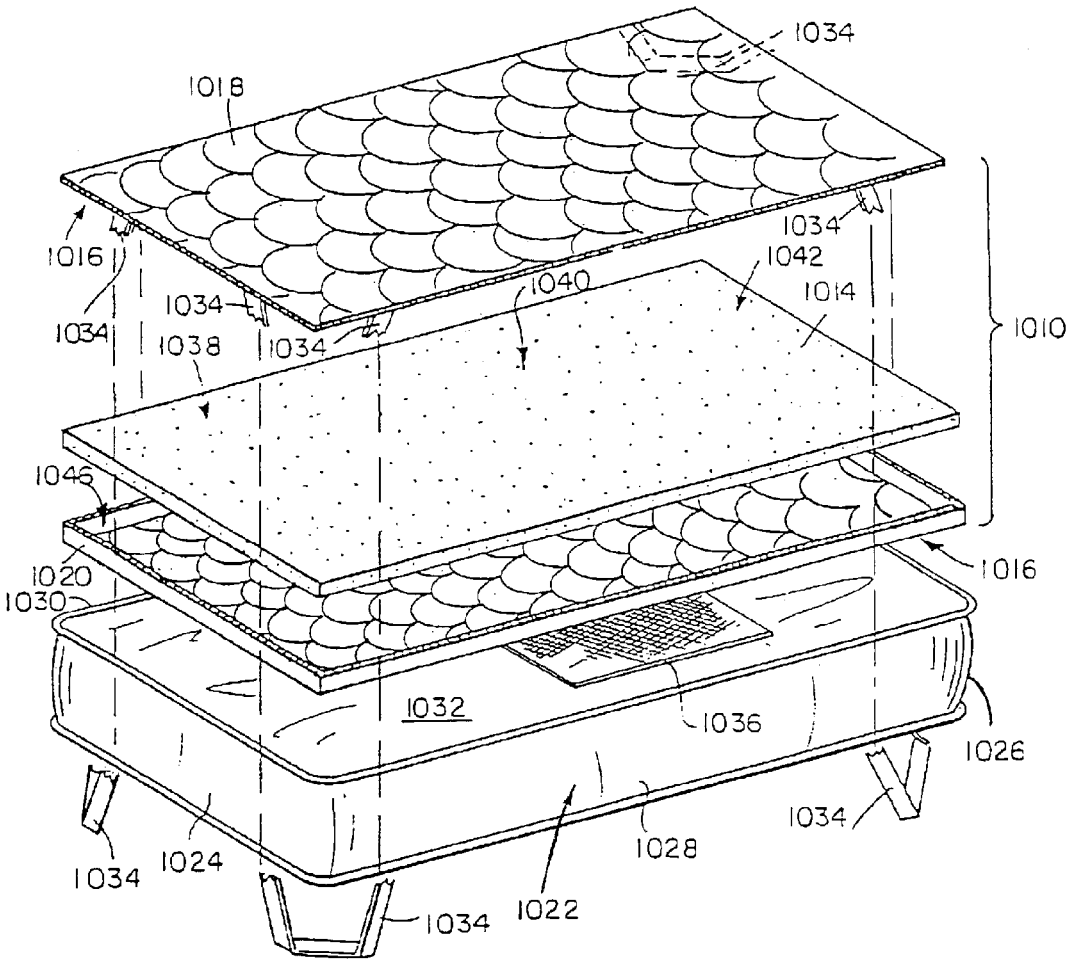
FIG. 42 is an exploded perspective view of a pillow top assembly in accordance with the present invention showing the pillow top assembly positioned to lie upon a top surface of a mattress and including a shell having a first and second cover defining an interior region therebetween, a foam block held within the interior region, and handles extending from the first cover for engagement with the mattress to hold the assembly upon the mattress.

As shown in FIG. 42, a pillow top assembly 1010 in accordance with the present invention provides separate sleeping surfaces for warm summer months cooler winter months. Pillow top assembly 1010 includes a shell 1016 and a foam pad 1014 positioned to lie within, shell 1016. Shell 1016 includes a top quilted panel 1018 having thermal properties designed for sleeping comfort during cooler months and a bottom quilted panel 1020 having thermal properties designed for sleeping comfort during warmer months.

Pillow top assembly 1010 in accordance with the present invention is configured to lie on a mattress, a mattress overlay, or a mattress replacement system 1022 (hereinafter "mattress"). As shown in FIG. 42, mattress 1022 has a head end 1024, foot end 1026 longitudinally spaced-apart from head end 1024, a longitudinally-extending first edge 1028 therebetween, and a longitudinally-extending second edge 1030 spaced apart from first edge 1028. In addition, mattress 1022 includes an upper panel 1032.

As used throughout the description and claims, the phrase "head end" will be used to denote the end of any referred-to object that is positioned to lie nearest head end 1024 of mattress 1022 and the phrase "foot end" will be used to denote the end of any referred-to object that is positioned to lie nearest to foot end 1026 of mattress 1022. The phrase "first edge" will be used to denote the edge of any referred-to object that is positioned to lie nearest first edge 1028 of mattress 1022 and the phrase "second edge" will be used to denote the edge of any referred-to object that is positioned to lie nearest second edge 1030 of mattress 1022. Also, unless otherwise noted, identical element numbering of pillow top assembly 1010 elements will be used on alternative embodiments. As described above, mattress 1022 can be any mattress for use in a home, a mattress for use in a hospital or other care facility, or any other type of mattress having an upwards-facing surface 44 above which a person rests. Illustrative mattress 1022 supports pillow top assembly 1010 of the present invention.

Pillow top assembly 1010 rests on upper panel 1032 so that pillow top assembly 1010 lies outside of the mattress interior (not shown). According to the present invention, pillow top assembly 1010 includes a series of four straps 1034, one strap 1034 situated adjacent each corner. Pillow top assembly 1010 is secured to mattress 1022 by looping each strap 1034 over a respective corner of mattress 1022. Pillow top straps 1034 are used in conjunction with anti-slip material 1036 which keeps pillow top 1010 constrained. Pillow top assembly 1010 can also lay freely on-mattress 1022 or can be coupled to mattress 1022 by use of hook and loop type fasteners or other suitable coupling means. Although four straps 1034 are illustrated on assembly 1010, is understood that greater than or fewer than four straps, could be provided in accordance with the present invention.

Figure 43:
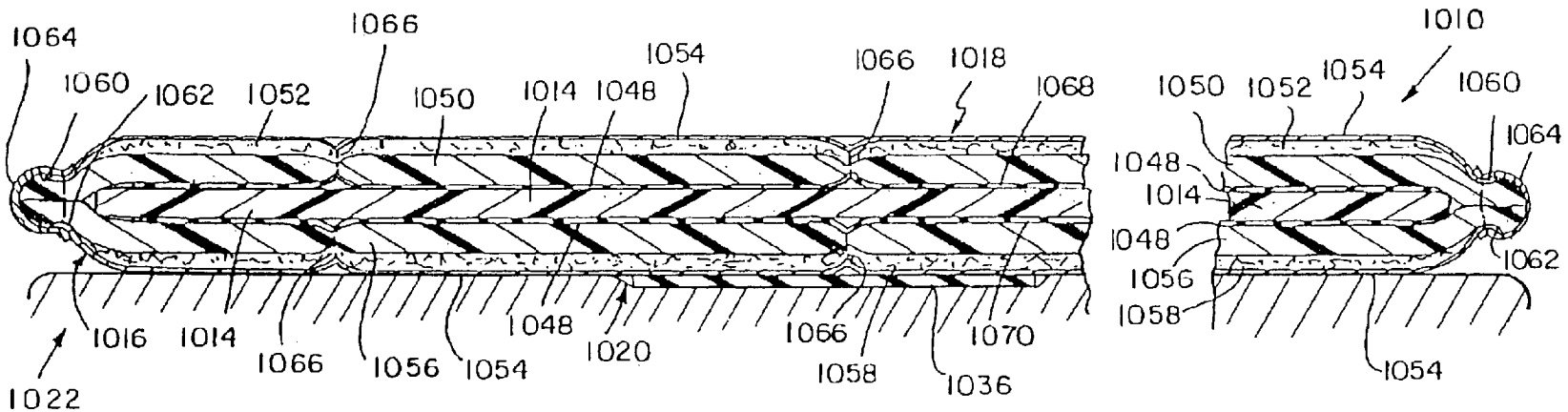
FIG. 43 is a cross-sectional view of the pillow top assembly of FIG. 42, showing the first and second covers coupled together with the zoned blocks positioned therebetween and an anti-slip sheet positioned to lie between a seat portion of the pillow top assembly and the mattress to prevent motion between the seat portion of the pillow top assembly and the mattress.

Shell 1016 of pillow top assembly 1010 that houses pad 1014 includes top quilted panel 1018 that cooperates with bottom quilted panel 1020 to define an interior region 1046 therebetween. As shown in FIG. 43, top quilted panel 1018 is preferably constructed of an adhesive sheet 1048, a foam layer 1050 constructed of polyurethane foam and positioned to lie adjacent adhesive sheet 1048, a winter layer 1052 constructed of a wool/polyester blend or pure wool or anti-microbial polyester fiber positioned to lie adjacent foam layer 1050 and having a first thermal resistance, and a cloth 1054 constructed of rayon, cotton, or cotton blend Damask cloth covering winter layer 1052. It is understood, however, that cloth 1054 may be constructed of a wide variety of natural or synthetic fibers that are used in the manufacture of cloth including non-air and non-liquid permeable cloth. Furthermore, a non-air and non-liquid permeable top quilted panel 1018 and bottom quilted panel 1020 may be used without exceeding the scope of the present invention. Foam layer 1050 provides a pre-determined vertical controlled compression to the user. Foam layer 1050 is relatively soft to allow the user to sink into winter layer 1052. Thus greater percentage of the user's surface area engages winter layer 1052 providing a warm feel to the user.

Bottom quilted panel 1020 is constructed of adhesive sheet 1048, a foam layer 1056 constructed of polyurethane foam and positioned to lie adjacent adhesive sheet 1048, a summer layer 1058 constructed of an anti-microbial polyester fiber or wool/polyester blend or pure wool positioned to lie adjacent foam layer 1056 and having a second thermal resistance, and cloth 1054 covering summer layer 1058 as shown, for example, in FIG. 43. In the preferred embodiment of the present invention, foam layer 1056 of bottom quilted panel 1020, situated next to summer layer 1058, is made of foam having a second firmness that is greater than foam layer 1050 of top quilted panel 1018, positioned next to winter layer 1052. Thus a smaller percentage of the user's surface area engages summer layer 1058 providing a cooler feel to the user and made of foam having a second firmness that is greater than that of foam layer 1050.

As described above, the preferred embodiment of the present invention includes top and bottom quilted panels 1018, 1020 that have a different thermal resistance. For example, when winter layer 1052 of top quilted panel 1018 is constructed of a wool/polyester blend, it effectively creates a "winter top" due to its high thermal resistance. Likewise, when summer layer 1058 of bottom quilted panel 1020 is constructed of a polyester fiber with anti-microbial, it effectively creates a "summer top" due to its low thermal resistance to the growth of unwanted organisms. Thus, the "summer top" provides the user with a cooler skin feel and the "winter top" provides the user with greater thermal resistance and therefore a warmer skin feel. Therefore, during the cooler winter months, the winter top can be placed nearest the user. When the weather becomes warmer, pillow top assembly 1010 may be flipped over so that the summer top is nearest the sleeper. Thus, pillow top assembly 1010 provides two sides with different thermal properties for different environmental conditions that occur with the change of seasons. In addition, winter layer 1052 can be plusher than summer layer 1058. So, more of the user's surface area engages the surface of winter layer 1052 and winter layer feels warmer to the user. Summer layer 1058 can be firmer than winter layer 2063. So, the user sinks into summer layer 1058 less than winter layer 1052, less of the user's surface area engages summer layer 1058, and therefore more of the user is exposed to air and is cooler. Further, turning the pillow top assembly 1010 for different seasons will increase the longevity of assembly 1010 and even wear.

As shown in FIG. 43, top quilted panel 1018 includes a first perimeter edge 1060 and bottom quilted panel 1020 includes a second perimeter edge 1062 that is coupled to first perimeter edge 1060 at a seam 1064. While seam 1064 is illustrated and described, it is understood that a releasable fastener such as zippers and he like may be used in accordance with the present invention. As shown in FIGS. 42 and 43, top and bottom quilted panels 1018, 1020 are quilted. Quilting 1066, according to the present invention, runs through each layer 1018, 1020 individually, but quilting could run all the way through pillow top assembly 1010 without exceeding the scope of the present invention. Thus, quilting 1066 can provide both aesthetic appeal as well as structural support to pillow top assembly 1010.

Pad 1014 lies within interior region 1046 of shell 1016. Pad 1014 cooperates to form an easy-to-assemble, one-piece, pillow top assembly 1010 with a predetermined vertical controlled compression. As shown in FIG. 42, pad 1014 is shaped as a relatively flat rectangular block and has a uniform predetermined firmness. As shown in FIGS. 42 and 43, pad 1014 is positioned to lie between top and bottom quilted panels 1018, 1020 in interior region 1046 of shell 1016 and extends from head end 1024 to foot end 1026 of mattress 1022. Adhesive sheets 1048 provide further structural support for pillow top assembly 1010 by serving as an adhesive connection between top and bottom quilted panels 1018, 1020 and pad 1014. Pad 1014 can also be sculpted to a desired shape or formed from a piece of foam having firmness that varies along its length or across its width without exceeding the scope of the invention as presently perceived.

According to the present invention, an anti-skid material 1036 is provided to inhibit sliding movement of pillow top assembly 1010 on upper panel 1032 adjacent anti-skid material 1036. Anti-skid material 1036 is particularly useful on articulating beds (not shown) where movement can occur between mattress 1022 and pillow top assembly 1010 during articulation of mattress 1022. In addition, non-slip material 1036 inhibits sliding movement of pillow top assembly 1010 when the user is entering or exiting mattress 1022. Pillow top assembly 1010 includes a head region 1038, a seat region 1040, and a foot region 1042. Non-slip material 1036 is positioned to lie between seat region 1040 and mattress 1022. Because non-slip material 1036 is not placed between head and foot regions 1038, 1042 and mattress 1022, motion or slipping is permitted in articulating beds between mattress 1022 and head and foot regions 1038, 1042. This movement allows head and foot regions 1038, 1042 to adjust to the underlying motion of mattress 1022 due to articulation of the articulating bed while the seat region 1040 of pillow top assembly 1010 remains generally stationary relative to seat region 1040 of mattress 1022. This relative motion between the pillow top and mattress minimizes the "shear" between the surface and the patient. Anti-skid material 1036 is made of Sleep Tight® (polyvinyl chloride (PVC) on a polyester scrim), rubber foam, or any suitable material that will restrict the movement of pillow top assembly 1010 relative to mattress 1022 adjacent to non-slip material 1036.

Figure 44:
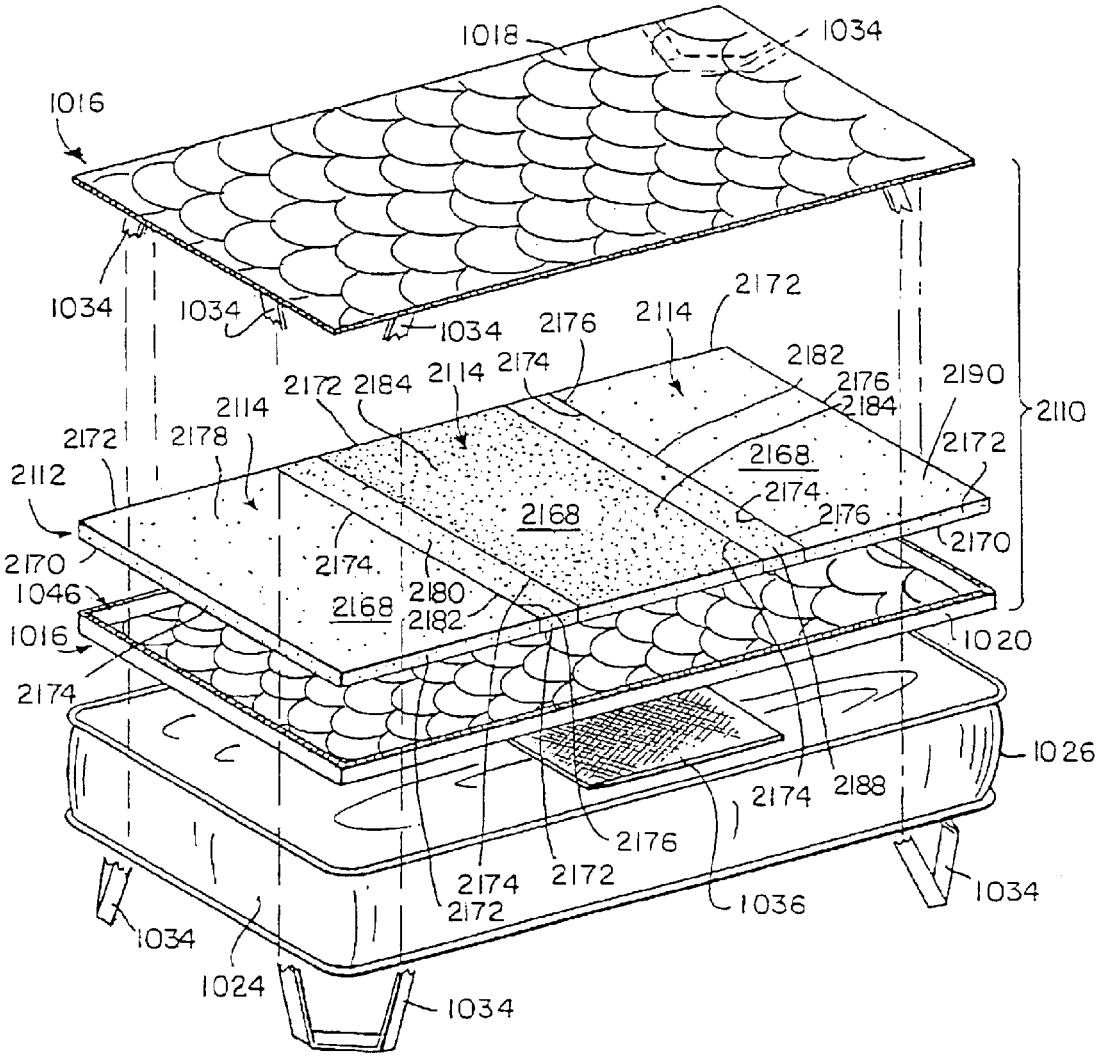
FIG. 44 is a view similar to FIG. 42 of an alternative pillow top assembly in accordance with the present invention showing the pillow top assembly including a shell defining an interior region, a series of zoned blocks held within the interior region, and handles extending from the shell.

As shown in FIG. 44, a pillow top assembly 2110 provides a user with two-dimensional zoning. Specifically, assembly includes a series 2112 of standardized zoned blocks 2114 that cooperate to provide vertical controlled compression and head-to-toe zoning. Pillow top assembly 2110 allows a user to have head-to-toe zoning on a conventional inner spring mattress, conventional water mattress, or a conventional single chamber air bladder to achieve both zoning and adjustable firmness for a lower cost than adjustable air bladders. Each block 2114 in series 2112 is constructed of a foam material similar to blocks 592 and has an individual firmness level. Thus, blocks 2114 of different firmness levels create zones within pillow top assembly 2110 of various firmness. Thus, series 2112 produces a "customized" pillow top or assembly 2110 or super top, as previously discussed, proportioned to fit the needs of a particular size and shape person (not shown) or to provide the user with the desired firmness characteristics. Assembly of modular blocks 2114 is completed by using shell 1016 that surrounds blocks 2114 and holds them securely in their pre-determined positions. As with pillow top assembly 1010, pillow top assembly 2110 and other embodiments of pillow top assemblies disclosed herein may be reversible, meaning that pillow top assembly 2110 and other embodiments of pillow top assemblies mentioned below include a summer top and an opposing winter top as described in detail above with respect to pillow top assembly 1010.

As shown in FIG. 44, blocks 2114 are generally rectangular in shape. Blocks 2114 are formed to include a top surface 2168 facing top quilted panel 1018, a bottom surface 2170 facing bottom quilted panel 1020, opposite side edges 2172 extending between top and bottom surfaces 2168, 2170, and first and second ends 2174, 2176 extending between top surface 2168 and bottom surface 2170. Second end 2176 of a first block 2178 in series 2112 abuts and is affixed to first end 2174 of a second block 2180 in series 2112 to form a contact joint 2182 therebetween. Likewise, second end 2176 of second block 2180 abuts and is affixed to first end 2174 of a third block 2184 to form a contact joint 2182 therebetween. Third block abuts a fourth block 2188 and fourth block abuts a fifth block 2190 in a similar manner. Blocks 2114, however, need not be coupled together in accordance with the present invention. First, third, and fifth blocks 2178, 2184, 2190 are preferably made of foam of substantially the same degree of firmness. Second and fourth blocks 2180, 2188 are preferably made of a foam that has a higher degree of firmness than first third, and fifth blocks 2178, 2184, 2190. This arrangement provides symmetry to pillow top assembly 2110. It is understood, that blocks 2114 may be formed as trapezoids, rectangles, honeycombs, or any number of shapes that are capable of fitting together at a contact joint to form series 2112 of blocks 2114 that extend between head end 1024 and foot end 1026 of mattress 1022 without exceeding the scope of the present invention. It is also understood that the firmness of assembly 2110 may be varied by including a single block 2114 with convolutions to provide head-to-toe zoning.

Illustrative blocks 2114 in series 2112 are constructed in the same manner and have similar firmness ranges as previously discussed blocks 92. The actual degree of firmness of blocks 1114 can be pre-selected to offer a range of choices for the end user. For example, three firmness arrangements can be pre-selected to offer users a "soft" pillow top assembly, a "medium" pillow top assembly having zoned blocks with a higher degree of firmness than the soft pillow top assembly, or a "hard" pillow top assembly having zoned blocks with a higher degree of firmness than the medium pillow top assembly. Thus, customers can select their degree of firmness from the pre-selected choices. Many degrees of firmness in addition to the three just mentioned may also be designed into pillow top assembly 2110 according to the present invention.

Figure 45:
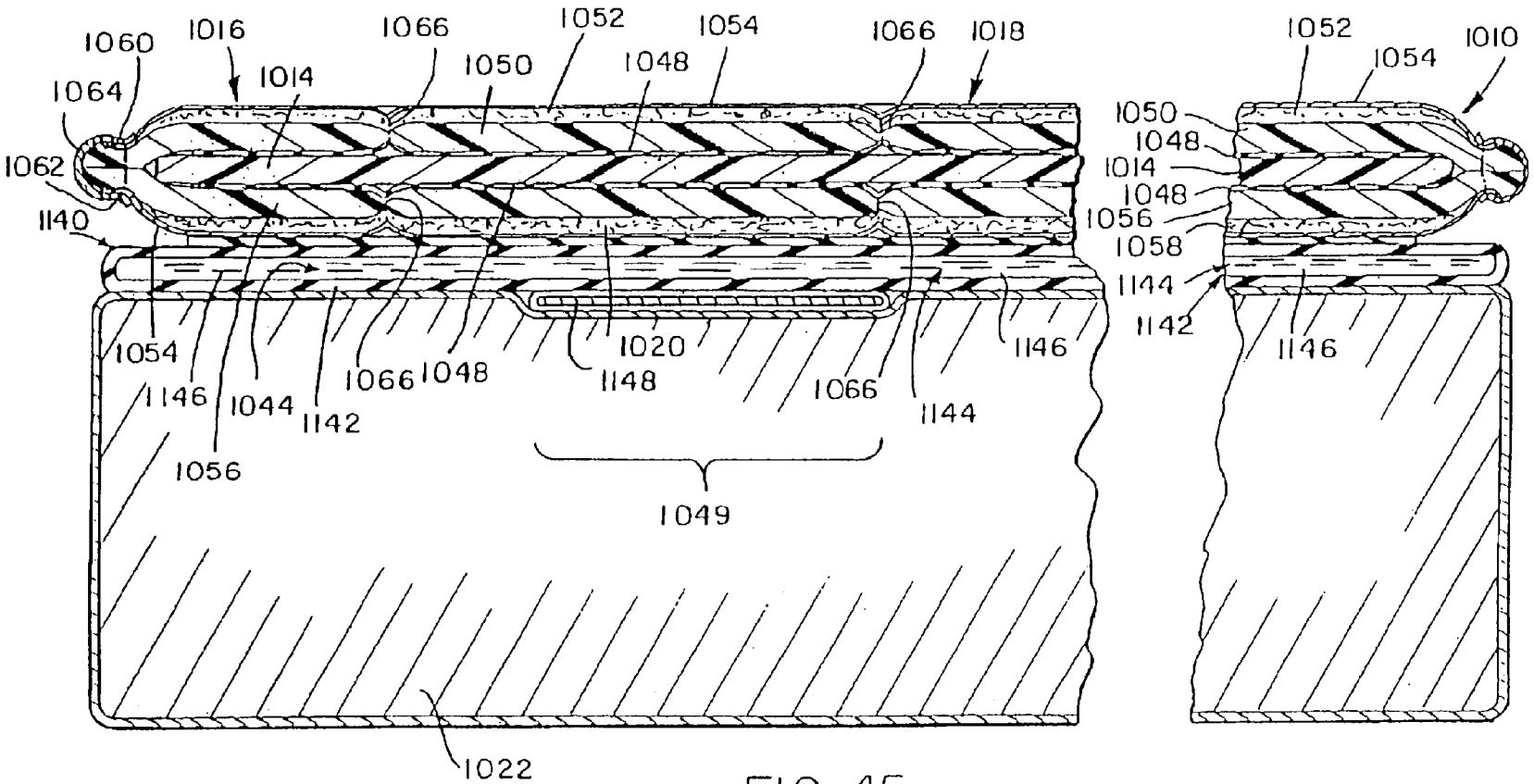
FIG. 45 is a cross-sectional view of a heat-dispersement apparatus in accordance with the present invention positioned upon a mattress and showing the heat-dispersement apparatus engaging a heating element and supporting the pillow top assembly of FIG. 42.

In still another embodiment of the present invention, a heat-dispersement apparatus 1140 is provided that is suitable for positioning between pillow top assembly 1010 and mattress 1022 as shown, for example, in FIG. 45. Dispersement apparatus 1140 provides the user with a heat sensation similar to a waterbed without the weight or risk of tear and cools the user when the mass of apparatus 1140 is at an ambient temperature that is lower than the body temperature of the user. It is understood that apparatus 1140 may also be positioned to lie between a wide variety of pillow top assemblies and mattresses so long as pillow top assembly is not so thick as to act as an insulator preventing heat from reaching the user.

Heat-dispersement apparatus 1140 includes an impermeable liner 1142 defining an interior cavity 1144, gel 1146 positioned to lie in cavity 1144, and at least one heating element 1148. Heating element 1148 may be any number of commercially available wired-heating pads configured to lie spaced apart from gel 1146, or may integral with apparatus 1140 (not shown) such that element 1148 is submersed in gel 1146. Gel 1146 suitable for use with the present invention is thermally conductive, provides a heat sink, and masks the feel of the wires of heating element 1148 from the user. It is understood, however, that while a gel is illustrated and described, a wide variety of dense thermally conductive materials, such as dense foam, may be used in accordance with the present invention. The desired heating characteristics of apparatus 1140 may vary in accordance with the present invention depending upon the thermal conductivity and density of gel 1146, the number of heating elements 1148, and size of apparatus 1140. Apparatus 1140 holds heat generated by heating elements 1148 and evenly dissipates heat through gel 1146 and thus across mattress 1022.

Heat-dispersement apparatus 1140 provides the user with the ability to pre-heat pillow top assembly 1010 before use or to provide a heating source during sleep. In one embodiment, apparatus 1140 creates a heat region 149 that enables the user to customize pillow top assembly 1010 to the user's pre-determined heating specifications or example, a person with back ailments may wish to heat their lumbar region separately from the rest of their body. Further, a person might desire to heat their lower legs and feet separately from the rest of their body during the winter. Many other combinations of independent heat regions 149 are also available for medical, comfort, and other reasons as well. Heat region 149 is created by placing a localized heating element 1148 adjacent desired heat region 149. While apparatus 1140 is illustrated and described, other heat sources and heating elements 1148 may be used in accordance with pillow top assembly 1010 of the present invention.

Figure 46:
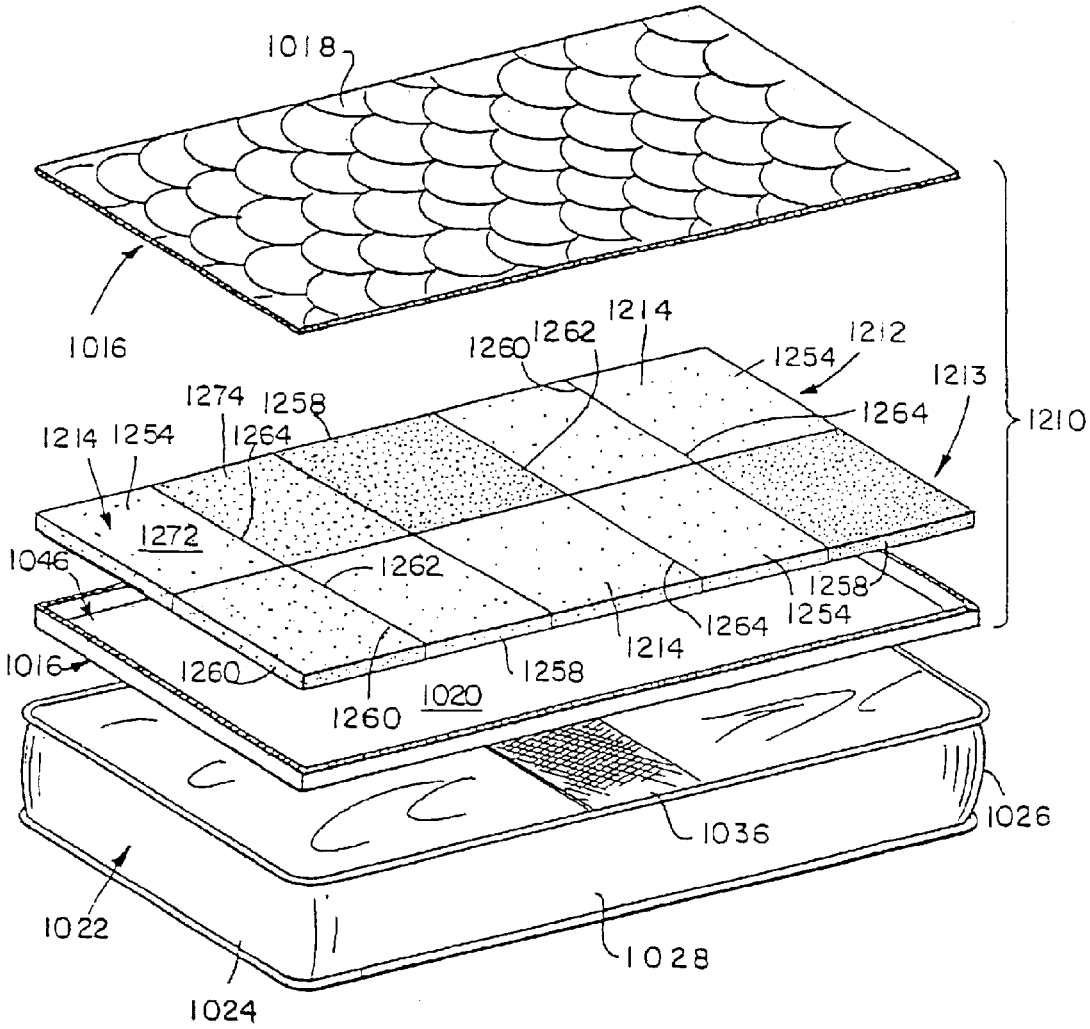
FIG. 46 is an exploded perspective view of a pillow top assembly in accordance with the present invention showing the pillow top assembly positioned to lie upon a top surface of a mattress and including a shell having a first and second layer defining an interior region therebetween and two series of zoned blocks held within the interior region and showing an anti-skid material positioned to lie between the pillow top assembly and the mattress.
Figure 47:
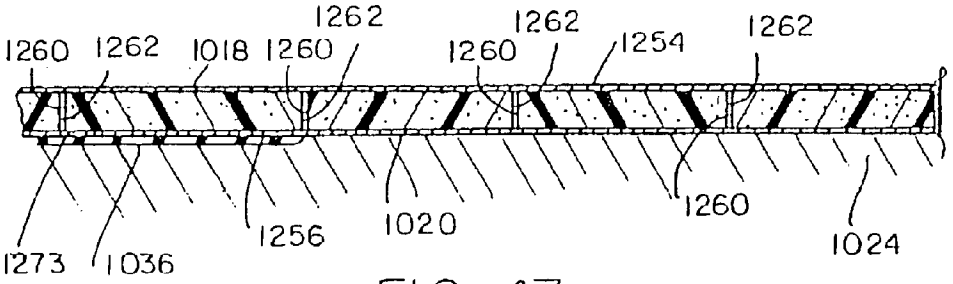
FIG. 47 is a cross section of the pillow top assembly of FIG. 46, showing the first and second layers of the shell coupled together with the zoned blocks positioned therebetween and an anti-slip sheet positioned between a middle region of the pillow topper and the mattress to prevent motion between the middle region of the pillow topper and the mattress during articulation of the mattress.
Figure 49:
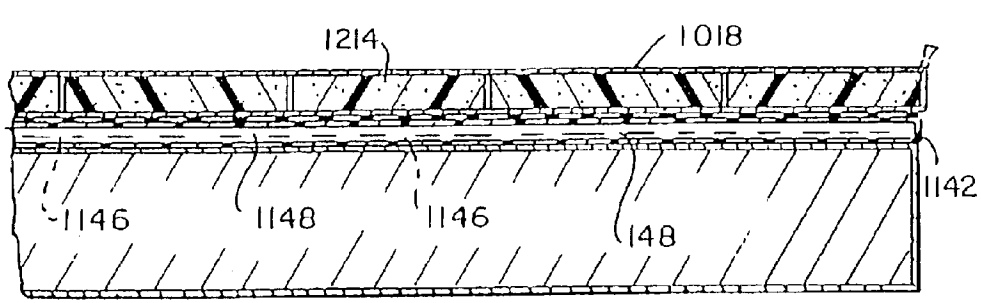
FIG. 49 is a-cross-sectional view of the pillow top assembly of FIG. 47 positioned to lie upon an anti-slip material, which lies upon a heat-dispersement of FIG. 45.
Figure 49:
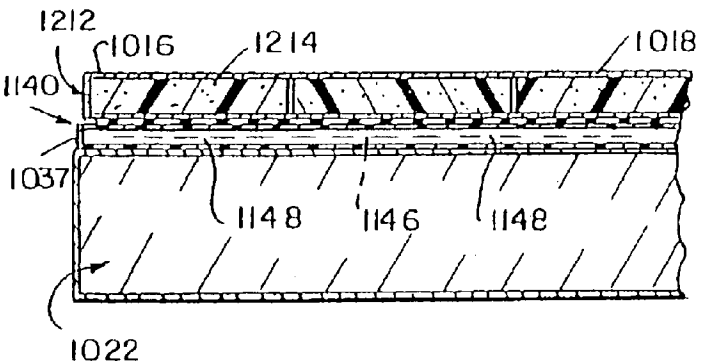

As shown in FIGS. 46, 47, and 49 yet another pillow top assembly 1210 or super top, in accordance with the present invention is provided. Pillow top assembly 1210 provides two-dimensional zoning to users. Specifically, pillow top assembly 1210 includes two series 1212, 1213 of standardized zoned blocks 1214 for mattresses 1022 sleeping more than one person. Individual blocks 1214 in each series 1212, 1213 cooperate to provide both vertical controlled compression and head-to-toe zoning. Blocks 1214 are constructed from foam materials similar to blocks 592, have a variety of sizes and firmness levels, and create zones within pillow top assembly 1210 of various firmness. Thus, series 1212, 1213 produce a "customized" assembly 1210 to fit the needs of particular sized and shaped people or to provide each user with their desired firmness characteristics. Shell 1016 surrounds blocks 1214 and holds them securely in their predetermined position. Assembly 1210 may also be formed with one series 1212 of blocks 1214 in accordance with the present invention.

Blocks 1214 lie within interior region 1046 of shell 1016. As shown in FIG. 46, zone blocks 1214 are generally uniformly shaped and are positioned in a side-by-side relationship within interior region 1046 between top and bottom quilted panels 1018, 1020. In addition, blocks 1214 extend from head end 1022 to foot end 1026 of shell 1016 that extends from head end 1022 to foot end 1026 of mattress 1022. Adhesive, sheets (not shown) may be used to provide further structural support for pillow top assembly 1210 by serving as an adhesive connection between top and bottom quilted panels 1018, 1020 and blocks 1214.

Referring now to FIG. 47, blocks 1214 are sculptured to a rectangular shape and provide both vertical controlled compression and head-to-toe zoning. It is understood that blocks 1214 may be formed as trapezoids, honeycombs, or any number of shapes that are capable of fitting together at a contact joint without exceeding the scope of the present invention. Blocks 1214 need not, however, necessarily be coupled together in accordance with the present invention. Blocks 1214 are formed to include a top surface 1254 facing top quilted panel 1018, a bottom surface 1056 facing bottom quilted panel 1020, opposite side edges 1058 extending between top and bottom surfaces 1254, 1256, and first and second ends 1260, 1262 extending between top surface 1254 and bottom surface 1256. Second end 1262 of a first block 1272 in series 1212 abuts first end 1260 of an adjacent block 1274 in series 1212 to form a contact joint 1264 therebetween. Heat-dispersement apparatus 1140 enables a user to have two-dimensions of zoning as well as the heat-sensation similar to a waterbed.

Anti-skid material 1036 is positioned to lie between seat section 1273 of pillow top assembly 1212 and mattress 1022 to prevent movement between mattress 1022 and pillow top assembly 1212 during articulation of mattress 1022. In addition, anti-skid material 1036 inhibits sliding movement of pillow top assembly 1212 when the user is entering or exiting mattress 1022. Anti-skid material 1036 rests upon mattress 1022, although it is understood that anti-skid material 1036 may be coupled to shell 1016. Referring now to FIG. 49, heat dispersement apparatus 1140 may be positioned between pillow top assembly 1210 and mattress 1022.

Figure 48:
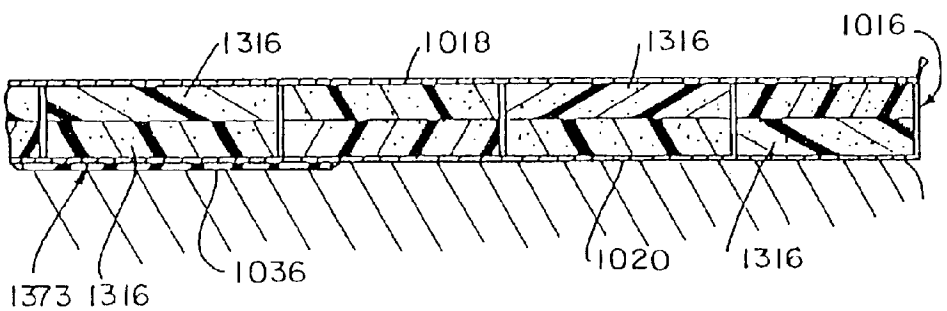
FIG. 48 is a cross section of another pillow top assembly of the present invention showing the pillow top assembly positioned to lie upon an anti-slip material, which lies upon a top surface of a mattress and showing the pillow top assembly including a shell, a first series of generally rectangular zone blocks positioned to lie within the shell and a second series of generally rectangular zone blocks positioned to lie upon the first series of blocks within the shell.
Figure 48:
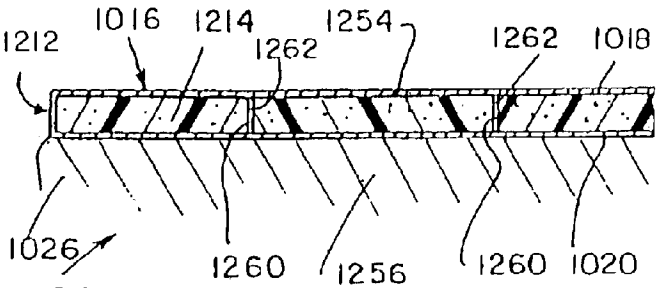
Figure 48:
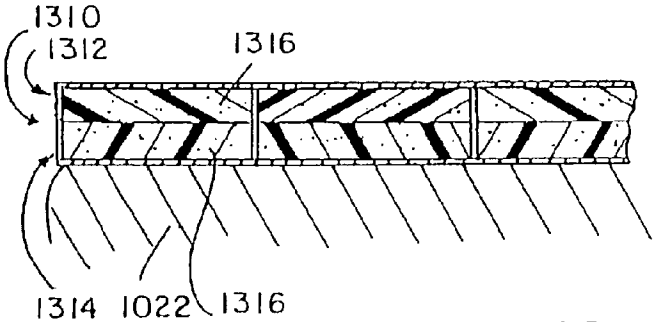

As shown in FIG. 48, yet another pillow top assembly 1310 in accordance with the present invention is provided. Pillow top assembly 1310 includes an upper zone series 1312 that has a different firmness than a lower zone series 1314. Thus, pillow top assembly 1310 provides the user with at least two different firmness feels depending upon whether the user is adjacent the top quilted panel 1018 or bottom quilted panel 1020. Specifically, the user will experience different vertical controlled compression depending upon what quilted panel 1018, 1020 to user engages.

Upper zone series 1312 is positioned to lie adjacent top quilted panel 1018 and bottom zone series 1314 is positioned to lie adjacent bottom quilted panel 1020. Panels 1018, 1020 may be formed as summer and winter tops as previously described in addition, individual blocks 1316 in series 1312, 1314 have a variety of sizes and firmness levels and create head-to-toe firmness zones within pillow top assembly 1310. Such differences in firmness between upper and lower zone series can be created by using blocks 1316 with different foam density, or by the use of ribs or other techniques known to those of ordinary skill in the art. Illustratively, anti-skid material 1036 is positioned to lie between seat section 1373 of pillow top assembly 1310 and mattress 1022 to prevent movement between mattress 1022 and pillow top assembly 1310 during articulation of mattress 1022 as discussed above. In addition, anti-skid material 1036 inhibits sliding movement of pillow top assembly 1310 when the user is entering or exiting mattress 1022.

Figure 50:
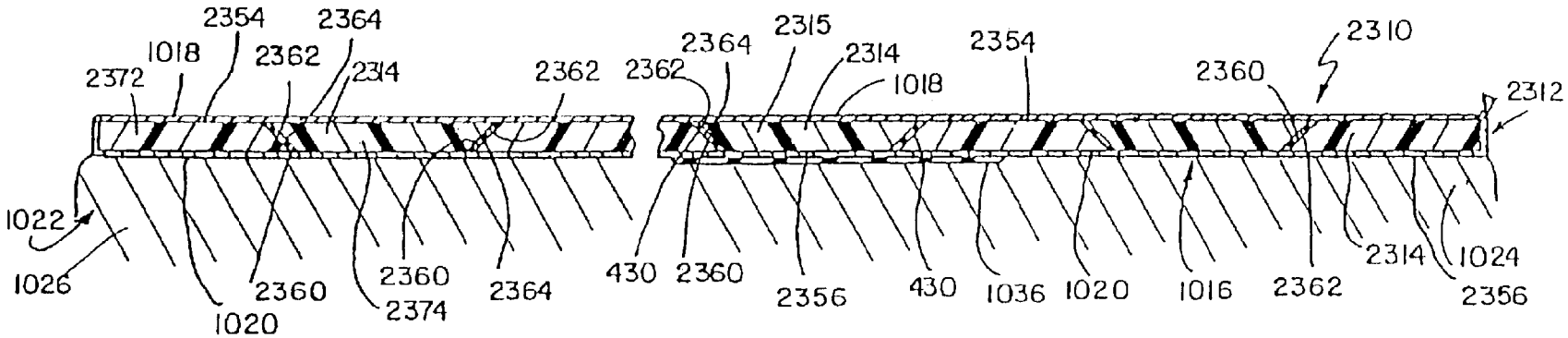
FIG. 50 is a cross section of another pillow top assembly of the present invention showing the pillow top assembly positioned to lie on a top surface of a mattress and including a shell defining an interior region and a series of transversely extending trapezoidal-shaped zoned blocks held within the interior region, each of the zoned blocks including angled first and second ends and showing the second end of a first block in the series overlapping the first end of an adjacent block in the series.

Referring now to FIG. 50, another pillow top assembly 2310 in accordance with the present invention is provided. Pillow top assembly includes a series 2312 of generally trapezoidal-shaped blocks 2314 to provide the user with two-dimensional zoning. Individual blocks 2314 in series 2312 are constructed of a foam material similar to blocks 592. Blocks 2314 may have a variety of firmness levels to create zones of various firmness within pillow top assembly 2310. Assembly of modular blocks 2314 is made easy by using shell 1016 that surrounds blocks 2314 and holds them securely in their pre-determined position. Blocks 2314 are formed to include a top surface 2354 facing top quilted-panel 1018, a bottom surface 2356 facing bottom quilted panel 1020 and angled first and second ends 2360, 2362 diverging from top surface 2354 toward bottom surface 2356. As shown in FIG. 50, second end 2362 of a first block 2372 in series 2312 abuts first end 2360 of an adjacent block 2374 in series 2312 to form a contact joint 2364 therebetween. Anti-shear coating 430 is positioned to lie at joint 2364 between first and second ends 2360, 2362 of adjacent blocks 2314 in series 2312 so that each block 2314 can move independently of adjacent blocks 2314 and provide head-to-toe zoning.

It is understood that blocks 2314 may be formed as cubes, rectangles, honeycombs, or any number of shapes that are capable of fitting together to form a series 2312 of blocks 2314. In the illustrative trapezoidal blocks 2314, second end 2362 of first block 2372 in series 2312 is overlapped by first end 2360 of adjacent block 2374 in series 2312. Alternatively, it is understood that second end 2362 of first block 2372 in series 2312 may overlap first end 2360 of adjacent block 2374 in series 2312. It is believed that this overlapping configuration provides gradual shifting of the firmness from one zone block 2314 to the next block 2314 in series 2312. Illustrative blocks 2314 in series 2312 are constructed of the same material as blocks 94 and the firmness of blocks 2314 can be varied as previously described for blocks 94. Blocks 2314 can also be sculpted to a desired shape or formed from a piece of foam having firmness that varies along its length or across its width without exceeding the scope of the invention as presently perceived.

The firmness of each block 2314 can be selected at the point of sale to allow the user to have a custom designed pillow top assembly 2310 without having to wait for a remote factory to construct and deliver pillow top assembly 2310. Furthermore, if the user desires to change the firmness configuration of pillow top assembly 2310, the user can return pillow top assembly 2310 to the point of sale for adjustment. At the point of sale, blocks 2314 can be removed and replaced to match the user's preference.

Figure 51:
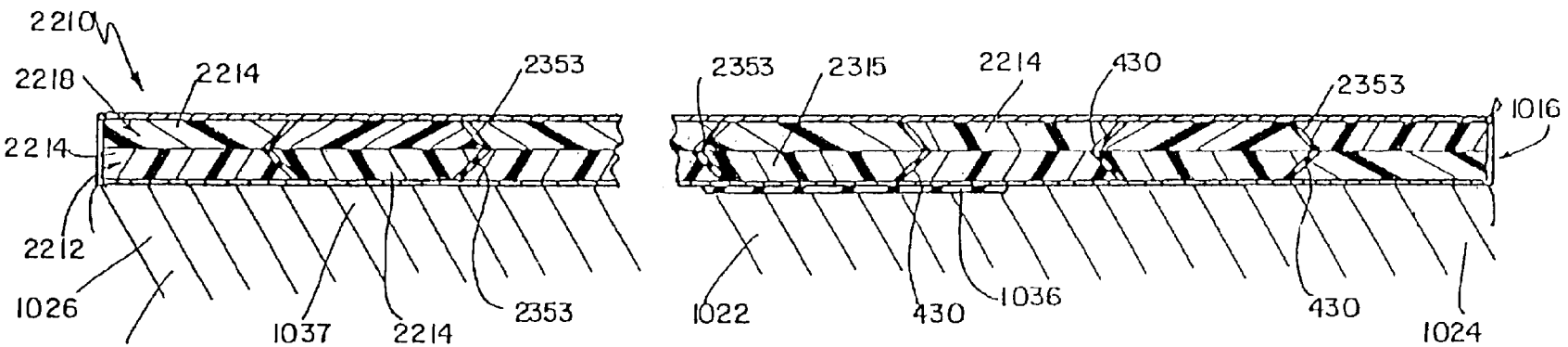
FIG. 51 is a view similar to FIG. 50 of yet another pillow top assembly of the present invention, showing the pillow top assembly including a first series of generally trapezoidal shaped zoned blocks and a second series of generally trapezoidal shaped zoned blocks positioned to lie upon the first series of zoned blocks.

Referring now to FIG. 51, a reversible pillow top assembly 2210 in accordance with the present invention is provided. Pillow top assembly 2210 includes a lower set 2212 of generally trapezoidal-shaped blocks 2214 that have a different firmness feel than an upper set 2218 of generally trapezoidal-shaped blocks 2214 positioned to lie upon lower set 2212. Thus, pillow top assembly 2210 provides the user with at least two different firmness feels depending upon whether the user is adjacent upper set 2218 or lower set 2212. The stacked configuration of first and second sets 2212, 2218 allows the user to further customize the vertical controlled compression of pillow top assembly 2210 as well as to alter the feel of the head-to-toe zoning.

As shown in FIG. 51, upper set 2212 includes transversely extending blocks 2214. Lower set 2218 of blocks 2214 extends transversely across first set 2212 of blocks 2214. It is understood, however, that to achieve certain desirable customization, blocks 2214 within first and second sets 2212, 2218 may have a variety of firmness, and be positioned to lie in a variety of configurations. Pillow top assembly includes a summer top and an opposing winter top as previously discussed with reference to assembly 1010. So, preferably firmer foam blocks are positioned to lie adjacent the summer top so that the user is prevented from sinking into foam and a plusher foam blocks adjacent the winter top.

Zoned pillow top assemblies 2310 and 2210 of FIGS. 50 and 51 are positioned to lie upon anti-skid material 1036 as previously discussed. Anti-skid material prevents slipping of pillow top assemblies 2310, 2210 when the user enters or exits mattress and prevents slipping of assemblies 2310, 2210 adjacent seat sections during articulation of mattress 1022. Pillow top assemblies 2310, 2210 may also be customized for mattresses sleeping more than one person (not shown). Pillow top assemblies 2310, 2210 can be customized so that one portion of mattress 1022 provides the firmness characteristics desired by one person and another portion provides the firmness characteristics of that person's sleeping partner. Therefore, multiple personal preferences can be accommodated by one pillow top assembly 2310, 2210.

Figure 52:
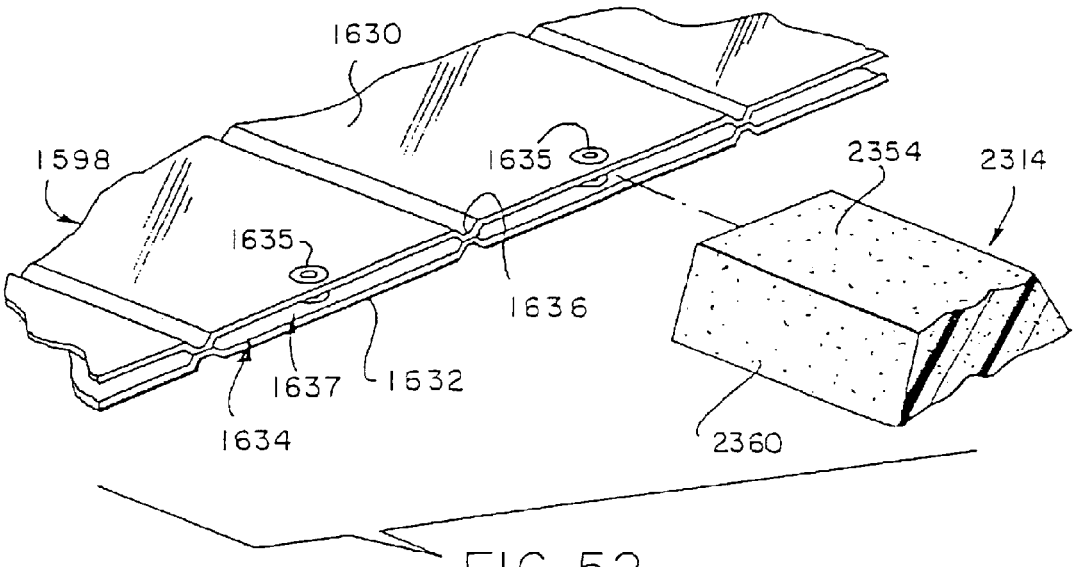
FIG. 52 is a perspective view of a slip cover in accordance with the present invention having a plurality of pockets sized to receive the zoned blocks and showing a zoned block before insertion into one of the pockets.
Figure 53:
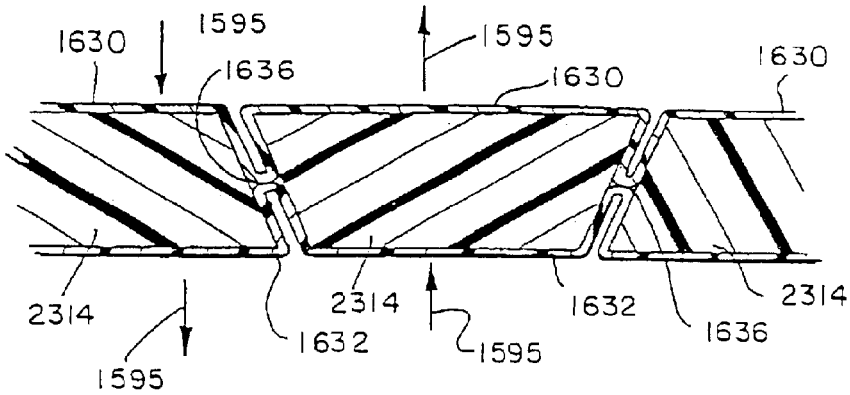
FIG. 53 is a cross-sectional view of the slip cover of FIG. 52 following insertion of the zoned blocks into the pockets.

As previously discussed, anti-shear coating 140 may be positioned to lie between adjacent blocks 1214, 2114, 2214, 2314 so that blocks 1214, 2114, 2214, 2314 can move independently of one another to provide head-to-toe zoning. While only blocks 2314 will be discussed hereafter, it is understood that the discussion of blocks 2314 applies to blocks 1214, 2114, and 2214 as well. As shown in FIG. 52, a slip cover 1598 may be provided to serve as an anti-shear coating and to join blocks 2314 together in a single unit in accordance with the present invention. Slip cover 1598 includes a top member 1630 and a bottom member 1632 coupled to top member 1630 to form a plurality of pockets 1634 therebetween. Pockets 1634 are spaced apart by seams 1636. Referring now to FIG. 53, pockets 1634 receive blocks 2314 and snaps 1635 are provided to close an opening 1637 to pockets 1634 to retain blocks 2314 therein. Pockets 1634 beneficially inhibit migration of blocks 2314 within pillow top assembly 2310 and permit independent action of blocks 2314. The independent action of blocks is shown by arrows 1595 in FIG. 53 to provide head-to-toe zoning. Slip cover 1598 is made from a material having a low coefficient of friction such as "parachute material" or nylon.

Figure 54:
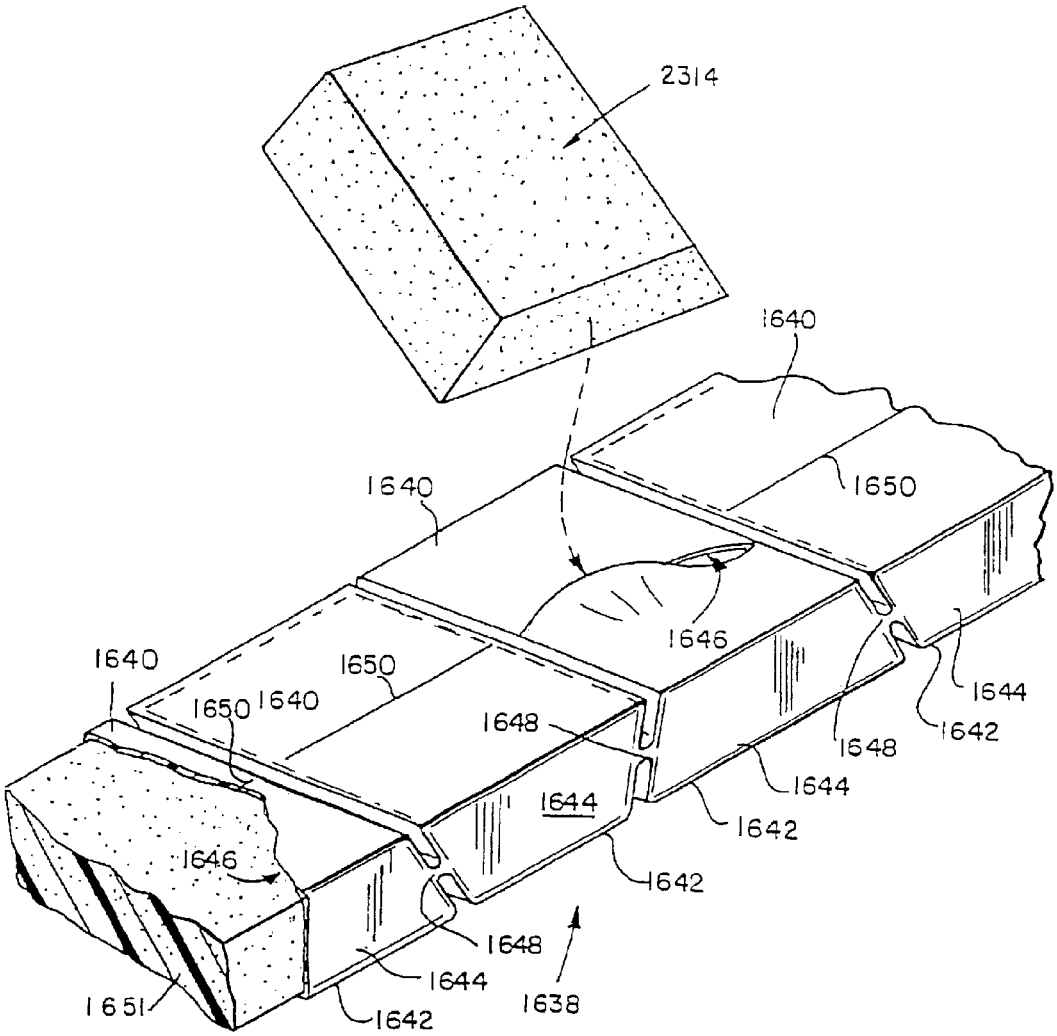
FIG. 54 is a perspective view of a sleeve in accordance with the present invention showing the sleeve having slots and pockets and showing generally trapezoidal-shaped zoned blocks positioned to lie in the pockets and showing one zoned block being inserted through a slot of the sleeve into the pocket.

If desired, an alternative sleeve 1638, shown for example in FIG. 54, may be provided to act as an anti-shear coating. Sleeve 1638 enables two-dimensional zoning by permitting vertical controlled compression and head-to-toe zoning. Sleeve 1638 includes an upper panel 1640, a lower panel 1642, and sides 1644 coupling upper and lower panels 1640, 1642 together. In addition, sleeve 1638 includes a plurality of spaced-apart pockets 1646 therein that are defined by seams 1648. Each upper panel 1640 includes at least one slot 1650 therethrough that defines an opening into pocket 1646 and is sized to receive a foam block 2314 therethrough. Reduced-sized blocks 1214, 2114, and 2214 may also be used with sleeve 1638 in accordance with the present invention. Similar to slip cover 1598, sleeve 1638 enables the individual compression of blocks 1651. It is understood that pockets 1646 may be configured in a variety of shapes and sizes to receive blocks of various sizes and shapes in accordance with the present invention.

Figure 55:
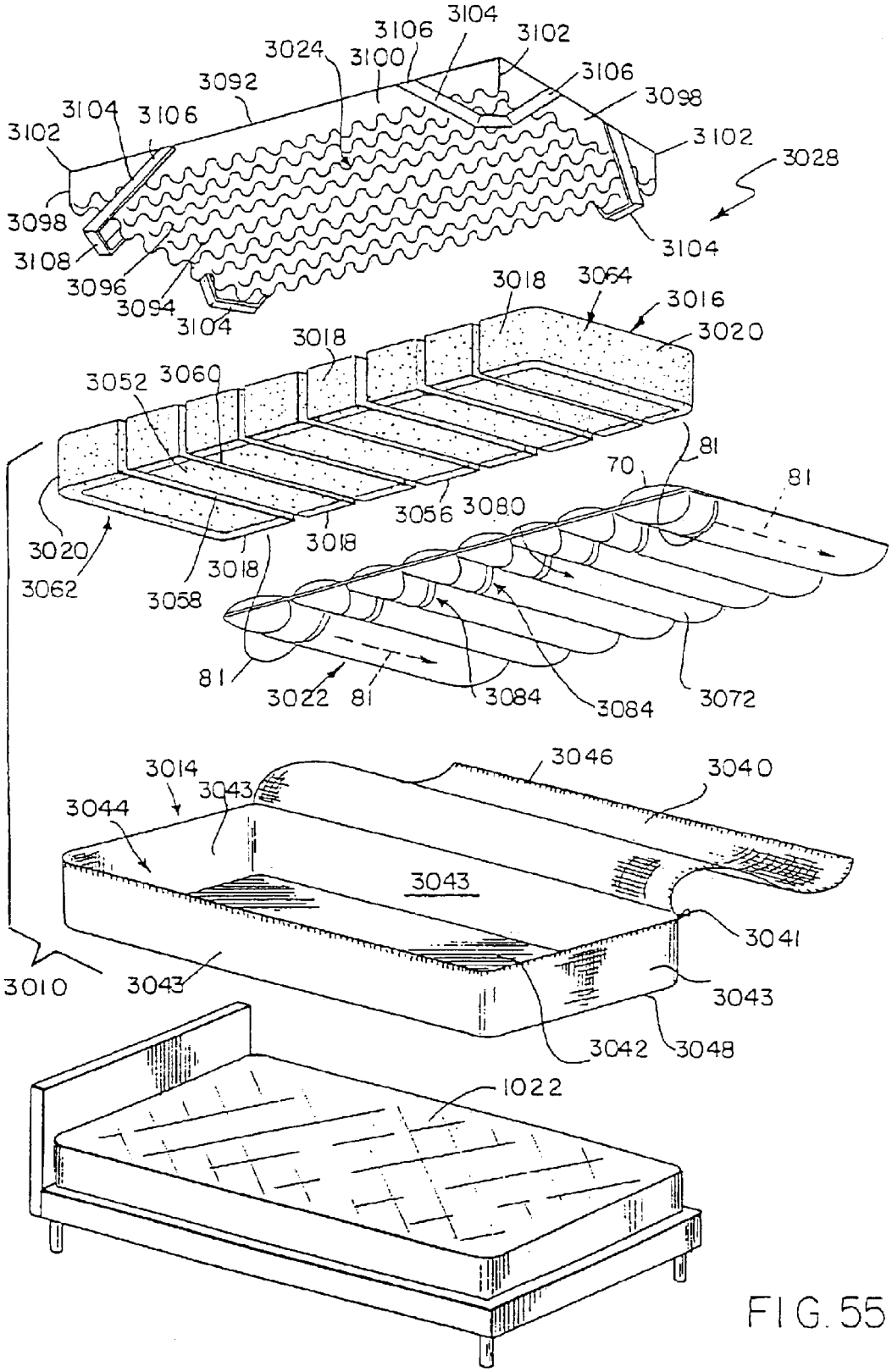
FIG. 55 is an exploded assembly view of a conversion mattress structure of the present invention showing the mattress structure including a fabric shell, resilient blocks, and a sleeve formed to receive the blocks and showing a first configuration of the mattress structure wherein convoluted foam is configured to rest upon the sleeve.
Figure 56:
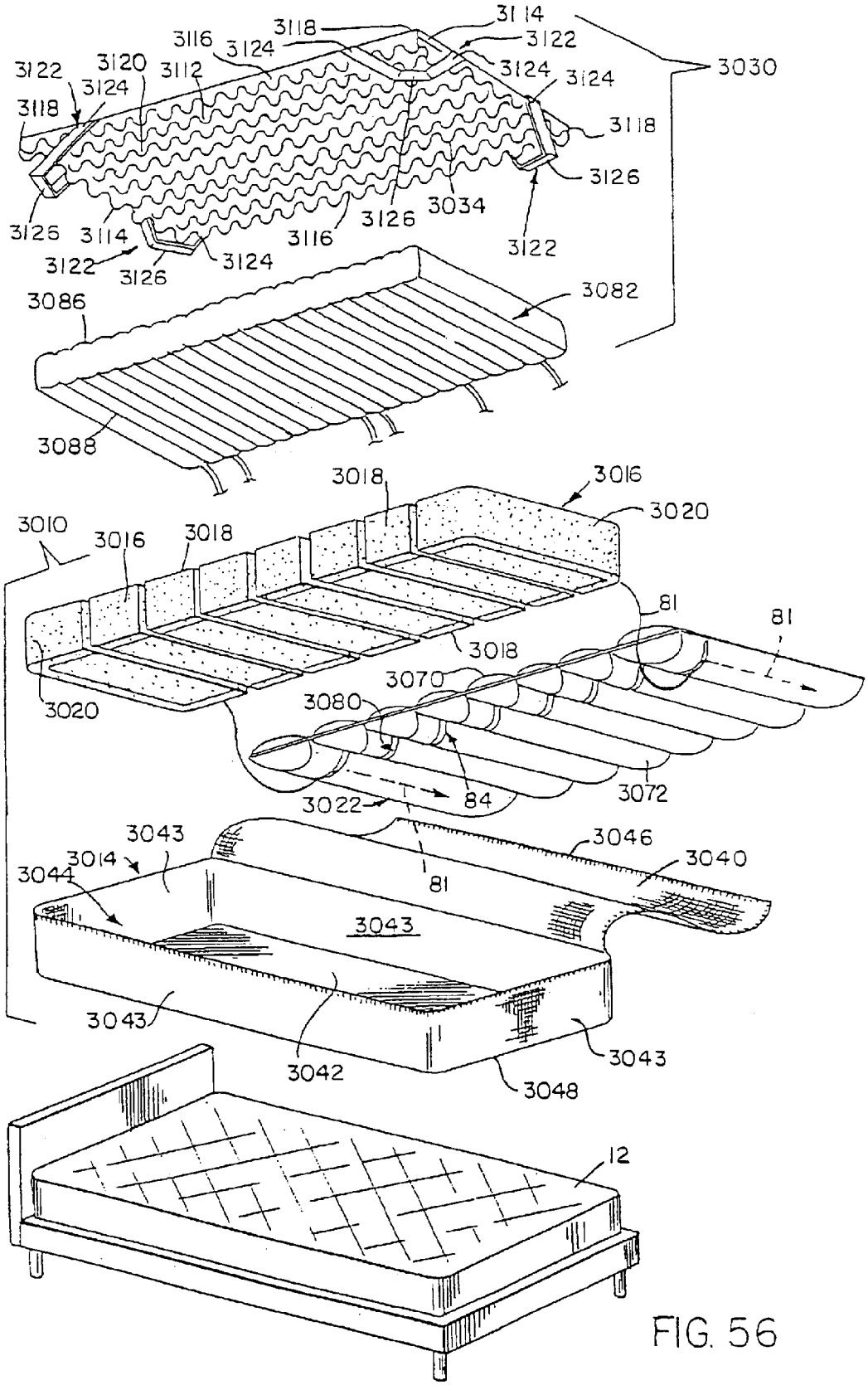
FIG. 56 is an exploded assembly view of a second configuration of the mattress structure of FIG. 55 showing the mattress structure including an air bladder and a foam topper that are configured to rest upon the sleeve within the fabric shell.

As shown in FIG. 55, a mattress structure 3010 is provided that permits a user upgrade from two-dimensional zoning to three-dimensional zoning. Mattress structure 3010 achieves the two-dimensional zoning by providing a plurality of zone blocks 3016. Mattress structure 3010 is upgradable, meaning that the user may upgrade to bladder 3032 as shown in FIG. 56, from a less expensive foam topper 3024. Zone blocks 3016 will cooperate with foam topper 3024 or with bladder 3032 to provide vertical controlled compression as well as head-to-to controlled compression. Bladder 3032 provides the side-to-side controlled compression to permit the three-dimensional zoning.

Figures 62, 63:
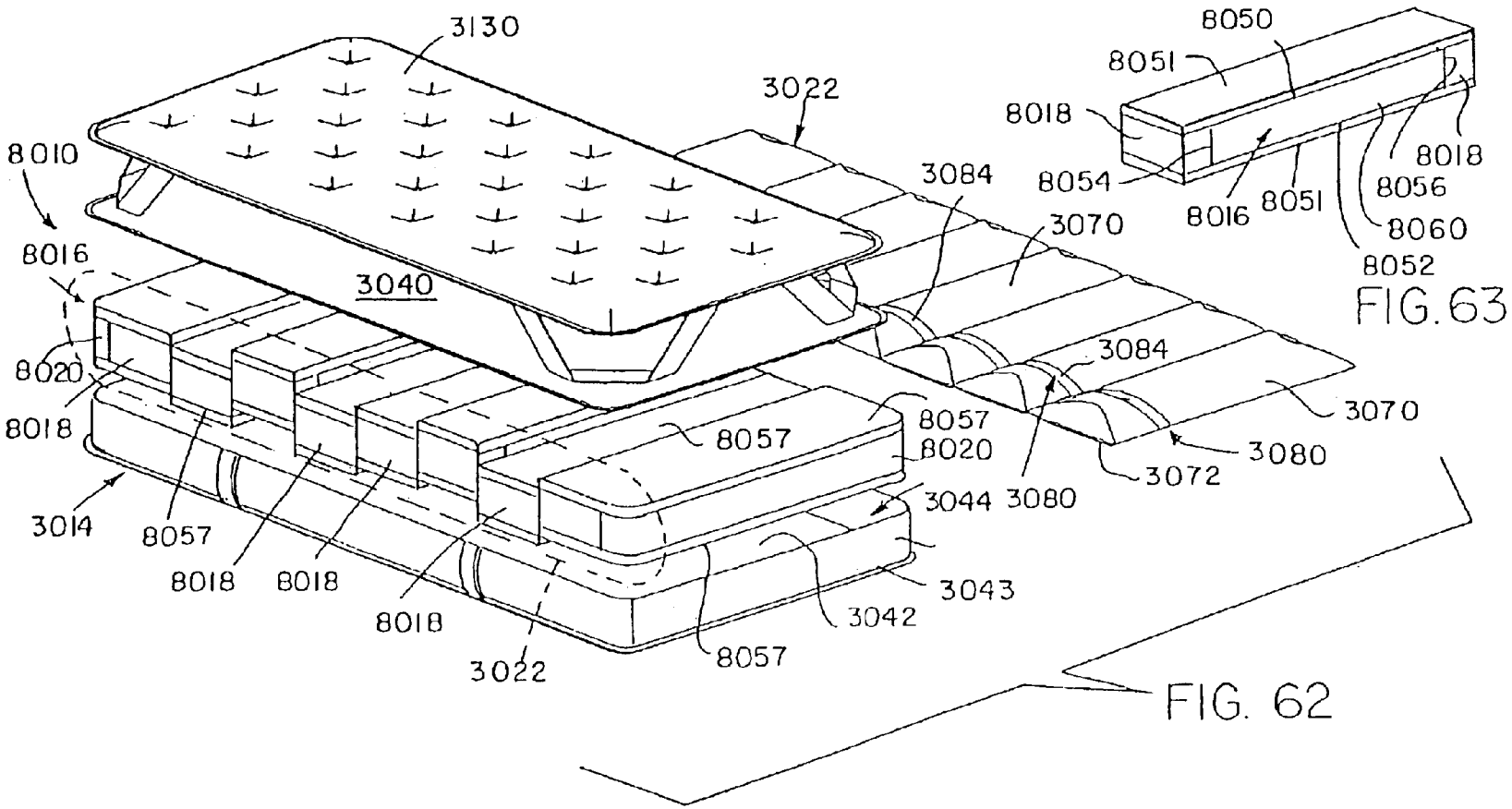
FIG. 62 is an exploded assembly view of a mattress structure of the present invention showing the mattress structure including a fabric shell, composite foam blocks, and a sleeve formed to receive the composite foam blocks.
FIG. 63 is a perspective view of one composite block showing the block coupled to top and bottom foam toppers and to opposite foam end rails.

Referring now to FIG. 62 a mattress structure 8010 is provided that is easy to ship to a user and that is symmetrical, which enables generally error-proof installation. Mattress structure includes fabric shell 3014, zoned blocks 8016, foam side rails 8018, foam end rails 8020, and slip cover 3022. Blocks 8016 have a variety of sizes and firmness levels that can vary to create zones within mattress structure 8010 of various firmness to provide a "customized" mattress structure 8010 proportioned to fit the needs of a particular size and shaped person or to provide a mattress having the desired firmness characteristics. Blocks 8016 are preferably constructed of a foam material similar to blocks 592.

As shown in FIG. 62, blocks 8016 are positioned to lie within slip cover 3022 in fabric shell 3014. Blocks cooperate with slip cover 3022 to form a core portion of mattress structure 8010. Blocks 8016 are formed Blocks 3016 are formed in a rectangular shape (See FIGS. 62 and 63) and include a top surface 8050 facing top panel 3040 of shell 3014, a bottom surface 8052 facing bottom panel 3042 of shell 3014, opposite ends 8054, 8056 and side edges 8058, 8060 extending between top and bottom surfaces 8050, 8052. As shown in FIG. 62, mattress structure 8010 includes eight blocks 8016. Two blocks 8016 form opposite ends 8062, 8064 while six blocks 8016 form a middle segment 8066. It is understood that greater or fewer than eight blocks 8016 may be used without exceeding the scope of the invention as presently perceived.

Referring now to FIG. 63, a portion of side rail 8018 is positioned to lie adjacent and is affixed to end 8054 of each block 8016 and a portion of side rail 8018 is positioned to lie adjacent and is affixed to opposing end 8056 of each block 8016. A portion of topper 8057 is positioned to lie adjacent and is affixed to top surface 8050 of each block 8016 and a portion of topper 8057 is positioned to lie adjacent and is affixed to bottom surface 3052. As shown in FIG. 63, end rail 8020 is positioned to lie between spaced apart rails 8018. The purpose of end rails 8020 and side rails 8018 is to build a firm perimeter amount the mattress. This firm perimeter serves to keep the user from rolling out and improves comfort when sitting on the edge of the bed. As shown in FIG. 62, end rail 8020 is positioned to lie between spaced-apart side rails 8018 at opposite ends 8062, 8064.

Side and end rails 3018, 3020 and topper 8057 are affixed to blocks 3016 by an adhesive. It is understood that a wide variety of commercially available adhesives can be used in accordance with the present invention so long as the adhesive is suitable for use with the material used to form side and end rails 8018, 8020, toppers 8057, and blocks 8016. Alternatively, side and end rails 8018, 8020 and topper 8057 can be coupled to blocks 8016 by hook-and-loop type connectors, buttons, snaps, and the like without exceeding the scope of the invention as presently perceived. Side and end rails 8018, 8020 and topper 3057 are constructed of materials similar to frame 574 and blocks 592 as previously discussed. As was discussed in connection with FIG. 59, it should be understood that fewer than all of blocks 8016 may be affixed to side rails 8018 in accordance with the present invention.

As described above, side rails 8018, end rails 8020, and topper 8057 of mattress structure 8010 are integrally coupled to blocks 8016 minimizing the number of components for assembly by the seller or the user. To further simplify the assembly of mattress structure 8010, the firmness characteristics of side rails 8018, end rails 8020, topper 8057, and blocks 8016 may be selected to be symmetrical about a point in the middle of mattress structure 8010 so that it is impossible to improperly place blocks 8016 in interior region 3044. Mattress structure 8010 will provide the expected firmness characteristics regardless of the orientation of blocks 8016 in interior region 3044 provided that blocks 8016 are arranged in the proper order relative to one another.

Mattress structure 3010 includes a fabric shell 3014, zoned blocks 3016, a slip cover 3022, and pillow topper 3024. Individual blocks 3016 have a variety of sizes and firmness levels that can vary to create zones within mattress structure 3010 of various firmness to produce a "customized" mattress structure 3010 proportioned to fit the needs of a particular size and shaped person (not shown) or to provide a mattress having the desired firmness characteristics. Blocks 3016 are preferably constructed of a foam material similar to blocks 592.

Fabric shell 3014 includes a top panel 3040, a bottom panel 3042, and a side wall 3043, that cooperate to define an interior region 3044 therebetween. Top and bottom panels 3040, 3042 and side wall 3043 are constructed of a permeable rayon material. It is understood, however that top and bottom panels 3040, 3042 and side wall 3043 may be constructed of a wide variety of natural and synthetic fibers that are used in the construction of cloth, such as cotton, wool, polyester, and blends thereof. Non-air and non-liquid permeable top and bottom panels may also be used without exceeding the scope of the present invention.

Top panel 3040 of fabric shell 3014 includes a first perimeter edge 3046 and bottom panel 3042 includes a second perimeter edge 3048. Top panel 3040 is constructed of a material having a low coefficient of friction to allow a pillow top to move relative to mattress structure 3010 minimizing shear to the user. In addition, top panel 3040 may also include a portion having an anti-skid material 1036 affixed thereto, preferably in a central location such as adjacent to seat section 3099, as shown, for example in FIG. 55. Anti-skid material 1036 inhibits sliding movement of a pillow top 3130 relative to top panel 3040 adjacent to anti-skid material 1036 while the top panel material permits movement of pillow top 3130 relative to top panel 3040 adjacent to other surfaces of top panel 3040 during mattress articulation.

Perimeter edge 3046 of top panel 3040 defines a first area dimension and perimeter edge 3048 of bottom panel 3042 defines a second area dimension that is substantially equivalent to first area dimension. The first and second area dimensions will vary depending upon whether mattress structure is a twin sized mattress, full sized mattress, queen sized mattress, or king sized mattress. Side wall 3043 extends between the first and second perimeter edges 3046, 3048. As shown in FIG. 55, side wall 3043 is coupled to bottom panel 3042 by a seam and top panel 3040 by a zipper 3041. It is understood, however, that hook and loop type fasteners, zippers, buttons, snaps, and a wide variety of permanent or releasable coupling mechanisms may be used to couple top panel 3040 and bottom panel 3042 to side wall 3043 without exceeding the scope of the invention as presently perceived.

Figure 57:
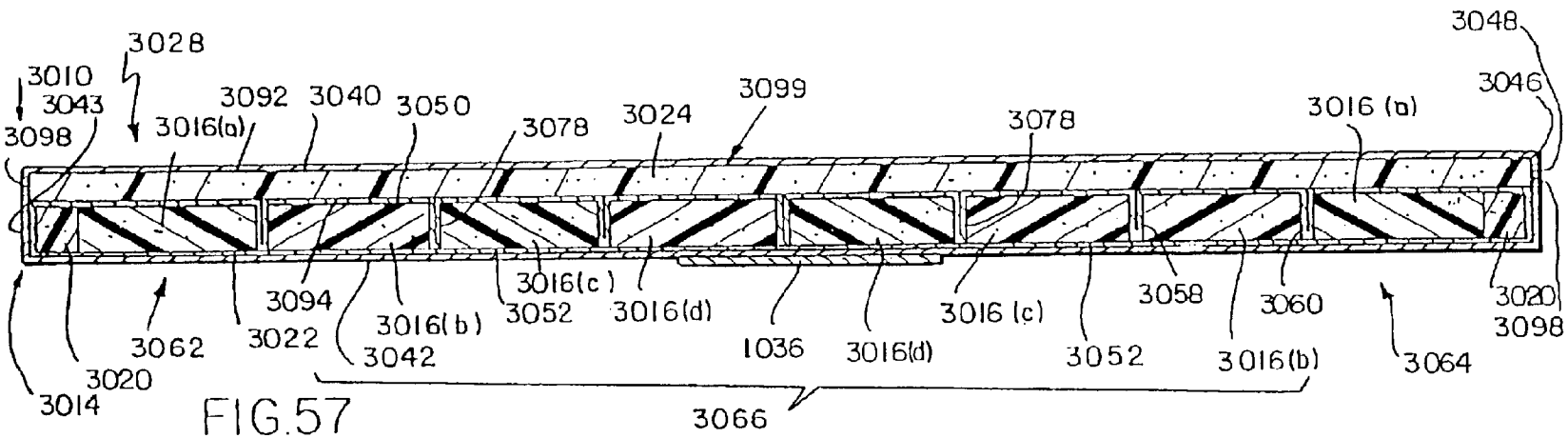
FIG. 57 is a cross-sectional view of the mattress structure of FIG. 55 in an assembled position showing the fabric shell having a pre-determined height and the foam core positioned upon the sleeve.
Figure 58:
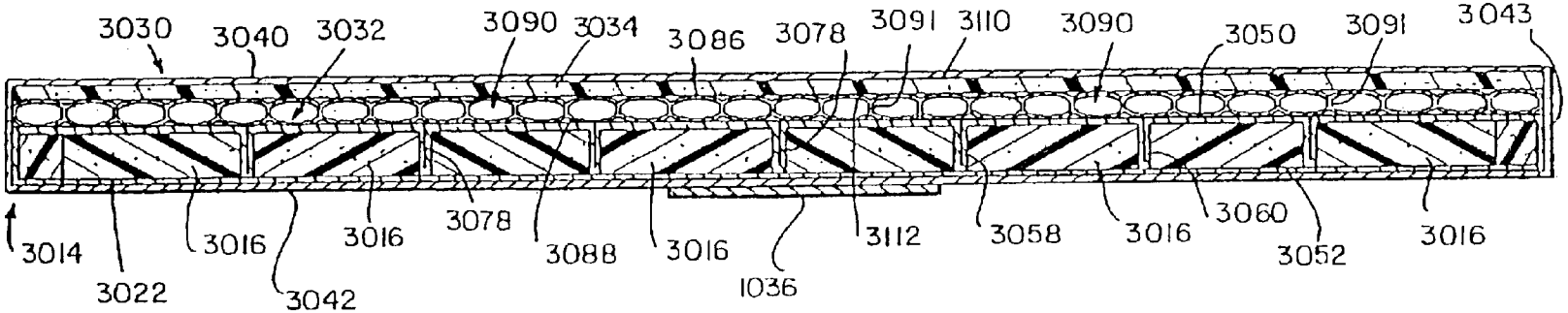
FIG. 58 is a cross-sectional view of the mattress structure of FIG. 56 in an assembled position showing the foam topper situated upon the air bladder and the air bladder situated upon the sleeve and also showing the fabric shell having generally the same predetermined height so that the mattress structure is interchangeable between the first and second configurations.

As shown in FIG. 57, blocks 3016 are positioned to lie within slip cover 3022 adjacent bottom panel 3042 of fabric shell 3014. Blocks 3016 cooperate with slip cover 3022 to form a core portion of mattress structure 3010. Blocks 3016 are formed in a rectangular shape (See FIGS. 56 and 58) and include a top surface 3050 facing top panel 3040 of shell 3014, a bottom surface 3052 facing bottom panel 3042 of shell 3014, opposite ends 3054, 3056 and side edges 3058, 3060 extending between top and bottom surfaces 3050, 3052. As shown in FIGS. 57 and 58, mattress structure 3010 includes eight blocks 3016. Two blocks 3016 form opposite ends 3062, 3064 while six blocks 3016 form a middle segment 3066. It is understood that greater or fewer than eight blocks 3016 may be used without exceeding the scope of the invention as presently perceived.

Referring now to FIG. 55, a portion of side rail 3018 is positioned to lie adjacent and is affixed to end 3054 of each block 3016 and a portion of side rail 3018 is positioned to lie adjacent and is affixed to opposing end 3056 of each block 3016. The purpose of end rails 3020 and side rails 3018 is to build a firm perimeter amount the mattress. This firm perimeter serves to keep the user from rolling out and improves comfort when sitting on the edge of the bed. As shown in FIG. 56, end rail 3020 is positioned to lie between spaced-apart side rails 3018 at opposite ends 3062, 3064.

Side and end rails 3018, 3020 are affixed to blocks 3016 by an adhesive. It is understood that a wide variety of commercially available adhesives can be used in accordance with the present invention so long as the adhesive is suitable for use with the material used to form side and end rails 3018, 3020, and blocks 3016. Alternatively, side and end rails 3018, 3020 can be coupled to blocks 3016 by hook-and-loop type connectors, buttons, snaps, and the like without exceeding the scope of the invention as presently perceived. Side and end rails 3018, 3020 are constructed of materials similar to frame 574 and blocks 592 as previously discussed. As will be discussed further in connection with FIG. 59, it should be understood that fewer than all of blocks 3016 may be affixed to side rails 3018 in accordance with the present invention.

As described above, side rails 3018 and end rails 3020 of mattress structure 3010 are integrally coupled to blocks 3016 minimizing the number of components for assembly by the seller or the user. To further simplify the assembly of mattress structure 3010, the firmness characteristics of side rails 3018, end rails 3020, and blocks 3016 may be selected to be symmetrical about a point in the middle of mattress structure 3010 so that it is impossible to improperly place blocks 3016 in interior region 3044. For example, if each block is of uniform firmness from side rail 3018 to side rail 3018; if each portion of side rail 3018 is made from material of the same firmness; if each end rail 3020 is made from material of the same firmness; and if the firmness characteristics of blocks 3016 vary so that the firmness characteristics of blocks 3016(*a*) are equivalent, the firmness characteristics of blocks 3016(*b*) are equivalent, the firmness characteristics of blocks 3016(*c*) are equivalent, and the firmness characteristics of blocks 3016(*d*) are equivalent; then even when the firmness characteristics of blocks 3016(*a*) vary from those of blocks 3016(*b*), 3016(*d*), or when the firmness characteristics of any of blocks 3016(*b*), 3016(*c*), 3016(*d*) vary from the others, mattress structure 3010 will provide the expected firmness characteristics regardless of the orientation of blocks 3016 in interior region 3044 provided that blocks 3016 are arranged in the proper order relative to one another.

As shown in FIGS. 55 and 56, slip cover 3022 is provided to house blocks 3016 and rails 3018, 3020 to permit independent action of blocks 3016. Slip cover 3022 therefore permits both vertical controlled compression and head-to-toe zoning. Slip cover 3022 is positioned to lie adjacent bottom panel 3042 of fabric shell 3014. Slip cover 3022 includes a top panel 3070 facing away from bottom panel 3042 of fabric shell 3014 and an opposite bottom panel 3072 adjacent bottom panel 3042. In addition, a plurality of transversely extending seams 3078 (See FIG. 57) extend between opposite top and bottom panels 3070, 3072 to form a plurality of pockets 3080 therebetween that receive blocks 3016 therein. Slip cover 3022 is made material having a low coefficient of friction as were sleeves 98, 598 so that friction acting between blocks 3016 is minimized enabling the individual compression of blocks 3016. Moreover, pockets 3080 inhibit migration of blocks 3016 within interior region 3044 of shell 3014 and, when blocks 3016 are shipped within pockets 3080, blocks 3016 are retained in their proper order adding to the ease of assembly of mattress structure 3010 as described above. Finally, slip cover 3022 permits blocks 3016 to be folded together to enable efficient storage or shipping of mattress structure 3010. Thus, mattress structure 3010 is easy to unfold as it is symmetric along a center line. This folding feature enables structure to be shipped easily. Moreover, sleeve 3022 covers blocks 3016 for an aesthetically pleasing appearance.

As shown in FIG. 55, bottom panel 3072 of slip cover 3022 is formed to include slots 3084 therethrough. Slots 3084 permit the insertion of blocks 3016 and rails 3018, 3020 into pockets 3080 as shown by arrows 3081. Slots 3084 expose blocks 3016 to bottom panel 3042. So, friction between blocks 3016 and panel 3042 inhibit sliding movement of slip cover 3022 relative to shell 3014. Illustratively, one slot 3084 extends into each pocket 3080 although, if desired, multiple slots could be provided to further ease assembly of mattress structure 3010. Slot 3084 is approximately 2 inches (5.1 cm) in width so that block 3016 engages bottom panel 3042 of shell 3014 to inhibit slip cover 3022 from sliding thereon. It is understood that the size as well as the positioning of slot 3084 may vary in accordance with the present invention.

As shown in FIG. 55, a foam topper 3024 is positioned to lie upon slip cover 3022 within interior region 3044 of shell 3014 to form first configuration 3028. Topper 3024 extends across slip cover 3022 and engages side wall 3043 of fabric shell 3014 to lie over zone blocks 3016 and side and end rails 3018, 3020. Topper 3024 is constructed of materials similar to blocks 3016. The firmness of topper 3024 is less than the firmness of blocks 3016. It is understood, however that the firmness of topper 3024 can be greater than that of blocks 3016 without exceeding the scope of the present invention.

Topper 3024 includes an upper side 3092 and an opposite bottom side 3094 facing slip cover 3022. Bottom side 3094 is formed to include interruptions 3096 therein. Illustratively, bottom side 3094 includes convolutions. It is understood, that topper 3024 can be formed without interruptions 3096 or that upper side 3092 may be formed with interruptions in accordance with the present invention. Topper 3024 also includes opposite ends 3098 having a predetermined height, and side edges 3100 engaging opposite ends 3098 at spaced-apart corners 3102.

As shown in FIG. 55, straps 3104 extend from topper 3024 to minimize movement of topper 3024 within interior region 3044 of fabric shell 3014. Straps 3104 include opposite ends 3106 coupled to upper side 3092 of topper 3024 adjacent each corner 3102 and a middle portion 3108 extending between opposite ends 3106. Middle portion 3108 serves as a loop and is sized to extend under zoned core slip cover 3022 to couple topper 3024 thereto. Straps 3104 are coupled to topper 3024 using hook and loop type fasteners. It is understood, however, that straps 3104 may be coupled to core 3024 using a wide variety of adhesives, snaps, buckles, ties, buttons, seams or the like in accordance with present invention.

As shown in FIG. 56, mattress structure 3010 may be upgraded to replace topper 3024 of first configuration 3028 with static air bladder 3032 and a thin topper 3034 to form an upgraded second configuration 3030. Upgraded configuration 3030 provides three-dimensional zoning which includes the advantages of head-to-toe zoning along with the advantage of adjustable firmness. Bladder 3032 is positioned to lie upon the zoned core 3022 within interior region 3044. Bladder 3032 extends across zoned core 3022 and engages side walls 3043 of fabric shell 3014. Thus, bladder 3032 lies over eight composite zones. Bladder 3032 is preferably inflated and deflated using air, however any acceptable fluid such as other gasses or liquids such as water and water having additives to adjust the viscosity of the resultant liquid can be used to inflate bladder 3032 without exceeding the scope of the invention as presently perceived. Thus, throughout the specification and claims such fluid will be referred to as air, although it is understood that other fluids may be used.

Bladder 3032 is a "one-zone" bladder having one continuous air pocket extending through bladder 3032 so that the entire bladder.3032 is uniformly inflated and deflated each time air is added to or removed from bladder 3032. Illustratively, bladder. 3032 is inflated to a maximum height of about 2.5 inches (6.4 cm). It is understood, however, that the height of bladder 3032 may vary without exceeding the scope of the present invention. Bladder 3032 may also be a multiple-zoned air bladder having independently inflatable zones (not shown) without exceeding the scope of the present invention. Bladder 3032 is positioned over blocks 3016. Therefore, should bladder 3032 deflate, blocks 3016 will provide support to the user.

Figure 60:
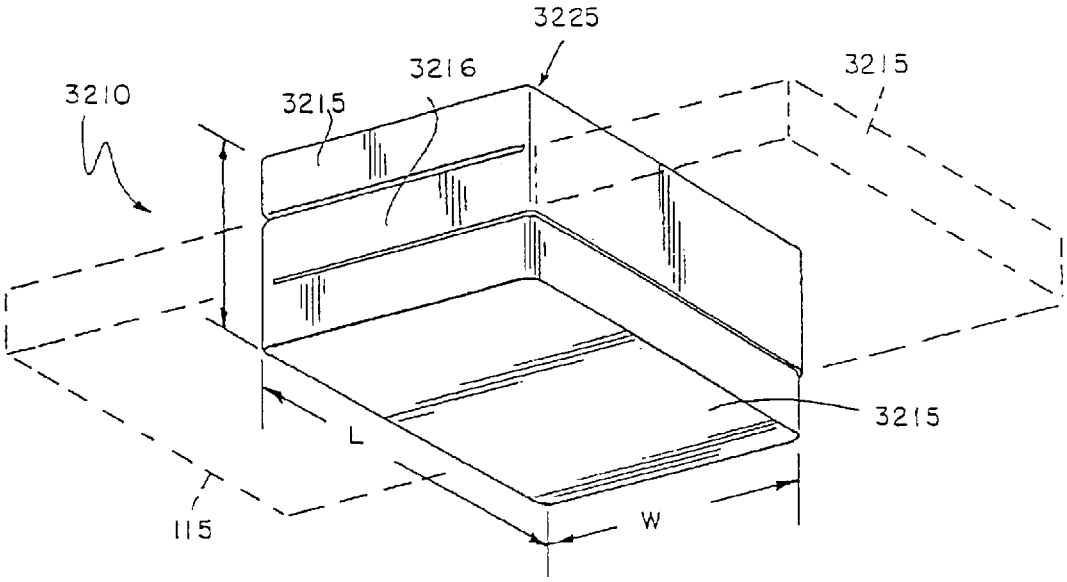
FIG. 60 is a perspective view of mattress structure of FIG. 59 in a folded position showing (in phantom) the relative positioning of the end foam blocks in the unfolded position and the symmetry of the end foam blocks to aid the manufacturer in storing and shipping the mattress structure.

Bladder 3032 is constructed from an upper sheet 3086 of an air impermeable material that is bonded to a lower sheet 3088 of an air impermeable material about a perimeter. It is understood that upper and lower sheets 3086, 3088 may be bonded together by heat. Specifically, upper and lower sheets 3086, 3088 are constructed of a nylon outer portion and a urethane inner portion. To couple upper and lower sheets 3086, 3088 together the urethane inner portions are placed together and heated until the inner portions are bonded together. It is understood that bladder may be formed using a wide variety of techniques, such as a perimetral bead of adhesive to form an air-tight perimetral seal. Upper and lower sheets 3086, 3088 cooperate to define an internal region 3090 of bladder 3032 that is air impermeable, as shown in FIG. 60. In addition, I-beams 3091 are positioned within internal region 3090 and are affixed to both upper sheet 3086 and lower sheet 3088 in order to establish the height of fully-inflated bladder 3032 and to provide uniform height across bladder 3032 when inflated. I-beams extend generally transversely across bladder 3032 and are formed to include holes (not shown) therethrough. Holes permit air to travel through bladder 3032 upon compression of bladder 3032 due to a user moving upon bladder 3032 or to articulation of the frame upon which bladder 3032 is situated.

As shown in FIG. 58, thin topper 3034 is positioned to lie upon upper sheet 3086 of bladder 3032. Thin topper 3034 has a top side 3110, an opposite bottom side 3112 facing bladder 3032, opposite ends 3114 having a pre-determined height, and side edges 3116 (See FIG. 59) engaging opposite ends 3114 at spaced-apart corners 3118. Bottom side 3112 of topper 3034 is formed to include interruptions 3120 therein. Illustratively, bottom side 3112 includes convolutions therein. It is understood that thin topper 3034 can be formed without interruptions 3120 or that top side 3110 may be formed with interruptions in accordance with the present invention.

As shown in FIG. 56, straps 3122 extend from topper 3034 to minimize movement of topper 3034 and bladder 3032 within interior region 3044 of fabric shell 3014. Straps 3122 include opposite ends 3124 coupled to top side 3110 of topper 3034 adjacent each corner 3118 and a middle portion 3126 that serves as a loop and extends between opposite ends 3124. Middle portion 3126 is sized to extend under zoned core 3022 to couple topper 3034 thereto. Straps 30122 are coupled to thin topper 3034 using hook and loop-type fasteners (not shown). It is understood, however, that straps 3122 may be coupled to topper 3034 using a wide variety of adhesives, snaps, buckles, ties, buttons, seams, or the like without exceeding the scope of the invention as presently perceived. Thus, mattress structure 3010 may be interchanged with core 3024 and bladder 3032/topper 3034.

Figure 59:
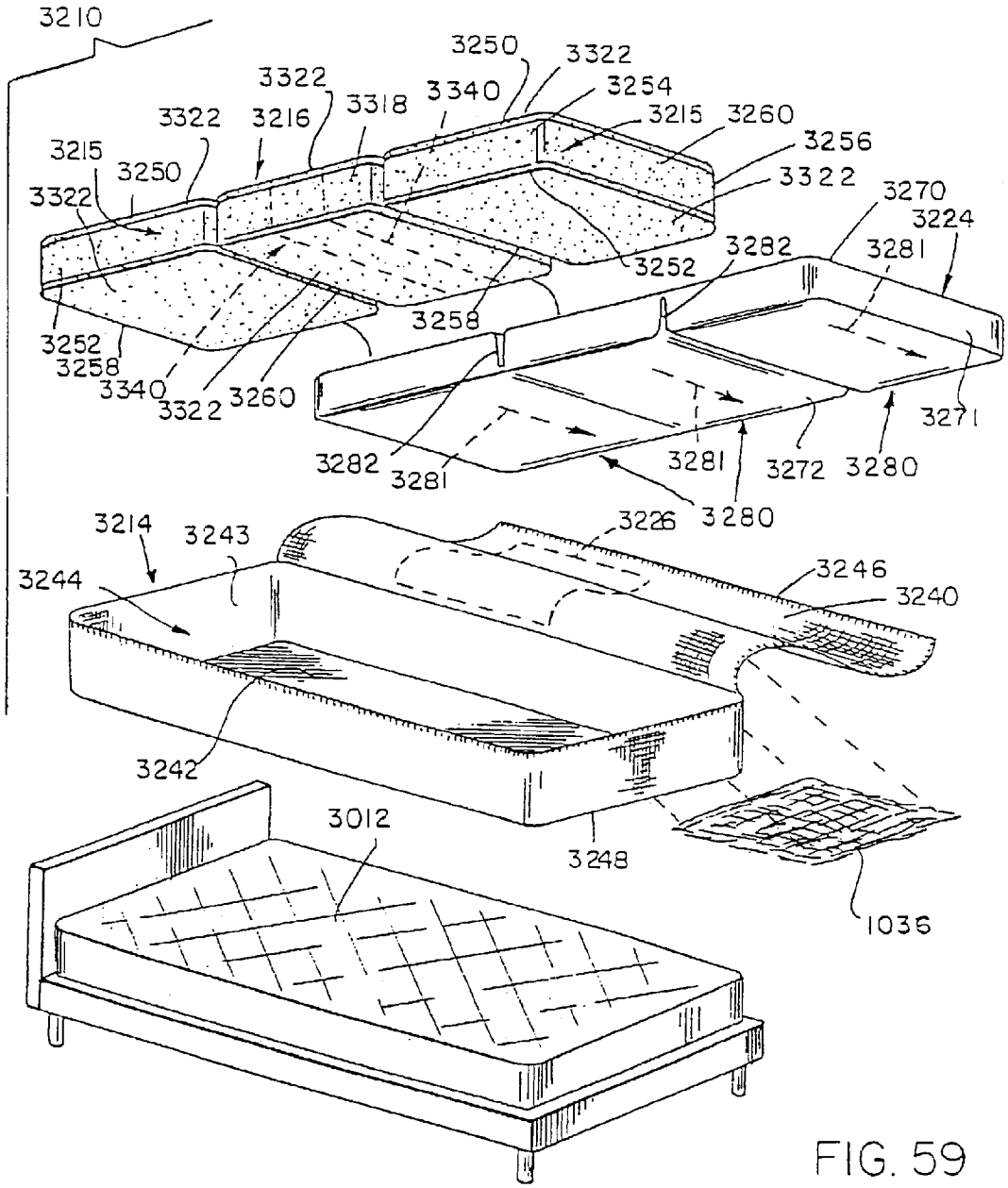
FIG. 59 is an exploded assembly view of an alternative embodiment of the present invention showing a mattress structure including a fabric shell, anti-skid material affixed to fabric shell, opposite end foam blocks, a center block that includes three symmetric zoned foam blocks (in phantom), foam side rails and toppers coupled to end and center blocks, and a sleeve formed to receive the end and center blocks.

A reversible mattress structure 3210, shown, for example in FIG. 59 can be provided in accordance with the present invention. Mattress structure 3210 is easy to ship and assembly and provides the user with two-dimensions of zoning. Mattress structure 3210 includes a fabric shell 3214, end foam blocks 3215, a center block 3216, and a cover 3224 formed to receive blocks 3215 and center block 3216. Cover 3224 permits mattress structure to be easy to unfold as it is symmetric along a center line. This folding feature enables efficient storage or shipping of mattress structure 3210. Cover 3224 in mattress structure 3210 also allows the blocks 3215,3216 to be easily positioned inside the zippered fabric shell 3214. Cover 3224 also helps to "self-locate" blocks 3215,3216 within shell 3214 since corner seams on cover 3224 align with block corners.

Center block 3216 and end blocks 3215 cooperate to define firmness characteristics for mattress structure 3210. For example, blocks 3215, 3216 may provide the user with various degrees of vertical controlled compression and head-to-toe zoning. It is understood that the firmness level of blocks 3215, 3216 may be selected such that structure 3210 has a "soft" or "plush" characteristics, "firm" characteristics, and various firmness characteristics therebetween, as well as various combinations thereof. While one center block 3216 and two end blocks 3215 are illustrated, it is understood that greater or fewer blocks 3215, 3216 may be used in accordance with the present invention.

Fabric shell 3214 includes a top panel 3240, a bottom panel 3242, and a side wall 3243, that cooperate to define an interior region 3244 therebetween. Top and bottom panels 3240, 3242 and side wall 3243 are constructed in a manner similar to shell 3014 as previously discussed. An anti-skid material 1036 may be affixed to top panel 3240 of fabric shell 3214 adjacent center block 3116. Top panel 3240 above blocks 3215, however, is constructed to permit relative movement of a pillow top thereon. Thus, portions of pillow top (not shown) away from anti-skid material 1036, for example, opposite head and foot ends of the pillow top that are positioned to lie directly upon top panel 3240 of fabric shell 3214, are free to slide relative to top panel 3240 during articulating movement of frame 3012. A center section of pillow top (not shown) remains generally stationary relative to top panel 3240 upon anti-skid material 1036.

Top panel 3240 of fabric shell 3214 includes a first perimeter edge 3246 and bottom panel 3242 includes a second perimeter edge 3248. Perimeter edge 3246 of top panel 3240 defines a first area dimension and perimeter edge 3248 of bottom panel 3242 defines a second area dimension that is substantially equivalent to first area dimension. The first and second area dimension will vary depending upon whether mattress structure is a twin sized mattress, a full sized mattress, a queen sized mattress, or a king sized mattress. Side wall 3243 extends between the first and second perimeter edges 3246, 3248. Illustratively, side wall 3243 is coupled to top and bottom panels 3240, 3242 by seams. It is understood, however, that hook and loop type fasteners, a zipper, buttons, snaps, and a wide variety of coupling mechanisms may be used in accordance with the present invention to couple top panel 3240 and bottom panel 3242.

As shown in FIG. 59, blocks 3215, 3216 are sized for extension into cover 3224. Blocks 3215, 3216 cooperate with cover 3224 to form a core 3225 of mattress structure 3210, as shown in FIG. 60. Blocks 3215, 3216 are symmetrical in shape and have generally the same predetermined width w and length L. It is understood that when mattress structure 3210 is a full sized mattress, king sized mattress, or queen sized mattress, greater than one set of end and center blocks 3215, 3216 may be used in a side-by-side relationship in accordance with the present invention.

Blocks 3215 include a top surface 3250 facing top panel 3240 of shell 3214, a bottom surface 3252 facing bottom panel 3242, opposite ends 3254, 3256 and side edges 3258, 3260 extending between top and bottom surfaces 3250, 3252. Blocks 3215 are constructed of a resilient foam material such as urethane foam. Blocks 3215 have a generally equal size and firmness level. It is understood, however, that blocks 3215 may have a variety of sizes and firmness levels and create zones of various firmness in accordance with the present invention. The firmness and support characteristics of the foam rubber can be varied in accordance with the desires of the user of mattress structure as previously discussed with reference to blocks 3016. It is also understood that various materials may be used to construct blocks 3215 as was previously discussed with reference to blocks 3016.

Figure 61:
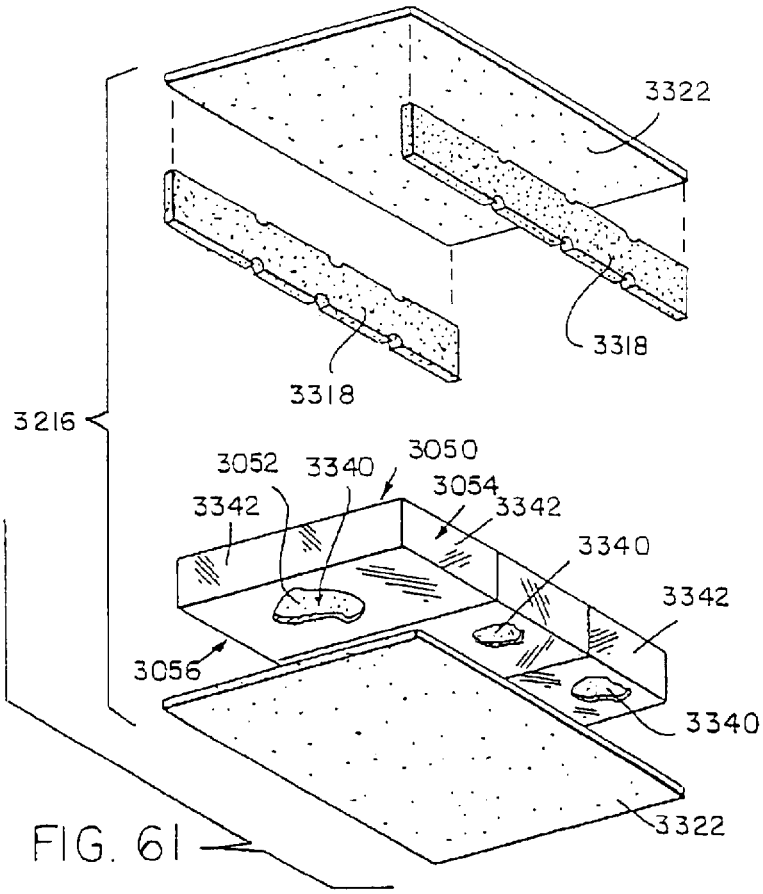
FIG. 61 is an exploded assembly view of the center block of FIG. 59 showing three symmetric zoned foam blocks therein that are separated by a polyethylene film to enable the blocks to move relative to one another.

As shown in FIG. 61, center block 3216 includes outer zoned blocks 3340, and center zoned block 3341. Blocks 3340 and 3341 are symmetric, meaning that blocks 3340, 3341 have a similar size, shape, firmness, and are aligned along a common axis. Blocks 3340 and 3341 are formed as previously discussed with reference to blocks 3016. Blocks 3340, however, are firmer than block 3341 to provide additional support for the user's thighs and lumbar. Center zoned block 3341 is less firm to compress adjacent the user's seat. As shown in FIG. 61, a polyethylene film 3342 having a low coefficient of friction extends about each block 3340 to permit blocks 3340 to move independently relative to one another. It is understood that a wide variety of materials having a low coefficient of friction may be adhered to blocks 3340 or may extend around blocks 3340 to permit relative movement therebetween in accordance with the present invention.

As shown in FIG. 61, a foam side rail 3318 is positioned to lie adjacent each opposite end 3054, 3056 of foam blocks 3340. Side rails 3318 are affixed to blocks 3340 by an adhesive. It is understood that a wide variety of commercially available adhesives can be used in accordance with the present invention so long as the adhesive selected is suitable for use with the material from which blocks 3340 are made. Moreover, side rails 3318 can be coupled to blocks 3340 by hook-and-loop type connectors, buttons, snaps, and the like. Side rails 3318 are constructed similar to frame 574 as previously discussed and are constructed of a firmer foam than blocks 3215, 3216. Side rails 3318 provide support to the user when entering or leaving mattress structure 3210. Side rails 3318 are only on center block 3216 because center block 3216 is where users climb on and off of mattress structure 3210. It is understood, however, that side rails 3318 may be positioned adjacent one or more of blocks 3215.

As shown in FIGS. 59 and 61, topper portions 3322 engage top and bottom surfaces 3250, 3252 of blocks 3215 and top and bottom surfaces 3050, 3052 of blocks 3340. Topper portions 3322 provides vertical "controlled compression to minimize interface pressure with user and to maximize comfort. Blocks 3215, 3216 underneath topper surfaces 3322 compress and varying degrees to provide support to various parts of the user. Topper portions 3322 also minimize the ability of the user to perceive the interface between blocks 3340 and rails 3318. Top and bottom surfaces 3250, 3252 and 3050, 3052 of blocks 3215 and 3340 are heat bonded to opposing toppers 3322. It is understood that blocks 3215, 3340 may be coupled to toppers 3322 by hook-and-loop type connectors, buttons, snaps and the like or by a wide variety of commercially available adhesives so long as the adhesive selected is compatible with the materials being adhered.

Cover 3224 is provided to house blocks 3215 and 3216 and toppers 3332. Cover 3224 is positioned to lie adjacent bottom panel 3242 of fabric shell 3014. Cover 3224 includes a top panel 3270 facing away from bottom panel 3242 and an opposite bottom panel 3272. A side wall 3271 extends between top and bottom panels 3270, 3272. Top and bottom panels 3270, 3272 are coupled to side wall 3271 by a seam and form a cavity (not shown) between top and bottom panels 3270, 3272. In addition, three pockets 3280 are formed therebetween that receive blocks 3215, 3216 along line 3281 therein as shown in FIG. 59. Pockets 3280 are spaced apart by seams 3282 that permit individual compression of blocks 3215, 3216 relative to one another. Moreover, pockets 3280 inhibit migration of blocks 3215, 3216 within interior region 3244 of shell 3214. Cover 3224 is made from a material having a low coefficient of friction such as a polyester non-woven material or nylon to serve as an anti-shear coating.

Further, cover 3224 permits blocks 3215, 3216 to be folded together, as shown in FIG. 60, to enable efficient storage or shipping of mattress'structure 3210. Thus, mattress structure 3210 is easy to unfold as it is symmetric along a center line. Moreover, cover 3224 covers blocks 3215, 3216 for an aesthetically pleasing appearance. Since cover 3224 is symmetric, mattress structure 3210 is essential "fool proof" in that users receiving structure 3210 in their home cannot install cover 3224 into shell 3214 improperly.

Figure 64:
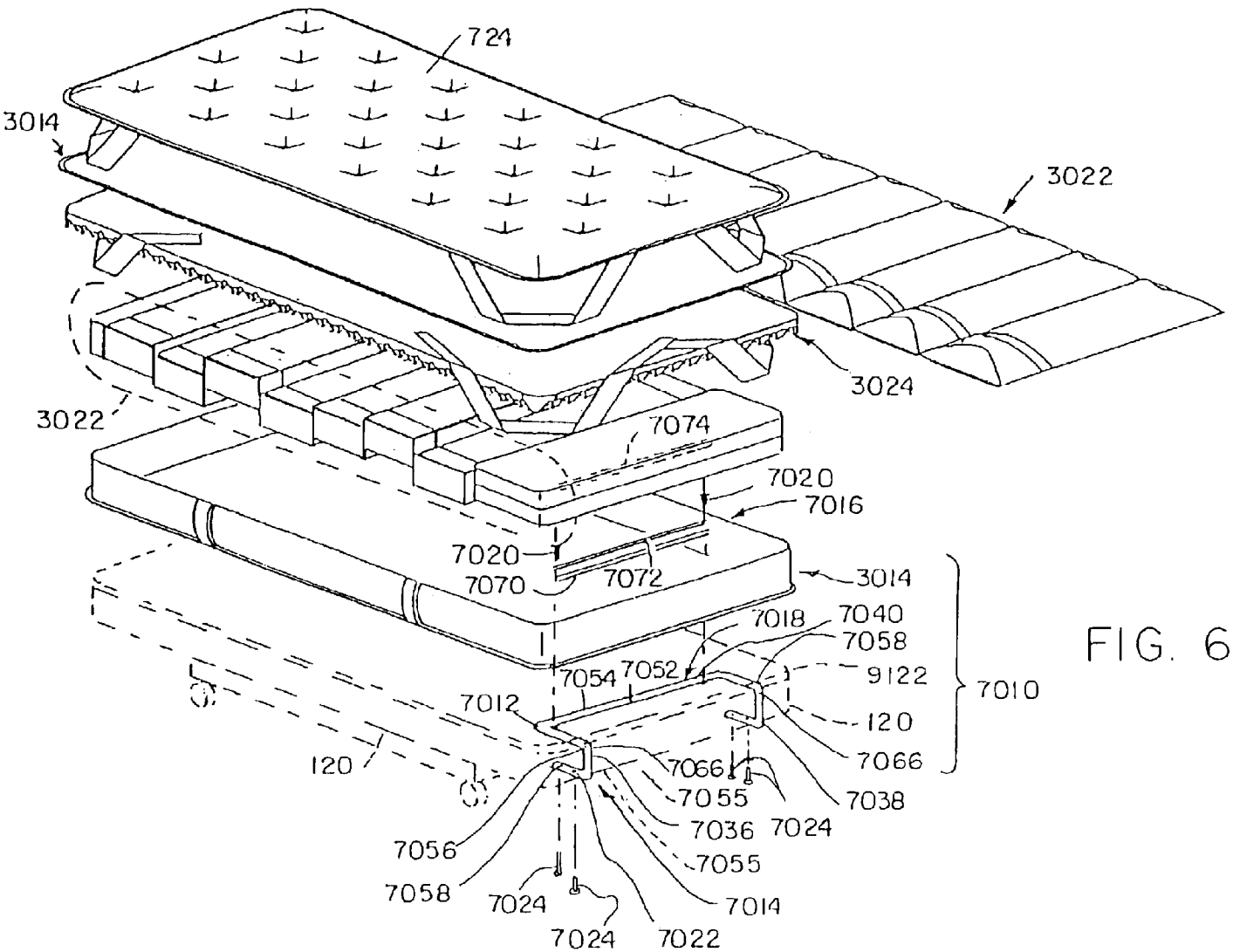
FIG. 64 is an exploded perspective view of a mattress retention bracket in accordance with the present invention showing the bracket including a retainer configured for extension into a block and a support frame configured to be coupled to a foundation and to the retainer.

Referring now to FIG. 64, a mattress retention bracket 7010 is provided in accordance with the present invention for use with a mattress structure 3010 to prevent mattress structure 3010 from sliding off of foot-end 7055 of foundation 120. Foundation 120 is formed to include a foam covering (not shown) to give foundation 120 the appearance of a conventional set of box springs. While mattress structure 3010 is illustrated and described, it is understood that retention bracket 7010 may be used with any number of mattresses in accordance with the present invention. Bracket 7010 includes a cantilevered support bar 7014 and a retainer 7016.

Retention bracket 7010 includes a support frame 7012 having base legs 7036, 7038 and a cantilevered retainer-support leg 7018 elevated above base legs 7036, 7038. Retainer 7016 is coupled to retainer-support leg 7018 above base legs 7036, 7038 by screws 7020. It is understood, however, that any number of fasteners such as pins, rivets, staples, etc. may be used in accordance with the present invention. Support frame 7012 is formed for secure stationary positioning upon foundation 120. Retainer-support leg 7018 interconnects opposite legs 7036, 7038.

Retainer-support leg 7018 as shown in FIG. 64 has a curved shaft 7040 portion with a concave side 7052 arranged to face respective base legs 7036, 7038 and an opposite convex side 7054. The retainer-support leg 7018 includes opposite end portions 7056, 7058 and the curved shaft 7040 portion extends between the opposite end portions 7056, 7058. Curved shaft portion 7040 also includes apertures (not shown) therethrough. The end portions 7056, 7058 are positioned in a spaced-apart relation to one another. It is understood that retainer-support leg 7018 may be formed in a variety of shapes so long as it interconnects base legs 7036, 7038.

Each base leg 7036, 7038 is configured to wrap about foundation 120 and includes a coupling end 7058 in generally a first plane and an upstanding end 7066 extending vertically above the first plane. Preferably, each base leg 7036, 7038 extends vertically upward from the first plane toward retainer-support leg 7016. Coupling ends 7058 each include an aperture 7022 sized to receive a screw 7024 therethrough. It is understood that any number of fasteners such as pins, rivets, staples, etc. may be used in accordance with the present invention.

Retainer 7016 includes a base portion 7070 and a tab 7072 that extends vertically away from base portion 7070. Base portion 7070 is configured to lie generally adjacent retainer-support leg 7018 and includes apertures (not shown) that are sized to receive screws 7020 therethrough.

To couple mattress retention bracket 7010 to foundation 120 and mattress structure 3010, base legs 7036, 7038 are wrapped about foundation 120 and ends 7058 are coupled to foundation by screws 7024. Thus, support frame 7012 is held securely onto foundation 120. Tab 7072 of retainer 7016 is inserted into a pre-formed slit 7074 formed within block 3016. Base portion 7070 of retainer 7016 is aligned with retainer-support leg 7018 and screws 720 are extended through base portion 7070, fabric shell 3014, and apertures in curved shaft portion 7040 to couple retainer 7016 to support frame 7012. Thus, stationary tab 7072 prevents blocks 3016 from sliding off of foot-end 7055 of foundation 120.

Figure 65:
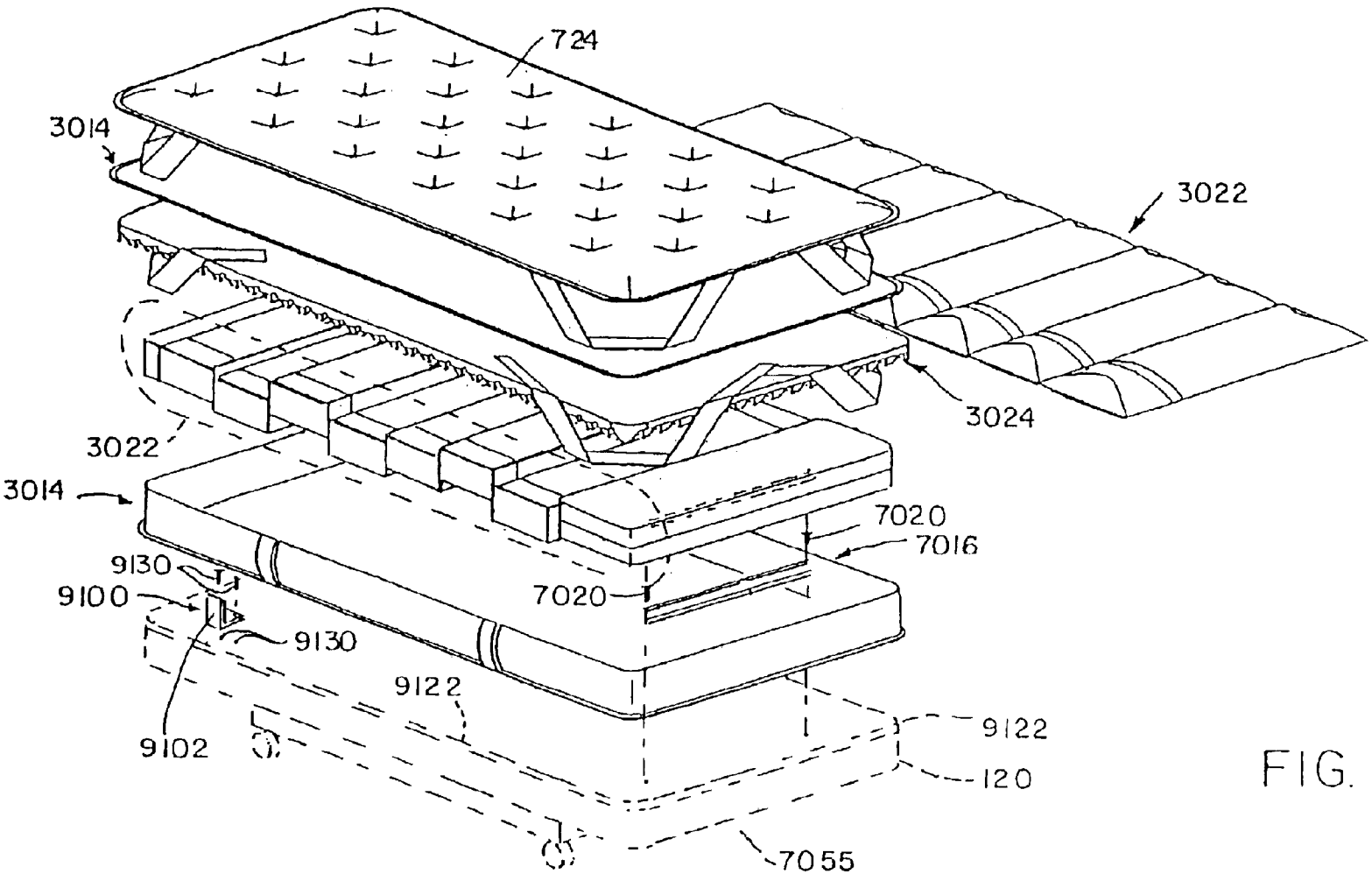
FIG. 65 is an exploded perspective view of a mattress retention apparatus that prevents an associated mattress structure from sliding laterally upon a foundation having a solid deck and the retainer of FIG. 64 configured to be coupled the solid support of the foundation.

In an alternative embodiment of the present invention, a mattress retention apparatus 9100 is shown in FIG. 65. Retention apparatus 9100 prevents an associated mattress structure 3014 from sliding laterally upon a foundation 9120 having a solid deck 9122. Retention apparatus 9100 includes an L-shaped bracket 9102 that is coupled to deck 9122 by screws 9130. It is understood that any number of fasteners such as pins, rivets, staples, etc. may be used in accordance with the present invention. Bracket 9102 includes an upper portion 9104 that comes along side of mattress structure 3104 to prevent mattress structure 3104 from sliding off of foundation 9120 while foundation 9120 is being articulated.

Still another embodiment of the present invention is illustrated in FIG. 65. Retainer 7016, as previously discussed with reference to FIG. 64, is coupled solid support 9122 of foundation 9120 by screws 9020. It is understood, however, that any number of fasteners such as pins, rivets, staples, etc. may be used in accordance with the present invention. Retainer 7016 may be used to couple any number of a wide variety of mattress structures directly to foundation 9120, so long as foundation 9120 has a solid deck 9122.

Although the invention has been described in detail with reference to a preferred embodiment, variations and modifications exist within the scope and spirit of the invention as described and defined in the following claims.

What is claimed is:

1. A mattress including first and second regions having first and second different compressibilities, respectively, the first and second regions defining a substantially continuous surface upon which a person reclines, the first region supporting a first region of the body of the person reclining on the mattress, the second region supporting a second region of the body of the person, wherein at least one of the regions includes a softer upper layer, a firmer intermediate layer and a softer lower layer presenting a first compressibility to a person reclining on the at least one of the regions during a first interval of compression and a second compressibility to the person on the at least one of the regions during a second interval of compression, and further including an anti-shear material between the first and second regions permitting relative movement between the first and second regions.

2. The mattress of claim 1 wherein the anti-shear material includes a sleeve for receiving one of the first and second regions.

3. The mattress of claim 2 wherein the anti-shear material includes sleeves for receiving both of the first and second regions.

4. The apparatus of claim 1 wherein the at least one region gives a softer feel when the person's weight is distributed generally uniformly over the at least one region, and gives a firmer feel when the person's weight is not distributed generally uniformly over the at least one region.

5. The mattress of claim 1 wherein the mattress has first and second ends and first and second sides, the first region lying closer to the first end and the second region lying closer to the second end.

6. The mattress of claim 1 wherein the mattress has first and second ends and first and second sides, the first region lying closer to the first side and the second region lying closer to the second side.

7. Apparatus for retaining an elongate mattress on an elongate foundation, the mattress including a first surface and the foundation including a second surface adjacent which the first surface rests when the mattress is on the foundation, the apparatus including an elongated and laterally-extending relief formed in one of the first and second surfaces, and an elongated and laterally-extending retainer configured to be received in the relief, the retainer being coupled to the other of the first and second surfaces, and wherein the first surface includes a first end and a second end and the second surface includes a first end and a second end, and wherein the retainer is positioned closer to one of the first and second ends of one of the first and second surfaces and the relief is positioned closer to a corresponding one of the first and second ends of the other of the first and second surfaces.

8. The apparatus of claim 7 wherein the relief is formed in the first surface and the retainer is coupled to the second surface.

9. The apparatus of claim 7, wherein the mattress and the foundation each has first and second sides, the first surface comprises one of the ends of the mattress and the second surface comprises one of the ends of the foundation.

10. The apparatus of claim 7, wherein one of the first and second surfaces is generally vertical.

11. The apparatus of claim 7, wherein the elongated and laterally-extending relief and retainer each extend along a majority of the width of the mattress.

* * * * *